US011536050B2

(12) United States Patent
Zhou et al.

(10) Patent No.: US 11,536,050 B2
(45) Date of Patent: Dec. 27, 2022

(54) SYSTEMS FOR SMART SECURITY

(71) Applicant: YUNDING NETWORK TECHNOLOGY (BEIJING) CO., LTD., Beijing (CN)

(72) Inventors: Shuwen Zhou, Beijing (CN); Wenfeng Li, Beijing (CN); Qi Yi, Beijing (CN); Tao Li, Beijing (CN)

(73) Assignee: YUNDING NETWORK TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/453,828

(22) Filed: Nov. 5, 2021

(65) Prior Publication Data

US 2022/0056734 A1 Feb. 24, 2022

Related U.S. Application Data

(63) Continuation of application No. PCT/CN2020/107524, filed on Aug. 6, 2020.

(30) Foreign Application Priority Data

Aug. 6, 2019 (CN) ..... 201910721176.9
Aug. 6, 2019 (CN) ..... 201910722089.5
(Continued)

(51) Int. Cl.
*E05B 47/00* (2006.01)
*E05B 15/00* (2006.01)
*G07C 9/00* (2020.01)

(52) U.S. Cl.
CPC ..... *E05B 47/0012* (2013.01); *E05B 15/00* (2013.01); *G07C 9/00738* (2013.01);
(Continued)

(58) Field of Classification Search
CPC ..... E05B 47/00; E05B 47/0012; E05B 15/00; E05B 2047/0022; E05B 2047/0026; E05B 2047/0061; G07C 9/00738; G07C 9/00944
(Continued)

(56) References Cited

U.S. PATENT DOCUMENTS 9,644,398 B1 * 5/2017 Cheng ..... E05B 47/0012
2008/0307837 A1 * 12/2008 Greiner ..... E05B 47/0012 292/172
(Continued)

FOREIGN PATENT DOCUMENTS

CN 106996223 A * 8/2017
CN 108915418 A 11/2018
(Continued)

OTHER PUBLICATIONS

International Search Report in PCT/CN2020/107524 dated Nov. 6, 2020, 12 pages.
(Continued)

*Primary Examiner* — Suzanne L Barrett
(74) *Attorney, Agent, or Firm* — Metis IP LLC

(57) ABSTRACT

The present disclosure provides systems for smart security. The system may include a smart security device, a control module, a driving module, and a mechanical structure. The control module may be configured to send a control instruction to the driving module. The driving module may be configured to drive the mechanical structure based on the control instruction, thereby performing a state switching operation of the smart security device.

13 Claims, 25 Drawing Sheets

(30) Foreign Application Priority Data

| | | |
|---|---|---|
| Aug. 6, 2019 | (CN) | 201910722796.4 |
| Aug. 6, 2019 | (CN) | 201921268299.3 |
| Aug. 6, 2019 | (CN) | 201921269377.1 |
| Aug. 6, 2019 | (CN) | 201921269379.0 |
| Aug. 6, 2019 | (CN) | 201921269398.3 |
| Aug. 6, 2019 | (CN) | 201921269399.8 |
| Aug. 6, 2019 | (CN) | 201921269432.7 |
| Aug. 6, 2019 | (CN) | 201921269526.4 |

(52) U.S. Cl.
CPC .. *G07C 9/00944* (2013.01); *E05B 2047/0022* (2013.01); *E05B 2047/0026* (2013.01); *E05B 2047/0061* (2013.01)

(58) Field of Classification Search
USPC ..... 70/279.1–283
See application file for complete search history.

(56) References Cited

U.S. PATENT DOCUMENTS

| | | | | |
|---|---|---|---|---|
| 2013/0192317 | A1* | 8/2013 | McKibben | G08C 17/02 292/144 |
| 2016/0326774 | A1 | 11/2016 | Dehaven et al. | |
| 2018/0051482 | A1 | 2/2018 | Miller et al. | |
| 2019/0145130 | A1* | 5/2019 | Affan | E05B 47/026 292/144 |
| 2020/0354991 | A1* | 11/2020 | Derham | E05B 63/0065 |
| 2021/0381276 | A1* | 12/2021 | Zou | E05B 47/0012 |
| 2022/0068060 | A1* | 3/2022 | Li | H04W 4/025 |

FOREIGN PATENT DOCUMENTS

| | | | | | |
|---|---|---|---|---|---|
| CN | 208310446 | U | | 1/2019 | |
| CN | 109653596 | A | | 4/2019 | |
| CN | 109667482 | A | | 4/2019 | |
| CN | 213058125 | U | * | 4/2021 | |
| DE | 10235201 | B4 | * | 2/2006 | E05B 47/0615 |
| EP | 2996487 | A2 | | 3/2016 | |
| GB | 2595007 | A | * | 11/2021 | E05B 47/0012 |
| WO | WO-2016057675 | A2 | * | 4/2016 | E05B 47/0002 |
| WO | WO-2017046399 | A1 | * | 3/2017 | E05B 47/0012 |
| WO | 2019071306 | A1 | | 4/2019 | |
| WO | WO-2021023278 | A1 | * | 2/2021 | E05B 1/003 |
| WO | WO-2021156498 | A1 | * | 8/2021 | |

OTHER PUBLICATIONS

Written Opinion in PCT/CN2020/107524 dated Nov. 6, 2020, 7 pages.

* cited by examiner

SYSTEMS FOR SMART SECURITY

CROSS-REFERENCE TO RELATED APPLICATION

This application is a Continuation of International Application No. PCT/CN2020/107524 filed on Aug. 6, 2020, which claims priority of Chinese Patent Application No. 201910722796.4 filed on Aug. 6, 2019, Chinese Patent Application No. 201921269379.0 filed on Aug. 6, 2019, Chinese Patent Application No. 201910722089.5 filed on Aug. 6, 2019, Chinese Patent Application No. 201921269377.1 filed on Aug. 6, 2019, Chinese Patent Application No. 201921269398.3 filed on Aug. 6, 2019, Chinese Patent Application No. 201921269399.8 filed on Aug. 6, 2019, Chinese Patent Application No. 201921269526.4 filed on Aug. 6, 2019, Chinese Patent Application No. 201921269432.7 filed on Aug. 6, 2019, Chinese Patent Application No. 201910721176.9 filed on Aug. 6, 2019, and Chinese Patent Application No. 201921268299.3 filed on Aug. 6, 2019, the contents of each of which are hereby incorporated by reference in its entirety.

TECHNICAL FIELD

The present disclosure relates to the field of smart security, in particular to systems for smart security.

BACKGROUND

With the continuous development of science and technology, systems for smart security are gradually recognized and favored by consumers due to advantages such as convenience, safety, technology, etc., and have brought great convenience to people's lives.

Therefore, the present disclosure provides systems for smart security with high security and good experience.

SUMMARY

One aspect of the present disclosure provides a system for smart security. The system may include a smart security device, a control module, a driving module, and a mechanical structure. The control module may be configured to send a control instruction to the driving module. The driving module may be configured to drive the mechanical structure based on the control instruction to perform a state switching operation on the smart security device.

In some embodiments, the smart security device may include a smart lock. The smart lock apparatus may include a lock body structure. The mechanical structure may include a transmission assembly disposed between the driving module and the lock body structure. The transmission assembly may be configured to connect the driving module and the lock body structure in a transmission connection.

In some embodiments, the transmission assembly may include a lock body connection member. The lock body connection member may be configured to drive the lock body structure to rotate. The transmission assembly may further include a clutch mechanism. The clutch mechanism may be configured to couple or separate the driving module and the lock body connection member during a rotation transmission process.

In some embodiments, the clutch mechanism may include a planet transmission assembly. The planet transmission assembly may include a sun gear, a planet carrier, a first planet gear, and a second planet gear. The first planet gear and the second planet gear may be disposed on the planet carrier. The driving module may be configured to drive the sun gear to rotate. Rotations of the first planet gear and the second planet gear driven by the sun gear may cause the planet carrier to swing between a first position and a second position. When the planet carrier is in the first position, a first coupling relationship may be formed between the first planet gear and the lock body connection member. When the planet carrier is in the second position, a second coupling relationship may be formed between the second planet gear and the lock body connection member. The planet carrier may further have a transitional rotation stroke between the first position and the second position.

In some embodiments, the driving module may further include a driving component and a reduction stage that is connected to the driving component through a transmission connection. The planet transmission assembly may be disposed between a final-stage element of the reduction stage and the lock body connection member.

In some embodiments, the clutch mechanism may include an output member connected to the driving component through a transmission connection. The output member may be configured to drive the lock body connection member to rotate. A first abutment member may be disposed on the output member. A second abutment member may be disposed on the lock body connection member. The first abutment member may be positioned to abut the second abutment member along a first direction to form a first abutment operation station. The first abutment member may be positioned to abut with the second abutment member along a second direction to form a second abutment operation station. The first abutment member and the second abutment member may be positioned to separate from each other to form an operation vacancy. The first direction may be opposite to the second direction.

In some embodiments, the transmission connection between the driving component and the output member may include a bevel gear transmission.

In some embodiments, the system may further include a detection module. The detection module may be configured to detect a current state of a lock body shaft. The detection module may include a first detection assembly and a control panel connected to the first detection assembly.

In some embodiments, the first detection assembly may include an angle sensor and a rotation detector that is connected to the lock body shaft through a transmission connection. The angle sensor may be fixedly disposed relative to the rotation detector.

In some embodiments, the first detection assembly may further include a position sensor. The position sensor may be disposed on the lock body shaft.

In some embodiments, the system may further include a detection module. The detection module may include a second detection assembly and the control panel being connected to the second detection component. When the driving component drives the lock body shaft to a locked state along the second direction at the second abutment operation station, the driving component may drive the first abutment member to reverse, and the second detection assembly may be configured to detect a reversal angle of the first abutment member.

In some embodiments, the second detection assembly may include a magnetic member and a magnetic encoder that is disposed corresponding to the magnetic member. The magnetic member may be disposed on the output member or an output shaft of the driving component. The magnetic encoder may be disposed on the control panel.

In some embodiments, the detection module may further include an induction assembly. The induction assembly may include a first induction element and a second induction element. The first induction element may be fixedly disposed relative to the lock body connection member; and the second induction element may be configured to rotate relative to the first induction element. The rotation of the lock body shaft may be configured to drive the first induction element to move relative to the second induction element and trigger the first induction element or the second induction element to send a wake-up signal to the control panel.

In some embodiments, the first induction element may include a Hall sensor, and the second induction element may include a magnetic induction member.

In some embodiments, the smart lock may include a mounting plate assembly. The mounting plate assembly may be configured to mount the smart lock. The mounting plate assembly may include a mounting plate and one or more sliding components.

Another aspect of the present disclosure provides a clutch mechanism of a smart lock apparatus. A driving component and a manual knob of the smart lock apparatus may be configured to drive a lock body shaft to rotate through a lock body connection member, respectively, and the lock body connection member may be disposed with an output gear that coaxially rotates. A planet transmission assembly may be disposed between the output gear and a final-stage gear that is connected to an output shaft of the driving component. The planet transmission assembly may include a sun gear configured to engage with the final-stage gear; a planet carrier; and two planet gears rotatably disposed on the planet carrier. The two planet gears may be located on both sides of a connection line of a rotation center of the sun gear and a rotation center of the output gear respectively. When the planet carrier rotates clockwise, a first engagement relationship may be formed between a first planet gear and the output gear. When the planet carrier rotates counterclockwise, a second engagement relationship may be formed between a second planet gear and the output gear. The planet carrier may have a transitional rotation stroke that is switched between the first engagement relationship and the second engagement relationship.

In some embodiments, the planet carrier may include a first plate and a second plate that are spaced apart from each other. The two planet gears may be disposed between the first plate and the second plate.

Still another aspect of the present disclosure provides a smart lock system. The smart lock system may include a driving component and a clutch mechanism as described above. The driving component may drive a lock body shaft to rotate via a lock body transmission member. An output shaft of the drive member may be connected to a gear reduction mechanism through a transmission connection. The final-stage gear may be a final-stage driven gear of the gear reduction mechanism.

In some embodiments, a transmission assembly may include a transmission member box including the driving component, the gear reduction mechanism, clutch mechanism of the smart lock, and the locking body transmission member. The driving component may be a driving motor. The gear reduction mechanism may be a straight gear transmission mechanism.

In some embodiments, the sun gear may be located in the transmission member box body and be fixedly connected to a second plate of the planet carrier.

Still another aspect of the present disclosure provides a smart lock. The smart lock may include a housing and a sealing plate that are formed an internal chamber. A transmission assembly and a control panel may be placed in the internal chamber. A manual knob may be located outside the housing. A driving component and the manual knob may drive, via a lock body transmission member, a lock body shaft to rotate respectively. The transmission assembly may use a smart lock system as described above. The transmission assembly may be disposed in one end portion of the housing, and the control panel may be disposed between the sealing plate and the transmission assembly.

In some embodiments, the other end portion of the housing may be enclosed with the sealing plate to form a lateral insertion opening. A battery compartment assembly may be disposed in the internal chamber via the lateral insertion opening.

In some embodiments, the smart lock may further include a detection switch. The detection switch may be disposed on the control panel. A planet carrier under a normal state may be in an intermediate position of a first engagement relationship and a second meshing relationship, and a first panel of the planet carrier may be disposed with a switch toggle. The switch toggle may be configured that when rotation of the planet carrier forms the first engagement relationship and the second engagement relationship, the detection switch may be triggered to form a corresponding trigger signal respectively, and the trigger signal may be output to the control panel.

In some embodiments, the control panel may output a reversal control signal based on the trigger signal so that the planet carrier is in the intermediate position.

In some embodiments, the control panel may obtain a determination result of the clutch mechanism in a separation state at a condition where the trigger signal is not received, and output an instruction signal for manual operation.

In some embodiments, a detachable clamping mechanism may be disposed between the battery compartment assembly and the housing and/or the sealing plate, and an outer surface of the battery compartment assembly may be engaged with an outer surface of the housing and/or the sealing plate.

In some embodiments, the outer surface of the sealing plate may include an inner recess portion. The inner recess portion may be disposed opposite to the control panel. A rotation buckle plate may be disposed in the inner recess portion. An axial limit matching pair may be disposed between the rotation buckle plate and the sealing plate. The rotation buckle plate may be switched between an assembling operation station and a disassembling operation station in a plane perpendicular to the lock body relative to the sealing plate. The assembling plate may be embedded on an outer side of the rotation buckle plate. An axial clamping adaptation portion may be disposed between the assembling plate and the rotation buckle plate. When the rotation buckle plate is disposed at the assembling operation station, the axial clamping adaptation portion may form an axial limitation. That is, the assembling is completed. When the rotation buckle plate 723 is at the disassembling operation station, the axial clamping adaptation portion may be separated. One end of the lock body connection member may be connected to the lock body transmission member. The lock body connection member and the lock body transmission member may rotate synchronously. The other end of the lock body connection member connected to the lock body shaft may protrude from the assembling plate.

Still another aspect of the present disclosure provides a smart lock apparatus. The smart lock apparatus may include a sealing plate, an intermediate plate, and an assembly plate. The intermediate plate may be rotatably connected to the sealing plate, and an axial limiting member may be disposed between the intermediate plate and the sealing plate. The intermediate plate may include a first clamping member. The assembly plate may include a second clamping member matching with the first clamping member. The intermediate plate may be configured to drive the first clamping member to rotate relative to the sealing plate and cause the first clamping member to clamp with the second clamping member, so as to fix the intermediate plate and the assembly plate.

In some embodiments, the smart lock apparatus may include a fastener. The intermediate plate may include an arc-shaped hole. A head of the fastener may pass through the arc-shaped hole and be fixed to the sealing plate. A diameter of a rear end of the fastener may be greater than a width of the arc-shaped hole, so that the fastener can slide along the arc-shaped hole. The fastener may form the axial limit member.

In some embodiments, the intermediate plate may include an operation portion. The operation portion may extend out of an outer side of an edge of the sealing plate. When the intermediate plate is rotated to clamp with the first clamping member and the second clamping member, the operation portion may be rotated to an outer side of an edge of the sealing plate.

In some embodiments, one of the first clamping member and the second clamping member may be a clamping groove, and the other of the first clamping member and the second clamping member may be a clamping plate adapted to the clamping groove.

In some embodiments, the first clamping member may be a clamping groove, and the second clamping member may be a clamping plate. A flange may be inward disposed on a side of the intermediate plate facing the assembling plate. The flange and a surface of the intermediate plate may form the clamping groove. A notch adapted to the clamping groove may be disposed on an edge of the assembling plate. An edge of the notch may form the clamping plate.

Alternatively, the first clamping member may be a clamping plate, and the second clamping member may be a clamping groove. The flange may be disposed inward on the side of the assembling plate facing the intermediate plate. The clamping groove may be formed on the flange and a surface of the assembling plate. The edge of the intermediate plate may be disposed with the notch adapted to the clamping groove. The edge of the notch may form the clamping plate.

In some embodiments, a count of the first clamping member and a count of second clamping members may be at least two, respectively. The at least two first clamping members and the at least two second clamping members may be disposed at intervals along a circumferential direction of the intermediate plate.

In some embodiments, the assembling plate may be disposed with two fixing holes, and may be fixed to the lock body shaft by fixing bolts passing through the fixing holes. The fixing bolts may be movable in the fixing holes to change a distance between the two fixing bolts.

In some embodiments, the fixing hole may be disposed with a fixing sleeve slidable along the fixing hole. The fixing sleeve may extend out of the fixing hole towards one end of the sealing plate. The extension edge may be abutted an edge of the fixing hole.

In some embodiments, the sealing plate may be disposed with a reserved groove corresponding to the fixing hole, and the intermediate plate may be disposed with a reserved hole corresponding to the fixing hole.

In some embodiments, the smart lock apparatus may include a battery compartment and a housing. The housing may be disposed on one side of the sealing plate away from the assembling plate, and a mounting chamber configured to accommodate the battery compartment may be formed between the housing and the sealing plate. An opening end of the mounting chamber may be disposed with a first buckle. An inner wall of the mounting chamber opposite to the opening end may be disposed with an elastic member. The smart lock apparatus may further include a second buckle. When the battery compartment is disposed in the mounting chamber and the first buckle and the second buckle are in a buckled state, the battery compartment can tightly compress the elastic member.

In some embodiments, the first buckle may include an insertion hole or an insertion groove, and the second buckle may include an insertion plug adapted to the insertion hole or the insertion groove.

In some embodiments, a slideway may be disposed at an end of the battery compartment away from the elastic member, and the insertion plug may be slidable along the slideway to achieve the engagement and disengagement between the insertion plug and the insertion hole or the insertion groove.

Still another aspect of the present disclosure provides a clutch mechanism of a smart lock. A driving component and a manual knob of the smart lock may be configured to drive a lock body shaft to rotate through a lock body transmission member respectively, the lock body transmission member and an output member may be disposed coaxially, and the output member may be connected to an output shaft of the driving component through a transmission connection. One of the output member and the lock body transmission member may include at least one pair of first circumferential limiting parts, and another of the output member and the lock body transmission member may include at least one pair of second circumferential limiting parts. One of the at least one pair of first circumferential limiting parts and one of the at least one pair of second circumferential limiting parts may be formed a set of clutch adaptation pairs. Each set of clutch adaptation pairs may be configured to that each pair of the first circumferential limiting portions parts is circumferentially disposed at interval, each pair of the second circumferential limiting portions parts is adapted to one pair of the first circumferential limiting parts, respectively, to form an operation station that is circumferentially abutting and adapting, and a preset rotation stroke between the lock body transmission member and the output member is switched between two operation stations. The preset rotation stroke may be larger than or equal to an operation stroke of the manual knob.

In some embodiments, the lock body transmission may be pivotally connected to the output member in the preset rotation stroke. A hole wall that forms the pivotal connection may include an inner bump extending radially inward, and an outer surface that forms the pivotal connection may include an outer bump extending radially outward. The first circumferential limit parts may be disposed on the inner bump, and the second circumferential limit parts may be disposed on the outer bump. An inner size of the inner bump may be less than an outer size of the outer bump.

In some embodiments, the lock body transmission may be inserted into the output member to form the pivotal connection. A count of outer bumps and a count of inner bumps may be set to two. The two outer bumps and the two inner bumps 381 may be spaced apart along the circumferential direction.

Still another aspect of the present disclosure provides a smart lock system. The smart lock system may include a driving component and a clutch mechanism as described above. The driving component may drive a lock body shaft to rotate via a lock body transmission member. An output shaft of the drive member may be connected to a bevel gear engagement pair in a transmission connection. The output shaft be a driven bevel gear of the bevel gear engagement pair.

In some embodiments, the smart lock system may further include a gearbox. The driving component may include a motor, and the gearbox may be connected between the motor and the bevel gear engagement pair in a transmission connection.

Still another aspect of the present disclosure provides a smart lock. The smart lock may include a housing and a sealing plate that are formed an internal chamber. A transmission assembly and a control panel may be placed in the internal chamber. A manual knob may be located outside the housing. A driving component and the manual knob may drive, via a lock body transmission member, a lock body shaft to rotate respectively. The transmission assembly may use a smart lock system as described above. The control panel may be disposed parallel to the sealing plate and the housing. The control panel may include two wearing openings. The driving component fixed on the sealing plate, a driving bevel gear in a bevel gear engagement pair, and transmission members therebetween may extend from the first wearing opening to the inner chamber on the other side of the control panel. The lock body transmission member may be in a transmission connection to the driven bevel gear via the second wearing opening.

In some embodiments, engagement teeth of the driven bevel gear may be disposed on a side of the control panel close to the sealing plate, and extended to a shaft sleeve on the other side of the control panel. The lock body transmission member may be in the transmission connection to the shaft sleeve of the driven bevel gear.

In some embodiments, an output gear may be fixedly disposed on the lock body transmission member. The other side of the control panel close to the lock body transmission member may be disposed with a detection gear adapted to the output gear, and an angle sensor and the detection gear may coaxially rotate to obtain an angle signal and output the obtained angle signal to the control panel.

In some embodiments, an outer side of the housing may form a battery compartment to accommodate a battery, and battery contact elastic pieces electrically connected to the control panel may be respectively disposed at end portions of the battery compartment.

In some embodiments, a count of the battery compartment may be two. The two battery compartments may be disposed on both sides axisymmetrically with respect to the driving component, and the two battery compartments may extend inward to the control panel. The detection gear may be disposed on an opposite side of the driven bevel gear with respect to the driving bevel gear and disposed between the two battery compartments.

Still another aspect of the present disclosure provides a smart lock. The smart lock may include a sealing plate assembly, a battery compartment assembly, a housing, and a manual knob that are sequentially disposed from bottom to top. The sealing plate assembly may include a control panel, a sealing plate, and a gearbox and a transmission assembly fixedly disposed on the sealing plate. The control panel may be disposed above the sealing plate. The gearbox and the transmission assembly may pass through the control panel respectively. The gearbox may include a motor and a gear assembly. The transmission assembly may include a driving gear and a driven member that are connected through a transmission connection. The driving gear may be connected to an output portion of the gearbox through the transmission connection. The driven member may be coaxially rotatable with a lock body shaft of the smart lock. The housing may be configured to cover a battery groove of the battery compartment assembly. The manual knob may be configured to pass through the housing and the battery compartment assembly, and is coaxially rotatable with the driven member.

In some embodiments, the sealing plate assembly and the battery compartment assembly may be connected through a screw connection. The battery compartment assembly and the housing may be fixed by a magnetic connection member.

In some embodiments, the battery compartment assembly and the housing may be respectively bonded to the magnetic connection member.

In some embodiments, the battery compartment assembly may further include a battery contact elastic piece. One end of the battery contact elastic pieces may be fixed to the control plate, and the other end may be inserted into the battery compartment assembly and connected to a battery in the battery compartment assembly.

In some embodiments, the transmission assembly may further include an intermediate gear. The intermediate gear may be coaxial rotated with the driven member and engaged with the driving gear, and an axis of the intermediate gear and an axis of the driving gear may be perpendicularly disposed.

In some embodiments, the sealing assembly may further include a bracket for supporting the control panel and the transmission assembly. The bracket may be disposed between the control panel and the sealing assembly.

In some embodiments, the smart lock may further include a first detection assembly. The first detection assembly may be integrated into the sealing plate assembly. The driven member may be a driven gear. The first detection assembly may include a position sensor and a detection gear engaged with the driven gear. The position sensor may be configured to detect a rotation angle of the detection gear.

In some embodiments, the first detection assembly may further include a wake-up unit. In response to detecting the rotation of the detection gear, the wake-up unit may be triggered to send a wake-up signal to the position sensor. The position sensor may be in the dormant state until receiving the wake-up signal from the wake-up unit.

In some embodiments, the wake-up unit may include a Hall sensor and a magnetic member. The magnetic member may be fixedly disposed on the detection gear or the driven gear. The Hall sensor and the position sensor may be both fixedly disposed on the control panel. The magnetic member may rotate relative to the Hall sensor, so that the Hall sensor is triggered to wake up the position sensor.

In some embodiments, the control panel may further include an antenna configured to achieve a signal connection with an external controller. A material of the battery compartment assembly may include a metal material. A position corresponding to the antenna on a side wall of the housing may be also disposed with a window. The window may be blocked by a plastic member.

Still another aspect of the present disclosure provides a smart lock system. The smart lock system may include a control panel, a first detection assembly, and an induction assembly. The first detection assembly and the induction assembly may be connected to the control panel through an electrical connection or a signal connection, respectively.

The induction assembly may be adapted to a lock body shaft. The induction assembly may be configured to detect a starting action of the lock body shaft from stationary to rotating and send a wake-up signal to the control panel. The control panel may be in a dormant state until the wake-up signal sent by the induction assembly is received. The awakened control panel may be configured to wake up the first detection assembly. The first detection assembly may be adapted to the lock body shaft and transmits a detected angular displacement of a rotation of the lock body shaft to the control panel.

In some embodiments, the system may further include a gearbox and a transmission assembly. The gearbox may be integrated with a motor and a gear assembly. The transmission assembly may include a driving gear and a driven member. The driving gear may be in the transmission connection to the motor. The driven member may be coaxially rotatable with the lock body shaft. The first detection assembly may include a rotation detection member that is connected to the driven member in a transmission connection and an angle sensor 512 that is disposed coaxially with the detection gear. The angle sensor may be connected to the detection gear in the transmission connection, and configured to obtain an angle signal and output the obtained angle signal to the control panel.

In some embodiments, the induction assembly may include a first induction element and a second induction element. The first induction element may be fixed on the driven member or the rotation detection member. The second induction element may be fixed on a lock body shaft. When the lock body shaft rotates, the second induction element may rotate relative to the first induction element, and the second induction element may be triggered to send the wake-up signal to the control panel.

In some embodiments, the first induction element may be a first magnetic member, and the second induction element may be a Hall sensor.

In some embodiments, the driven member and the rotation detection member may be gears that are engaged with each other, and the rotation detection member may be located on a radial side of the output gear.

In some embodiments, the system may further include a second detection assembly that is connected to the control panel through an electrical connection or a signal connection. The second detection assembly may be connected or adapted to the transmission assembly, and send a detected angular displacement of the rotation of the output shaft of the driving component to the control panel.

In some embodiments, the transmission assembly may further include an intermediate gear that is disposed coaxially with the driven member. The intermediate gear may be engaged with the driving gear. The intermediate gear and the driven member may be disposed with mutually matched vacancy rotation connection structures. The second detection assembly may include a third induction element and a fourth induction element. The third induction element may be fixedly mounted on the intermediate gear or the driving gear, and the fourth induction element may be fixedly mounted on the lock body shaft. When the output shaft of the motor rotates, the third induction element and the fourth induction element may rotate relative to each other, and the fourth induction element may be triggered to detect an angular displacement of the third induction element.

In some embodiments, the intermediate gear and the driving gear may be bevel gears.

In some embodiments, the third induction element may be a second magnetic member, and the fourth induction element may be a magnetic encoder.

In some embodiments, an outer diameter of the driven gear may be 2 times to 3 times an outer diameter of the output gear, and the angle sensor may be located between the rotation detection member and the intermediate gear.

Still another aspect of the present disclosure provides a smart lock, which includes a system as described above.

Still another aspect of the present disclosure provides a smart lock. The smart lock may include a motor, a transmission assembly, a control panel, a lock body shaft, and an induction assembly. The induction assembly may include a first induction element and a second induction element. The first induction element may be connected to the control panel through a signal connection. One of the first induction element and the second induction element may be fixed relative to the lock body shaft and be configured to rotate relative to the other of the first induction element and the second induction element. When the driving component drives the lock body shaft to rotate through the transmission assembly, the first induction element and the second induction element may rotate relative to each other, and the first induction element may be triggered to send a wake-up signal to the control panel. The control panel may be in a dormant state until the wake-up signal sent by the first induction element is received.

In some embodiments, the first induction element may be a Hall sensor, and the second induction element may be a magnetic induction.

In some embodiments, a count of the Hall sensor and/or the magnetic induction may be at least two and uniformly disposed along a circumferential direction of the lock shaft.

In some embodiments, the transmission assembly may include a connection portion, a driving member connected to an output shaft of the motor, and a driven member being coaxial with the lock body shaft. The connection portion may include a first abutment member and a second abutment member fixedly connected to the driven member. Rotation of the driving bevel member may drive the first abutment member to rotate. The forward rotation of the motor may drive, via the driving member, the first abutment member to rotate to be abutted the second abutment member, so that the lock body shaft is rotated and the lock body is locked. The reverse rotation of the motor may drive the first abutment member to reversely rotate to be separated from the second abutment member. The smart lock may further include a second detection assembly configured to detect a rotation angle of the first abutment member. When the driving component drive the lock body shaft to the locked state, the control panel of the smart lock may control the driving component to reversely rotate so that the first abutment member rotates a preset separation angle.

In some embodiments, the driving member may be a driving gear, and an axis of the driving gear may be perpendicular to an axis of the driven member. The transmission assembly may further include an intermediate gear engaged with the driving gear, the intermediate gear may be coaxial with the driven member, and the first abutment member may be fixedly connected to the intermediate gear.

In some embodiments, the intermediate gear may include a first sleeve. The first abutment member may be disposed on a side wall of the first sleeve. The output member may include a second sleeve. The second abutment member may be disposed on a side wall of the second sleeve. The first sleeve and the second sleeve may be coaxially disposed and sleeved on each other.

In the embodiment, the transmission assembly may further include a hollow shaft. The control panel may be disposed between the intermediate gear and the driven gear. The hollow shaft may pass through the control panel and be fixed to the control panel. The first sleeve and the second sleeve may be both disposed in the hollow shaft.

In some embodiments, a count of the first abutment member may be two, and the two first abutment members may be uniformly disposed along a circumferential direction of the first sleeve, and a count of the second abutment member may be two, and the two second abutment members may be uniformly disposed along a circumferential direction of the second sleeve.

In some embodiments, the second detection assembly may include a magnetic member and a magnetic encoder. The magnetic member may be fixedly disposed on the driving gear or the intermediate gear. The magnetic encoder may detect the rotation angle of the first abutment member and send the detected angle to the control panel.

In some embodiments, the second induction element may be fixed to the lock body shaft, the driven member, or the manual knob, and the first second induction element may be welded to the control panel.

Still another aspect of the present disclosure provides a smart lock. The smart lock may include a motor, a transmission assembly, and a second detection assembly. The transmission assembly may include a connection portion, a driving member connected to an output shaft of the motor, and a driven member that is coaxially rotatable with a lock body shaft of the smart lock. The connection portion may include a first abutment member and a second abutment member that is fixedly connected to the driven member. A rotation of the driving member may be configured to drive the first abutment member to rotate. A forward rotation of the motor may be configured to drive the first abutment member to rotate to abut with the second abutment member through the driving member, causing the lock body shaft to rotate and realize the lock body shaft locking. A reverse rotation of the motor may be configured to drive the first abutment member to reversely rotate and disengage from the second abutment member. The second detection component may be configured to detect a rotation angle of the first abutment member. When the motor drives the lock body shaft to a locked state, the control panel of the smart lock may be configured to control the motor to reversely rotate to cause the first abutment member to rotate a preset separation angle.

In some embodiments, the driving member may be a driving gear, and an axis of the driving gear may be perpendicular to an axis of the driven member. The transmission assembly may further include an intermediate gear engaged with the driving gear, the intermediate gear may be coaxial with the driven member, and the first abutment member may be fixedly connected to the intermediate gear.

In some embodiments, the intermediate gear may include a first sleeve. The first abutment member may be disposed on a side wall of the first sleeve. The output member may include a second sleeve. The second abutment member may be disposed on a side wall of the second sleeve. The first sleeve and the second sleeve may be coaxially disposed and sleeved on each other.

In the embodiment, the transmission assembly may further include a hollow shaft. The control panel may be disposed between the intermediate gear and the driven gear. The hollow shaft may pass through the control panel and be fixed to the control panel. The first sleeve and the second sleeve may be both disposed in the hollow shaft.

In some embodiments, a count of the first abutment member may be two, and the two first abutment members may be uniformly disposed along a circumferential direction of the first sleeve, and a count of the second abutment member may be two, and the two second abutment members may be uniformly disposed along a circumferential direction of the second sleeve.

In some embodiments, the second detection assembly may include a magnetic member and a magnetic encoder. The magnetic member may be fixedly disposed on the driving gear or the intermediate gear. The magnetic encoder may detect the rotation angle of the first abutment member and send the detected angle to the control panel.

In some embodiments, the magnetic member may be fixedly disposed on an axial center of the driving gear or an axial center of the intermediate gear.

In some embodiments, the magnetic encoder may be welded to the control panel.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1:
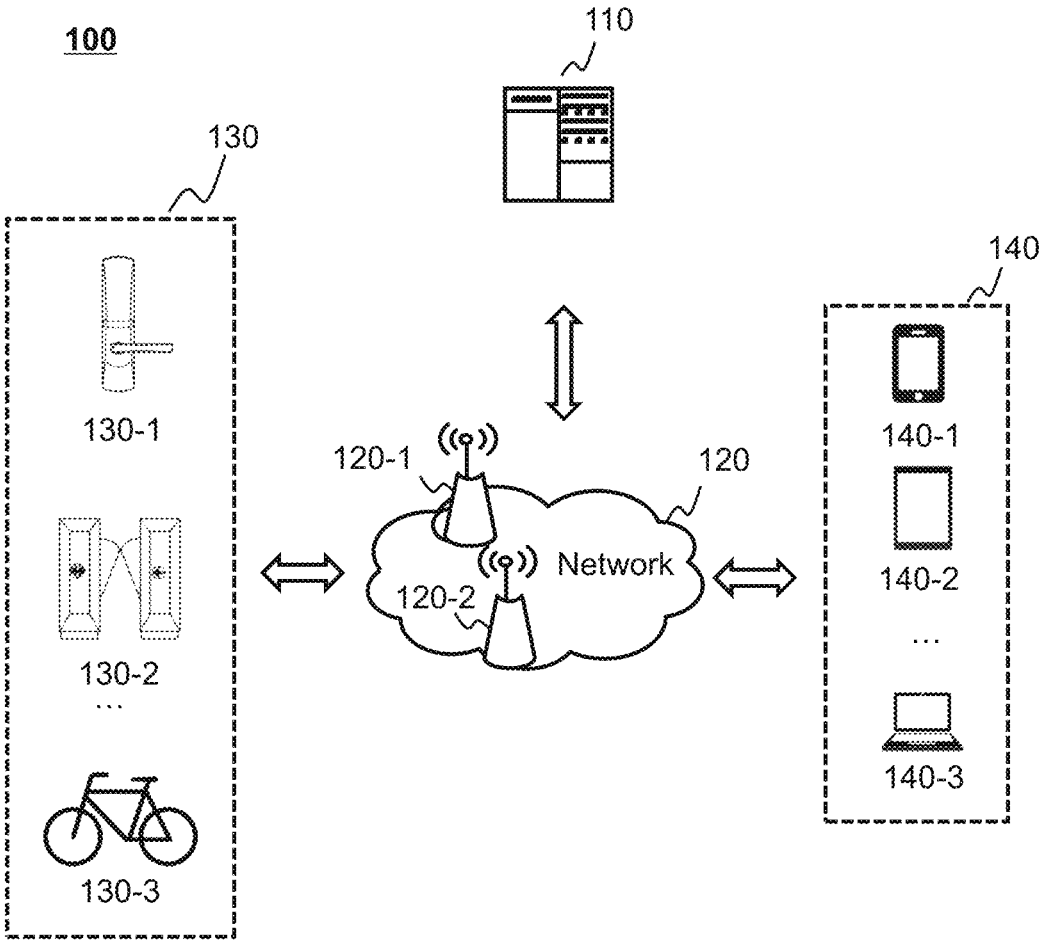
FIG. 1 is a schematic diagram illustrating an exemplary smart security system according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. Unless obviously obtained from the context or the context illustrates otherwise, the same numeral in the drawings refers to the same structure or operation.

It will be understood that the term "system," "engine," "unit," and/or "module" used herein are one method to distinguish different components, elements, parts, sections, or assembly of different levels in ascending order. However, the terms may be displaced by another expression if they achieve the same purpose.

As used in the disclosure and the appended claims, the singular forms "a," "an," and "the" may include plural referents unless the content clearly dictates otherwise. In general, the terms "comprise" and "include" merely prompt to include steps and elements that have been clearly identified, and these steps and elements do not constitute an exclusive listing. The methods or devices may also include other steps or elements.

The flowcharts used in the present disclosure illustrate operations that systems implement according to some embodiments in the present disclosure. It is to be expressly understood, the operations of the flowchart may be implemented not in order. Conversely, the operations may be implemented in an inverted order, or simultaneously. Moreover, one or more other operations may be added to the flowcharts. One or more operations may be removed from the flowcharts.

FIG. 1 is a schematic diagram illustrating an exemplary smart security system according to some embodiments of the present disclosure.

A smart security system 100 may include a server 110, a network 120, a smart security device 130, and a user terminal 140. The smart security system 100 may acquire identity confirmation information (e.g., first identification information, second identification information, etc.) of a user and confirm a user identity according to the identity confirmation information of the user. After the user identity is confirmed, one or more corresponding operations may be performed according to the user identity. For example, the smart security system 100 may be applied to devices for smart security, i.e., smart security devices. In some embodiments, the smart security device may include a smart lock apparatus (i.e., a smart lock) with a smart unlocking function, a traffic device with a smart unlocking function, a gate apparatus with a smart unlocking function, or the like, or any combination thereof. The smart unlocking function may be understood that the smart security device 130 can automatically drive a lock body in the smart security device 130 to move through a driving module to unlock the smart security device 130 after the user identity is confirmed. For example, the smart security system 100 may include a detection module 210, a driving module 270, and a mechanical structure 280. The detection module 210 may be configured to obtain identity confirmation information. The identity confirmation information may be used to determine whether the corresponding user is allowed to turn on the smart security device 130. If the corresponding user is allowed to turn on the smart security device 130, the driving module 270 may be used to drive the mechanical structure 280 to move, so that the smart security device 130 is in an unlocked state. More descriptions regarding the detection module 210, the driving module 270, and the mechanical structure 280 may be found elsewhere in the present disclosure (e.g., FIG. 2 and descriptions thereof).

It should be noted that the smart security system 100 may also be applied to other devices, scenes, and applications that need to perform the security, which will not be limited. Any devices, scenes, and/or applications for smart security involved in the present disclosure that can be used may be within the scope of the present disclosure.

The server 110 may process information and/or data associated with the smart security device 130. In some embodiments, the information and/or data associated with the smart security device 130 may include identity confirmation information of a user obtained by the server 110 when the user attempts to turn on the smart security device 130 and state information of the smart security device 130. Merely by way of example, the server 110 may process the identity confirmation information of the user in the smart security device 130, confirm the user identity according to the identity confirmation information, and generate an instruction to control the smart security device 130 according to a confirmation result of the user identity. As another example, the server 110 may determine the obtained state information of the smart security device 130, determine whether the current smart security device 130 is in an abnormal state, and transmit a determination result of the abnormal state to the user terminal 140.

In some embodiments, the server 110 may be a single processing device or a group of processing devices. The group of processing devices may be a centralized group of processing devices or a distributed group of processing devices. For example, the server 110 may be a distributed group. In some embodiments, the server 110 may be local or remote. For example, the server 110 may access information and/or data stored in the smart security device 130 and/or the user terminal 140 via the network 120. In some embodiments, the server 110 may be directly connected to the smart security device 130 and the user terminal 140 to access the information and/or data stored in the smart security device 130 and the user terminal 140. For example, the server 110 may be located in the smart security device 130 or directly connected to the smart security device 130. In some embodiments, the server 110 may be implemented on a cloud platform. For example, the cloud platform may include a private cloud, a public cloud, a hybrid cloud, a community cloud, a distributed cloud, an internal cloud, a multi-layer cloud, or the like, or any combination thereof.

In some embodiments, the server 110 may include a processing device. The processing device may process the information and/or data associated with the smart security device 130 to perform one or more functions described in the present disclosure. For example, the processing device may receive a request signal for identity confirmation sent by the smart security device 130 or the user terminal 140, and send a control instruction to the smart security device 130. As another example, the processing device may obtain the identity confirmation information acquired by the smart security device 130, and send the confirmation result of the user identity to the user terminal 140. In some embodiments, the processing device 112 may include one or more sub-processing units (e.g., a single-core processing device or a multi-core processing device). Merely by way of example, the processing device may include a central processing unit (CPU), an application-specific integrated circuit (ASIC), an application-specific instruction-set processor (ASIP), a graphics processing unit (GPU), a physical processing unit (PPU), a digital signal processor (DSP), a field-programmable gate array (FPGA), a programmable logic device (PLD), a controller, a microcontroller unit, a reduced instruction set computer (RISC), a microprocessor, or the like, or any combination thereof. In some embodiments, the server 110 may be located inside the smart security device 130, and the smart security device 130 and the server 110 may be connected through an internal wired network. In some embodiments, the server 110 may also be located in a cloud end and connected to the smart security device 130 via a wireless network.

The network 120 may facilitate an exchange of the information and/or data in the smart security system 100. In some embodiments, one or more components (e.g., the server 110, the smart security device 130, the user terminal 140) of the smart security system 100 may send the information and/or data to other components of the smart security system 100 via the network 120. For example, the identity confirmation information acquired by the smart security device 130 may be transmitted to the server 110 via the network 120. As another example, the confirmation result regarding the user identity in the server 110 may be sent to the user terminal 140 via the network 120. In some embodiments, the network 120 may be any form of wired or wireless network, or any combination thereof. For example, the network 120 may include a cable network, a wired network, an optical fiber network, a telecommunication network, an internal network, the Internet, a local area network (LAN), a wide area network (WAN), a wireless local area network (WLAN), a metropolitan area network (MAN), a public switched telephone network (PSTN), a Bluetooth network, a ZigBee network, a near field communication (NFC) network, or the like, or any combination thereof. In some embodiments, the network 120 may include one or more network access points. For example, the network 120 may include wired or wireless network access points, such as base stations and/or Internet exchange points 120-1, 120-2, . . . , and one or more components of the smart security system 100 may be connected to the network 120 to exchange the data and/or information via the network access point.

The smart security device 130 may obtain the identity confirmation information of the user and confirm the user identity according to the identity confirmation information. After the user identity is confirmed, one or more corresponding operations may be performed according to the user identity. In some embodiments, the smart security device 130 may include a smart lock 130-1, a gate lock 130-2, and a transportation lock 130-3.

For example, when the smart security device 130 is the smart lock apparatus 130-1, the processing device may determine whether the user is allowed to unlock the smart lock apparatus 130-1 according to the identity confirmation information of the user. If the identity confirmation information of the user is confirmed by the smart lock apparatus 130-1, the smart security system 100 may control the driving module 270 of the smart lock apparatus 130-1 to drive the mechanical structure 280 to move so as to unlock the smart lock apparatus 130-1. In some embodiments, the smart lock apparatus 130-1 may be applied to a door body, a parking space lock, a safety deposit box, a suitcase, etc. In some embodiments, distinguished by category, the smart lock device 130-1 may include a button type smart lock, a dial type smart lock, an electronic key type smart lock, a touch type smart lock, a password recognition type smart lock, a remote control type smart lock, a card identification type smart lock (e.g., a magnetic card, an integrated circuit (IC) card), a biometric recognition type smart lock (e.g., a fingerprint, a finger vein, a palm print, a face, a voice, an iris, a retina), or the like, or any combination thereof.

As another example, when the smart security device 130 is the gate device 130-2, the processing device may determine whether the user is allowed to pass through the gate lock 130-2 according to the identity confirmation information of the user. If a determination result is that the user is allowed to pass through the gate lock 130-2, the smart security system 100 may control the driving module 270 of the gate lock 130-2 to drive the mechanical structure 280 to move so as to unlock the gate lock 130-2 and release the user. If the determination result is that the user is not allowed to pass through the gate lock 130-2, the smart security system 100 may not unlock the gate lock 130-2. In some embodiments, the gate lock 130-2 may be applied to an entrance or an exit of an airport, a subway station, a light rail station, a bus station, a train station, an office building, a residential area, etc., where the user identity needs to be determined. In some embodiments, the gate lock 130-2 may include a swing gate apparatus, a wing gate apparatus, a three-roll gate apparatus, a rotation gate apparatus, a translation gate apparatus, or the like, or any combination thereof.

As still another example, when the smart security device 130 is the transportation lock 130-3 (e.g., a bicycle, an electric vehicle, etc.), the transportation lock 130-3 may be a private transportation apparatus (e.g., a private car) or a shared transportation apparatus (e.g., a shared vehicle, a shared bicycle, etc.). The processing device may determine whether the user is an owner or a current renter of the transportation lock 130-3 according to the identity confirmation information of the user, thereby determining whether a lock of the transportation lock 130-3 is opened. After the transportation lock 130-3 confirms the identity confirmation information of the user, the smart security system 100 may control the driving module 270 of the transportation lock 130-3 to drive the mechanical structure 280 to move so as to unlock the transportation lock 130-3.

It should be noted that the smart security device 130 is not limited to the smart lock apparatus 130-1, the gate lock 130-2, and the transportation lock 130-3 shown in FIG. 1, and can also be applied to devices that require smart security, which will not be limited. Any devices that can use the smart security function included in the present disclosure may be within the scope of the present disclosure.

In some embodiments, the user terminal 140 may obtain the information and/or data in the smart security system 100. In some embodiments, the user terminal 140 may obtain push information regarding the state of the smart security device 130. In some embodiments, the push information may include switch state information of the smart security device 130, clutch state information between a lock body structure and the driving module 270 of the smart security device 130, user usage information, alarm information, etc. In some embodiments, the user may obtain the state information of the smart security device 130 through the user terminal 140. For example, the smart security device 130 may include a smart lock or a transportation apparatus, and the user can use the user terminal, a current state of the smart lock, or a current state of the transportation apparatus to prompt himself to avoid forgetting to lock the smart lock or lock the transportation apparatus. In some embodiments, the user may obtain the clutch state information through the user terminal 140, and select an operation mode of the smart security device 130 to turn on according to the clutch state information. For example, when the clutch state information shows that the lock body of the smart security device 130 is coupled with the driving module 270, an electric unlocking mode may be selected. When the clutch state information shows that the lock body of the smart security device 130 is separated from the driving module 270 or in a state that the transmission is disconnected, the electric unlocking mode or a manual unlocking mode may be selected. In some embodiments, the server 110 may also directly determine based on the clutch state information detected by the detection module 210 to determine a better unlocking mode, and send the unlocking mode to the user terminal 140. That is, the push information may include a suggested unlocking mode. In some embodiments, the user terminal 140 may include a mobile device 140-1, a tablet computer 140-2, a laptop computer 140-3, or the like, or any combination thereof. In some embodiments, the mobile device 140-1 may include a smart home device, a wearable device, a smart mobile device, a virtual reality device, an augmented reality device, or the like, or any combination thereof. In some embodiments, the smart home device may include a smart lighting device, a smart electrical control device, a smart monitoring device, a smart TV, a smart camera, a walkie-talkie, or the like, or any combination thereof. In some embodiments, the wearable device may include a smart bracelet, smart footwear, smart glasses, a smart helmet, a smart watch, smart clothes, a smart backpack, a smart accessory, or the like, or any combination thereof. In some embodiments, the smart mobile device may include a smart phone, a personal digital assistant (PDA), a gaming device, a navigation device, a point of sale (POS), or the like, or any combination thereof. In some embodiments, the virtual reality device and/or augmented virtual reality device may include a virtual reality helmet, virtual reality glasses, a virtual reality patch, an augmented reality helmet, augmented reality glasses, an augmented reality patch, or the like, or any combination thereof.

Figure 2:
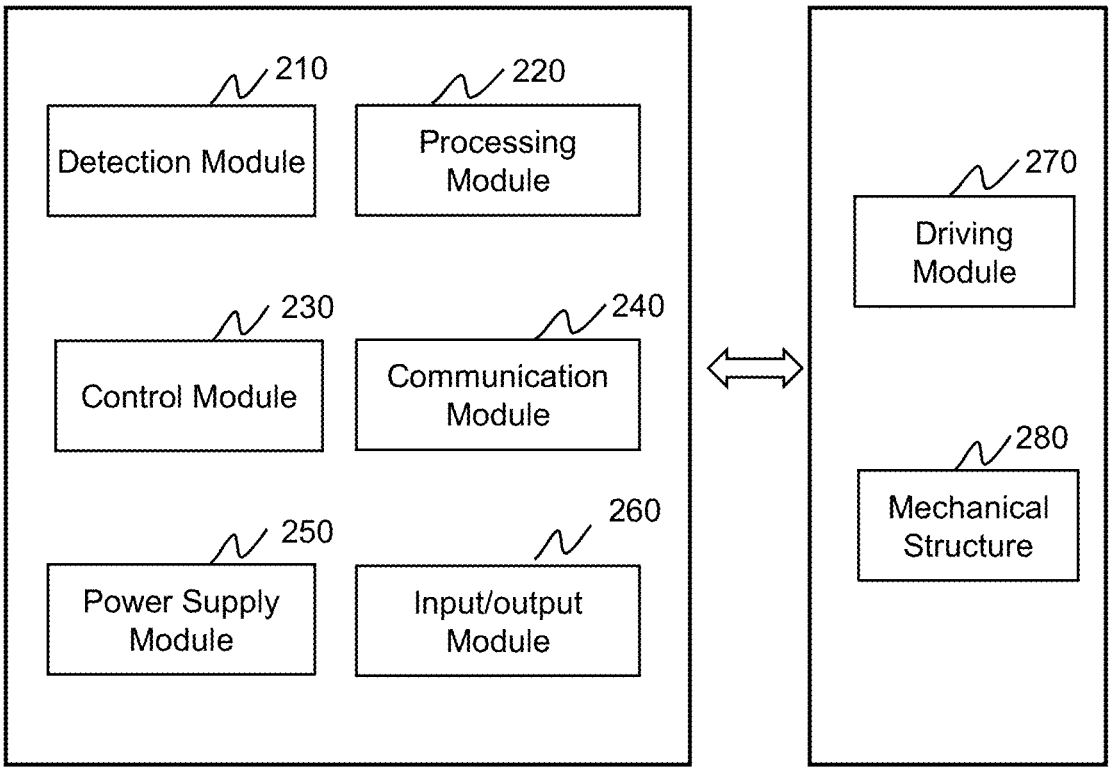
FIG. 2 is a block diagram illustrating an exemplary smart security system according to some embodiments of the present disclosure.

FIG. 2 is a block diagram illustrating an exemplary smart security system according to some embodiments of the present disclosure.

In some embodiments, the smart security system 200 may include a control module 230, a driving module 270, and a mechanical structure 280. The control module 230 may be configured to send a control instruction to the driving module 270, and the driving module 270 may drive the mechanical structure 280 to move based on the control instruction, thereby performing a state switching operation on a smart security device (e.g., the smart security device 130). In some embodiments, the state switching operation of the smart security device may include switching from an unlocking state of the smart security device to a locking state or switching from the locking state to the unlocking state. In some embodiments, the state switching operation of the smart security device may also include switching from the unlocking state or the locking state of the smart security device to an operation vacancy state or a separation state to facilitate a manual unlocking operation. In some embodiments, the smart security system 200 may also include other modules, such as a detection module 210, a processing module 220 (also referred to as a processor), a communication module 240, a power supply module 250, an input/output module 260, or the like, or any combination thereof. The following takes FIG. 2 as an example for a detailed description.

As shown in FIG. 2, the smart security system 200 may include the detection module 210 (also referred to as the processor), the control module 230 (also referred to as a master, a microcontroller unit (MCU), a controller), the communication module 240 (also referred to as an alarm module), the power supply module 250, the input/output module 260, driving module 270 (also referred to as a motor driving module), and the mechanical structure 280. It should be noted that the modules, units, and sub-units mentioned in the present disclosure can be implemented by hardware, software, or a combination of software and hardware. The implementation of the hardware may include circuits or structures including entity components. The implementation of the software may include storing operations corresponding to the modules, units, and sub-units in the form of code in a memory, and being executed by appropriate hardware, such as, a microprocessor. When the modules, units, and sub-units mentioned herein perform the operation, without special description, it may refer to that the software code including the function is performed, or the hardware including the function is used. Meanwhile, when the modules, units, and subunits mentioned herein is corresponding to hardware, the corresponding hardware do not be limited, as long as the hardware that can achieve the function is within the scope of the present disclosure. For example, the different modules, units, and subunits mentioned herein may correspond to a same hardware structure. As another example, the same module, unit, and sub-units mentioned herein may also correspond to a plurality of separate hardware structures. In some embodiments, partial operations of partial modules in the smart security system 200 may be performed by the server 110.

In some embodiments, the detection module 210 may be configured to obtain identity confirmation information of a user. The identity confirmation information may include first identification information and second identification information. Further, the first identification information may refer to information for embodying a user identity (also referred to as identity identification information). In some embodiments, the first identification information may include biometric information, password information, or the like, or any combination thereof. Biometric information may be a physiological characteristic that can be measured or can be identified and verified on a human individual, which can be distinguished from other human individuals. In some embodiments, the biometric information may include fingerprint information, palm print information, finger vein information, face information, heart rate information, voice information, iris information, retina information, or the like, or any combination thereof. In some embodiments, the password information may include number information, character information, text information, or the like, or any combination thereof. In some embodiments, the password information may also include an authentication gesture, an answer of an authentication problem, an image selection result, etc. The second identification information may be information for indicating whether the user is a living body (also referred to as living body identification information). In some embodiments, the second identification information may include blood oxygen information, heart rate information, finger vein information, face information, or the like, or any combination thereof. For example, the second identification information may be blood oxygen information. As another example, the second identification information may be blood oxygen information and heart rate information. As still another example, the second identification information may be blood oxygen information, heart rate information, and finger vein information.

In some embodiments, the detection module 210 may also be configured to obtain motion position information of the driving module 270 in the smart security device 130, and send a detection result to the processing module 220 through the input/output module 260 or the communication module 240. The processing module 220 may determine whether the driving module 270 needs to stop or continue to move, and send a determination result to the control module 230. Accordingly, the control module 230 may execute a corresponding control instruction on the driving module 270 according to the determination result. For example, when the control module 230 detects that the driving module 270 moves to a locking state, the control module 230 may control a driving component in the driving module 270 to reversely rotate so as to switch the smart lock to an operation vacancy state.

In some embodiments, the detection module 210 may also be configured to obtain current state information of the smart security device 130. For example, in the embodiment of the smart lock 130-1, the current state of the smart security device 130 may include an unlocking state of a lock body shaft, a locking state of the lock body shaft, an opening state of a door body, and a closing state of the door body. In some embodiments, the detection module 210 may send the detected current state information to the processing module 220. The processing module 220 may determine whether the smart security device 130 is in an abnormal condition according to the current state information, and send the abnormal condition to the user terminal 140 through the communication module 240.

The processing module 220 may process data from the detection module 210, the control module 230, the communication module 240, the power supply module 250, and/or the input/output module 260. For example, the processing module 220 may process identity confirmation information from detection module 210. As another further, the processing module 220 may process instructions or operations from the input/output module 260. In some embodiments, the processed data may be stored in the memory or a hard disk. In some embodiments, the processing module 220 may send the processed data to one or more components in the smart security system 200 via the communication module 240 or the network 120. For example, the processing module 220 may send a detection result of a subject to the control module 230, and the control module 230 may perform subsequent operations or instructions based on the detection result. As another example, the smart security device 130 is a smart lock, and after the identity confirmation information of the subject is confirmed, the control module 230 may send an instruction to the driving module 270 to control the smart lock to unlock.

The control module 230 may be associated with other modules in the smart security system 200. In some embodiments, the control module 230 may control an operation state of other modules (e.g., the communication module 240, the power supply module 250, the input/output module 260, the driving module 270) in the smart security system 200. For example, the control module 230 may control an operation state of the detection module 210 according to the detection result of the subject. After the detection result of the subject is generated, the control module 230 may control the detection module 210 to enter a standby state within a certain time period (e.g., 1 second, 2 seconds, etc.) and wait for a next wake-up and detection. As another example, the control module 230 may control an operation state of the driving module 270. If the detection result of the subject is passed, the control module 230 may send an unlock instruction to the driving module 270, and the driving module 270 may drive the mechanical structure 280 to unlock. As still another example, the control module 230 may control a power supply state (e.g., a normal mode, a power saving mode), a power supply time, etc., of the power supply module 250. When a remaining power of the power supply module 250 reaches a certain threshold (e.g., 10%), the control module 230 may control the power supply module 250 into the power saving mode or connect to an external power supply for charging.

In some embodiments, the communication module 240 may be configured to exchange information or data. In some embodiments, the communication module 240 may be used for communication between internal components (e.g., the detection module 210, the processing module 220, the control module 230, the power supply module 250, the input/output module 260, and/or the drive module 270) in the smart security device 130. For example, the detection module 210 may send the identity confirmation information to the communication module 240, and the communication module 240 may send the identity confirmation information to the processing module 220. In some embodiments, the communication module 240 may also be used for communication between the smart security device 130 and other components (e.g., the server 110, the user terminal 140) in the smart security system 200. For example, the communication module 240 may send state information (e.g., a switching state) of the smart security device 130 to the server 110. The server 110 may monitor the smart security device 130 based on the state information, and send monitored abnormal conditions to the user terminal 140 in time. The communication module 240 may use a wired technique, a wireless technique, and a wired/wireless hybrid technique. The wired technique may include a metal cable, a mixed cable, an optic cable, or the like, or any combination thereof. The wireless technique may include a Bluetooth network, a Wi-Fi network, a Zigbee network, a near field communication (NFC) network, a radio frequency identification (RFID) network, a cellular network (including global system for mobile (GSM) communications, code division multiple access (CDMA), 3G, 4G, 5G, etc.), a narrow band Internet of things (NBIoT), or the like, or any combination thereof. In some embodiments, the communication module 240 may encode the sent information based on one or more encoding modes. For example, the encoding mode may include a phase encoding mode, a non-return-to-zero code mode, a differential Manchester code mode, etc. In some embodiments, the communication module 240 may select different transmission and encoding modes according to a type of data to be transmitted or a type of network. In some embodiments, the communication module 240 may include one or more communication interfaces for different communication manners. In some embodiments, other modules of the smart security system 200 shown in FIG. 2 may be dispersed on a plurality of devices, in which case the other modules may include one or more communication modules 240, respectively, to transmit information between the modules. In some embodiments, the communication module 240 may include a receiver and a transmitter. In other embodiments, the communication module 240 may be a transceiver. In some embodiments, the communication module 240 may also have a prompt function and/or an alarm function. For example, when the detection result of the subject is not passed, the communication module 240 may send prompt information or alarm information to the subject and/or the user. In some embodiments, an alarm mode may include a sound alarm, a light alarm, a remote alarm, or the like, or any combination thereof. For example, when the alarm mode is a remote alarm, the communication module 240 may send the prompt information or the alarm information to an associated user terminal, and the communication module 240 may also establish a communication (e.g., a voice call, a video call) between the subject and the associated user terminal. In some embodiments, when the detection result of the subject is passed, the communication module 240 may also send the prompt information to the subject and/or the user. For example, the communication module 240 may send prompt information that the user identity is successfully confirmed to the subject. As another example, the communication module 240 may send prompt information that the user identity is successfully confirmed to the associated user terminal.

In some embodiments, the power supply module 250 may supply power to other components (e.g., the detection module 210, the processing module 220, the control module 230, the communication module 240, the input/output module 260, the driving module 270) in the smart security system 200. The power supply module 250 may receive a control signal from the processing module 220 to control a power output of the smart security device 130. For example, when the user identity is successfully confirmed, the power supply module 130 may supply power to the driving module 270 to cause that the driving module 270 can drive the mechanical structure 280 to move, thereby driving the smart security device 130 to unlock. As another example, if the smart security device 130 receives no operation instruction within a certain time period (e.g., 1 second, 2 seconds, 3 seconds, or 4 seconds), the power supply module 250 may only supply power to the memory to cause the control module 230 of the smart security system 200 to a standby mode. As still another example, if the smart security device 130 receives no operation instruction within a certain time period (e.g., 1 second, 2 seconds, 3 seconds, or 4 seconds), the power supply module 250 may disconnect the power supply to other components, and data in the smart security system 200 may be transferred to the hard disk, so that the smart security device 130 enters the standby mode or a sleep mode. In some embodiments, the power supply module 250 may include at least one battery (e.g., the battery 75 in FIG. 23). The battery may include a dry battery, a lead storage battery, a lithium battery, a solar cell, a wind energy power generation battery, a mechanical energy power generation battery, or the like. The solar cell may convert light energy into electrical energy and be stored in the power supply module 250. The wind energy power generation battery may convert wind energy into electrical energy and be stored in the power supply module 250. The mechanical energy power generation battery may convert mechanical energy into electrical energy and be stored in the power supply module 250. The solar cell may include a silicon solar cell, a thin film solar cell, a nanocrystalline chemical solar cell, a fuel sensitized solar cell, a plastic solar cell, etc. The solar cell may be distributed on the smart security device 130 in the form of a battery panel. In some embodiments, when an amount of power of the power supply module 250 is less than a power threshold (e.g., the amount of power at 10%), the processing module 220 may send a control signal to a voice device (e.g., a speaker) of the smart security device 130. The control signal may control the voice device to issue a voice prompt. The voice prompt may include information that the power supply module 250 has insufficient power. In some embodiments, when the amount of power of the power supply module 250 is less than the power threshold, the processing module 220 may send a control signal to the power supply module 250. The control signal may control the power supply module 250 to perform a charging operation. In some embodiments, the power supply module 250 may include a standby power source. In some embodiments, the power supply module 250 may also include a charging interface. For example, when the power supply module 250 is in an emergency situation (e.g., the power of the power supply module 250 is 0, and an external power system fails to supply power), the subject may use a portable electronic device (e.g., a mobile phone, a tablet computer) or a power bank to temporarily charge the power supply module 250.

The input/output module 260 may obtain, transmit, and send a signal. The input/output module 260 may be connected or communicated with other modules in the smart security system 200. Other modules in the smart security system 200 may be connected or communicated through the input/output module 260. The input/output module 260 may include a wired interface (e.g., a USB interface, a serial communication interface, a parallel communication port, etc.), a wireless network (e.g., a Bluetooth network, an infrared network, a radio frequency identification (RFID) network, a WLAN authentication and privacy infrastructure (WAPI) network, a general packet radio service (GPRS) network, a code division multiple access (CDMA) network, etc.), or any combination thereof. In some embodiments, the input/output module 260 may be connected to the network 120 and obtain information via the network 120. For example, the input/output module 260 may obtain the identity confirmation information of the user from the detection module 210 via the network 120 or the communication module 240, and output the identity confirmation information of the user. As another example, the input/output module 260 may obtain a prompt instruction or an alarm instruction from the control module 230 via the network 120 or the communication module 240. In some embodiments, the input/output module 260 may include a virtual channel connection (VCC), GND, RS-232, RS-485 (e.g., RS485-A, RS485-B), a general network interface, or the like, or any combination thereof. In some embodiments, the input/output module 260 (e.g., a camera, a microphone) may transmit the obtained identity confirmation information of the user to the detection module 210 via the network 120. In some embodiments, the input/output module 260 may encode the transmitted signal based on one or more encoding modes. The encoding mode may include a phase encoding mode, a non-return-to-zero code mode, a differential Manchester code mode, or the like, or any combination thereof.

In some embodiments, the driving module 270 may include one or more driving power sources. In some embodiments, the driving force source may include an electric driving motor (e.g., the driving component 12 in FIG. 4). In some embodiments, the driving motor may include a direct current (DC) motor, an alternating current (AC) induction motor, a permanent magnet motor, a switching magnetic resistance motor, or the like, or any combination thereof. In some embodiments, the driving module 270 may include one or more drive motors. For example, when the smart security device 130 is applied to the smart lock 130-1, the gate lock 130-2, or the transportation lock 130-3, the detection module 210 may obtain the identity confirmation information of the subject, and the processing module 220 may confirm the user identity based on identity confirmation information of the subject. The processing module 220 may send subsequent instructions to the control module 230 according to the confirmation result of the user identity. If the user identity is successfully confirmed, the control module 230 may control the driving module 270 to operate, and the driving module 270 may act on the mechanical structure 280 to complete a subsequent operation. For example, the control module 230 may send an instruction that includes an electrical signal, and the electrical signal includes a desired operation state and a desired time period. The driving source of the driving module 270 may perform a corresponding configuration according to a content (e.g., the driving motor in the driving module 270 is operating at a specific time per minute for a specific time period) of the electrical signal, the rotation of the driving motor may drive the change of the state (e.g., unlocking, closing, starting) of the mechanical structure 280 connected to the driving motor. As another example, when the smart security device 130 is applied to the smart lock 130-1, after the user identity is successfully confirmed, the driving module 270 may drive the mechanical structure 280 (e.g., a bolt) connected to the driving motor to unlock. As still another example, when the smart security device 130 is applied to the gate lock 130-2, after the user identity is successfully confirmed, the driving module 270 may drive the mechanical structure 280 (e.g., a roller shaft, a door) connected to the driving motor to provide a passing channel for the user. As still another example, when the smart security device 130 is applied to the transportation lock 130-3, after the user identity is successfully confirmed, the driving module 270 may drive the mechanical structure 280 (e.g., a lock) connected to the driving motor to unlock. In some embodiments, the smart security system 200 may implement automatic unlocking. The communication module 240 may obtain a geographic fence position of the user terminal 140, and send the geographic fence position of the user terminal 140 to the processing module 220. The geographic fence position can refer to a virtual geographic region enclosed by a virtual fence. The processing module 220 may determine a user position according to the geographic fence position of the user terminal 140. When the user reaches a preset geographic fence (e.g., a region within 10 meters, 50 meters, or 100 meters away from the smart lock 130-1), and after the user terminal 140 establishes a signal connection (e.g., a Bluetooth connection) with the communication module 240 of the smart lock 130-1, the control module 230 may automatically send an unlock signal (e.g., a Bluetooth key) to the driving module 270 to unlock, or automatically notify the server 110 to send an unlocking instruction.

In some embodiments, the mechanical structure 280 may include a transmission assembly and a lock body structure. In some embodiments, the driving module 270 may drive a motion of the transmission assembly, and then can drive the lock body structure to move between an unlocked state and a locked state. When the lock body structure is in the unlocked state, the bolt of the smart security device 130 may be in a retracted state, and when the lock body structure is in the locked state, the bolt of the smart security device 130 may be in an extended state. In some embodiments, when the smart security device 130 includes the smart lock 130-1, the lock body structure may include a lock body shaft and a bolt. In some embodiments, when the smart security device 130 includes the transportation lock 130-3, the lock body structure may include a lock. In some embodiments, when the smart security device 130 includes the gate lock 130-2, the lock body structure may include a roller shaft or a door body.

In some embodiments, the mechanical structure 280 may also include a manual operation assembly. When the user identity information is successfully confirmed, the user may drive the lock body structure to move between the unlocked state and the locked state via the manual operation assembly. In some embodiments, the manual operation assembly may be used by the user to drive the motion of the lock body structure through a certain operation element. For example, when the smart security device 130 includes the smart lock 130-1, the operation element included in the manual operation component may include a mechanical key or an operation knob located in the door.

In some embodiments, the mechanical structure 280 may also include a clutch structure. The clutch structure may be configured to couple or separate the driving module 270 and the lock body structure during a rotation transmission. The coupling of the driving module 270 and the lock body structure during the rotation transmission can be understood that a motion of the driving module 70 may be transmitted to the lock body structure. The separation of the driving module 270 and the lock body structure during the rotational transmission can be understood that the movement transmission of the driving module 270 to the lock body structure is disconnected. That is, the movement of the driving module 270 cannot be transmitted to the lock body structure. Alternatively, the rotation of the lock body structure cannot be transmitted to the driving module 270. When the driving module 270 is separated from the lock body structure, the user may drive the lock body structure to move through the manual operation component to open or close the door, which is no need to overcome a resistance of the driving module 270, and the operation is labor-saving. More descriptions regarding the mechanical structure 280 may be found elsewhere in the present disclosure.

It should be noted that the mechanical structure 280 is not limited to the transmission assembly, the lock body structure, and the clutch structure. The mechanical structure 280 may also include other structures. As used herein, the lock body structure is not limited to the locking shaft and the locking tongue of the smart lock 130-1, the roller shaft or the door body of the gate lock 130-2, and the lock of the transportation lock 130-3. The lock body structure may also include other structures. A specific structure may be based on a type of the smart security device 130, which will not be limited herein. Any mechanical mechanisms that can use the smart security device included in the present disclosure may be within the scope of the present disclosure.

It should be understood that the system and the modules thereof shown in FIG. 2 may be implemented in various manners. For example, in some embodiments, the system and the modules thereof may be implemented by hardware, software, or a combination of software and hardware. As used herein, the hardware part may be realized by dedicated logic. The software part may be stored in a storage and executed by an appropriate instruction to execute systems, such as a microprocessor or dedicated design hardware. Those skilled in the art may understand that the above methods and systems may be implemented using computer-executable instructions and/or included in processor control codes. For example, the codes may be provided on such as a carrier medium (e.g., a disk, a CD, or a DVD-ROM), a programmable memory of a read-only memory (firmware), or a data carrier (e.g., an optical or electronic signal carrier). The system and the modules thereof of the present disclosure may be implemented by hardware circuits such as very large-scale integrated circuits or gate arrays, semiconductors (e.g., logic chips, transistors, etc.), programmable hardware devices (e.g., field-programmable gate arrays, programmable logic devices, etc.), various types of processors, or the like, or any combination thereof.

It should be noted that the above description of the smart security system 200 and the modules thereof are merely provided for the purposes of illustration, and not intended to limit the scope of the present disclosure. It should be understood that for persons having ordinary skills in the art, after understanding the principle of the system, it may be possible to arbitrarily combine various modules, or form subsystems to connect with other modules without departing from the principle. In some embodiments, the detection module 210 and the processing module 220 may be one module including the functions of obtaining and processing the identity confirmation information. Those variations do not depart from the scope of the present disclosure.

Figure 3:
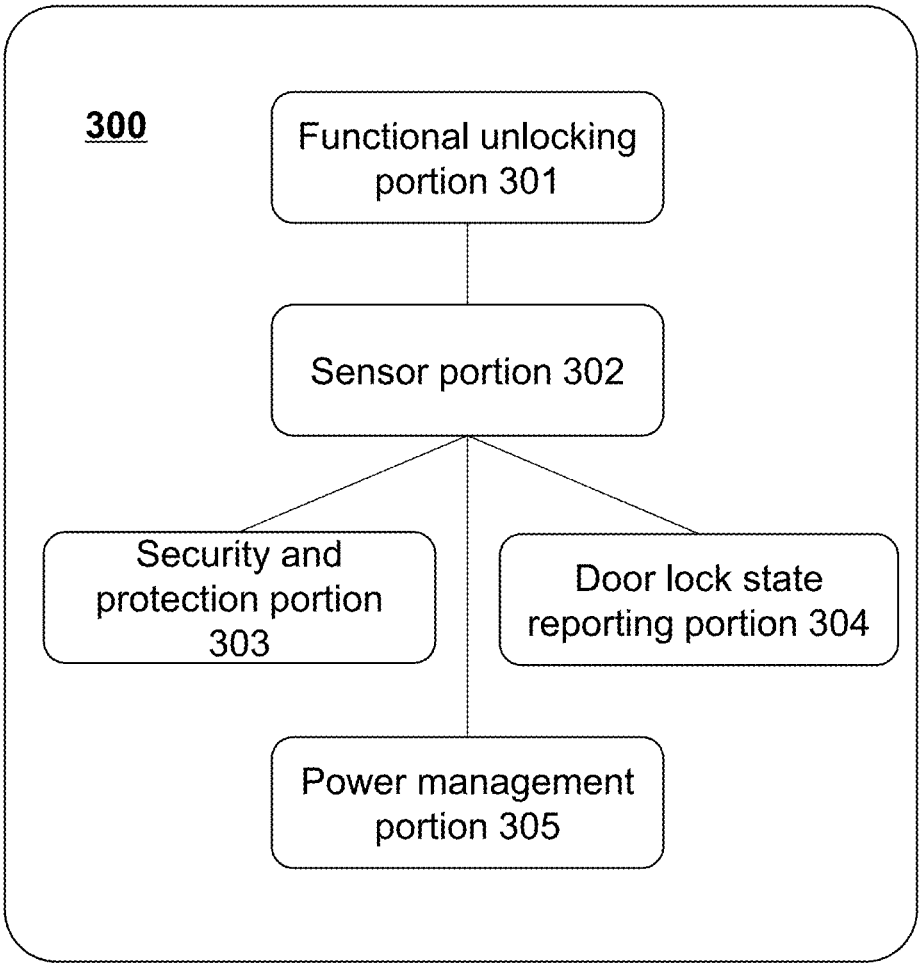
FIG. 3 is a schematic diagram illustrating functional portions of a smart lock according to some embodiments of the present disclosure.

FIG. 3 is a schematic diagram illustrating functional portions of a smart lock according to some embodiment of the present disclosure.

In some embodiments, when the smart security device 130 includes the smart lock (or a smart lock) 130-1, the smart security system may also include a smart lock system. The smart lock system may be applied to security fields such as home devices, electronic access systems, etc. For ease of understanding, in some embodiments of the present disclosure, the smart lock 130-1 is described in detail by taking a smart lock system as an example. However, it should be understood that some embodiments involved in the present disclosure may also be applied to embodiments in other fields, which are not limited to one embodiment of the smart lock.

In some embodiments, the smart lock system may also include one or more modules included in the smart security system 100 in the above embodiment, for example, the modules shown in FIG. 2. Referring to FIG. 3, from functional portions of the smart lock system, in some embodiments, a smart lock system 300 may include the following functional portions, such as a functional unlocking portion 301, a sensor portion 302, a security portion 303, a power management portion 305, a smart lock state reporting portion 304, etc. In some embodiments, the above functional parts of the smart lock system 300 may be implemented at least partially by relying on one or more modules in the above embodiments, which will be described in detail below.

In some embodiments, the functional unlocking portion 301 refers to an implement mode of a bolt of the smart lock device 130-1 from an extended state to a retracted state, that is, an unlocking mode. The door may be considered as being locked in the case that the bolt is in the extended state, and the door may be considered as being unlocked in the case that the bolt is in the retracted state. In some embodiments, the unlocking mode of the smart lock 130-1 may include a digital password unlocking mode, a mobile phone Bluetooth unlocking mode, a Bluetooth key unlocking mode, a near-field communication (NFC) card unlocking mode, a fingerprint unlocking mode, a mechanical unlocking mode, or the like, or any combination thereof. In some embodiments, the digital password unlocking mode needs to be implemented in combination with a touch interaction. A PAD may be fabricated on a control panel of the smart lock 130-1 and used as a touch panel. Alternatively, a capacitive screen may be used as a touch portion, which may improve the touch sensitivity, anti-interference capabilities may be enhanced, and multi-form touch, multi-point touch, etc., may be supported. In addition, a display portion of the smart lock 130-1 may employ a 24-bit red-green-blue (RGB) full-color liquid crystal display (LCD) screen. Therefore, the colors are abundant, and the images are diversified. A user may freely select a pattern and download the pattern to the smart lock under management by an application (APP) installed on a mobile phone. In some embodiments, with respect to the mobile phone Bluetooth unlocking mode, the APP installed on the mobile phone may be a smart lock management APP, and include binding a gateway, bonding the smart lock, configuring fingerprints, delivering passwords, real-time checking a smart lock state, and checking a battery capacity. The mobile phone Bluetooth unlocking mode is one function of the APP. After the smart lock is bound via the APP, the smart lock may be unlocked via the APP. In some embodiments, with respect to the Bluetooth key unlocking mode, a Bluetooth key is bound and paired by configuring the Bluetooth key via the APP. The Bluetooth key unlocking mode may be suitable for the old and children. In some embodiments, with respect to the NFC card unlocking mode, an NFC card is paired via bonding, which is suitable for the old and children. In some embodiments, the mechanical unlocking mode may be understood as a door unlocking function with a mechanical key on a traditional smart lock, which is still used in the smart lock.

The digital password unlocking mode, the mobile phone unlocking mode, the Bluetooth key unlocking mode, the NFC card unlocking mode, the fingerprint unlocking mode, etc., may be performed to unlock by the driving module 270 driving the mechanical structure. Therefore, these unlocking modes may be referred to as automatic unlocking. The mechanical unlocking mode may also be understood as manual unlocking. That is, the unlocking needs to be achieved by a user manually operating to drive the mechanical structure. For example, the lock may be unlocked by unlocking with the mechanical key or rotating a door handle or an operation knob. The smart lock including the manual unlocking function and the electric unlocking function may allow the user to freely choose an unlocking mode, which improves the user experience. In some embodiments, the functions of the smart lock may also include automatic adjustment to a state suitable for the user to manually unlock the lock. The function may be referred to as a manual/electric operation mode automatic conversion function in the present disclosure. The function may be implemented via a clutch mechanism in the mechanical structure 280 as described above. More descriptions regarding the clutch mechanism implementing the automatic conversion between the above operation modes may be found elsewhere in the present disclosure.

In some embodiments, the sensor portion 302 may implement detection functions in several scenarios by using several types of sensors disposed on the smart lock 130-1, so that the processing device 112 may determine whether the smart lock 130-1 is operated (e.g., a handle, a knob, a button, etc., of smart lock 130-1 is operated). The several detection functions may include a bolt detection, a clutch position detection, a handle detection, an infrared detection, a mechanical key detection, an anti-pry detection, an anti-peephole theft detection, a noise detection, or the like, or any combination thereof. Correspondingly, the sensors configured to implement the above detection functions may include a bolt detection sensor, a clutch position detection sensor, a handle (or a knob, a button, etc.) detection sensor, an infrared sensor, a mechanical key detection sensor, an anti-pry door detection sensor, an anti-peephole theft sensor, a noise sensor, or the like, or any combination thereof. In some embodiments, the bolt detection sensor can detect a state of the bolt of the lock body structure, and identify states of the lock body and a latch bolt, thereby ensuring a locked state of the door. In some embodiments, the clutch position detection sensor may be configured to detect a relative position of the driving module 270, thereby determining a separation state between the driving module 270 and the lock body structure. In some embodiments, the handle detection sensor may include an operation knob detection on an inner panel of the door body and a handle detection on an outer panel of the door body, thereby determining whether the door is opened by the outer panel or the inner panel. In some embodiments, the infrared sensor can rapidly wake up the smart lock system in the case that the system is in a deep dormant state, thereby saving the battery power. Meanwhile, the infrared sensor can also perform a brightness detection of a background light and adjust a brightness of the screen in real time. In some embodiments, for the mechanical key detection sensor, the smart lock may obtain the unlocked state of the mechanical key. In some embodiments, the anti-pry detection sensor can trigger an anti-pry device to give an alarm where someone is attempting to pry the lock. In some embodiments, for the anti-peephole theft sensor, the inner panel of the smart lock may be equipped with a detection device. When the sensor is triggered, the door handle may be pressed down and unlocked. When the sensor is not touched, unlocking via the inner panel handle may not be implemented. If a criminal pries the lock by pressing the handle under the peephole, since the criminal does not touch the sensor, it is impossible to unlock the lock through the handle on the inner panel. In some embodiments, for the noise sensor, after the smart lock is awakened, the noise sensor can detect a background noise and adjust a speaker volume in real time. In some embodiments, the bolt detection sensor and the clutch position detection sensor may include a gyroscope sensor, a Hall sensor, a magnetic induction sensor, an angular velocity sensor, or the like, or any combination thereof. More descriptions regarding the bolt detection sensor and the clutch position detection sensor may be found elsewhere in the present disclosure. In some embodiments, the sensor portion 302 may be further configured to determine that the lock is unlocked from indoors or outdoors. For example, the sensor portion 302 may include a sensor for living object detection, and the sensor for living object detection may determine a position relationship between a user who unlocks the lock and the lock. As another example, the sensor portion 302 may include an object determination sensor, and the object determination sensor may be configured to determine whether a user has a permission to unlock the lock from indoors.

In some embodiments, the security portion 303 may be used to achieve the security of the smart lock system via one or more sensors in the sensor portion 302. For example, the anti-pry door detection sensor can effectively prevent the smart lock from being pried. As another example, an anti-peephole theft sensor can prevent the environment inside the door from being observed from outside the door through the peephole. As still another example, the bolt detection sensor can detect the state of the bolt of the lock body, and identify the state of the lock body and the bolt, thereby ensuring the locked condition of the door to avoid the safety risk caused by forgetting to lock. As still another example, the object determination sensor may prevent an object without the permission (e.g., a baby, a child, an intruder, etc.) from leaving the house.

In some embodiments, the smart lock state reporting portion 304 may be understood as reporting information related to the door state or the lock state of the smart lock 130-1 to the server 110, and the server 110 may selectively send the information to the corresponding user terminal 140. In some embodiments, the information related to the door state or the lock state may include the state (e.g., whether the door is open or closed) of the door body and the state (e.g., whether the bolt is in the extended state or the retracted state) of the lock. In some embodiments, a reporting content of the door state may also include an anti-pry alarm, information indicating whether the door is closed, unlocking time information, etc. In some embodiments, a reporting content of the lock body state may also include movement of the handle (knob), unlocking or locking of the bolt, touching the button, etc. In some embodiments, the smart lock state may be detected by the sensor portion 302.

In some embodiments, the power management portion 305 may include charging management and power consumption management. In some embodiments, the charging management may include a charging mode and a type of a rechargeable battery. For example, the charging mode may indicate that the smart lock can be charged via a USB interface. As another example, the type of the rechargeable battery may indicate that the smart lock uses a polymer rechargeable battery. The battery may be charged by a charging management module, and the smart lock may be normally used during the charging. In some embodiments, the power consumption management may include obtaining the battery capacity of the smart lock in real time and feeding back the battery capacity information to the user. For example, the smart lock is equipped with a co-processor configured to specifically manage a system power source (e.g., a battery). A power acquisition unit may obtain the battery capacity in real time. The processor may obtain the battery capacity. In one aspect, the battery capacity may be uploaded to the server 110 via the ZigBee network, and the user may obtain the battery capacity via the APP. In another aspect, in the case of low power, an indicator light on the smart lock may light up to prompt a low power to the user. When the battery capacity reaches to a low power shutdown threshold, the processor may inform the co-processor to shut down the system power source.

In some embodiments, the power consumption management may further include a rapid wake-up function. The rapid wake-up function may be configured to wake up the smart security device (i.e., the smart lock 130-1) from a sleep mode or a standby mode, so that subsequent operations are performed rapidly, which may reduce power consumption and ensure the performance of the smart lock. In some embodiments, the wake-up mode may include contact wake-up and non-contact wake-up. The contact wake-up may include mechanical switch wake-up (e.g., key switch wake-up or shrapnel pressure switch wake-up), touch wake-up (e.g., pressure sensor wake-up or capacitive sensor wake-up). The non-contact wake-up may include sound wake-up, infrared proximity wake-up, or the like, or any combination thereof. In some embodiments, an element configured to implement the wake-up function may be located on the smart lock 130-1, or may be independently disposed relative to the smart lock 130-1.

In some embodiments, the wake-up mode may also include automatic wake-up. That is, the control module 230 (e.g., the control panel 60) of the smart security device may be waked up by a wake-up sensor sensing a motion signal of the mechanical structure 280 in the smart lock 130-1. Then, the control module 230 may wake up several sensors that are in the dormant state or the standby state. In some embodiments, the wake-up sensor may include an angular accelerometer, a Hall sensor, a magnetic induction sensor, or the like, any combination thereof. More descriptions regarding the wake-up function may be found elsewhere in the present disclosure.

In some embodiments, when the smart security system corresponds to the smart lock 130-1, the functional portion of the smart lock 130-1 may also include a rapid assembly portion. In some embodiments, the rapid assembly portion may include rapidly assembling the smart lock 130-1 to the door body, which may improve efficiency of mounting the smart lock on the door body. In other embodiments, the rapid assembly portion may include rapidly assembling each part of the smart lock 130-1 to improve assembly efficiency of operating production lines. More descriptions regarding the rapid assembly portion may be found elsewhere in the present disclosure, which is not repeated herein.

The smart lock may include functions of electric unlocking and manual unlocking, so that the user can choose different unlocking modes according to the needs of different scenarios. For example, when the user forgets the password, the fingerprint recognition is abnormal, or the smart lock is out of power, the user may choose the manual unlocking mode, that is, use the mechanical key to unlock the smart lock. As another example, the user may use the manual knob (or a knob, a handle, a button, etc.) to unlock the door indoors. During unlocking the lock with the mechanical key or by turning the manual knob, the mechanical key or the manual knob may drive a lock body shaft in the lock body structure to rotate, thereby unlocking the smart lock. In some embodiments, the lock body shaft may be in a transmission connection to the driving motor. When the user uses the mechanical key or the manual knob to rotate, the user needs to apply a large torque to drive the lock body shaft to rotate, thereby unlocking the smart lock.

In some embodiments, the mechanical structure 280 on the smart lock may include a clutch mechanism. When the lock body structure of the smart lock is in a locked state, the driving module may drive the motor to rotate to a clutch position. That is, a motion transmission between the driving motor and the lock body structure is disconnected. Therefore, next time the lock is unlocked using the mechanical key or the knob inside the door, no large torque is needed, the operation is labor-saving, and the user experience is improved.

In some embodiments, the clutch mechanism may include a planet gear transmission assembly. For example, rotations of the driving motor may drive a sun gear to rotate, and rotations of the sun gear may drive planet gears to rotate. The planet gears and the lock body shaft on the lock body structure may be in a transmission connection. When the lock body shaft is connected to one of the planet gears, the lock body shaft may be driven to unlock the smart lock. When the lock body shaft is connected to another one of the planet gears, the lock body shaft may be driven to lock the smart lock. When the sun gear drives the planet gear on the planet carrier to rotate, the planet carrier may swing under the action of inertia. The swing of the planet carrier may cause that the planet gear is separated from the lock body structure to enter a transmission disconnected state. The detailed description may be taken hereinafter in combination with FIGS. 4 to 11.

Figure 4:
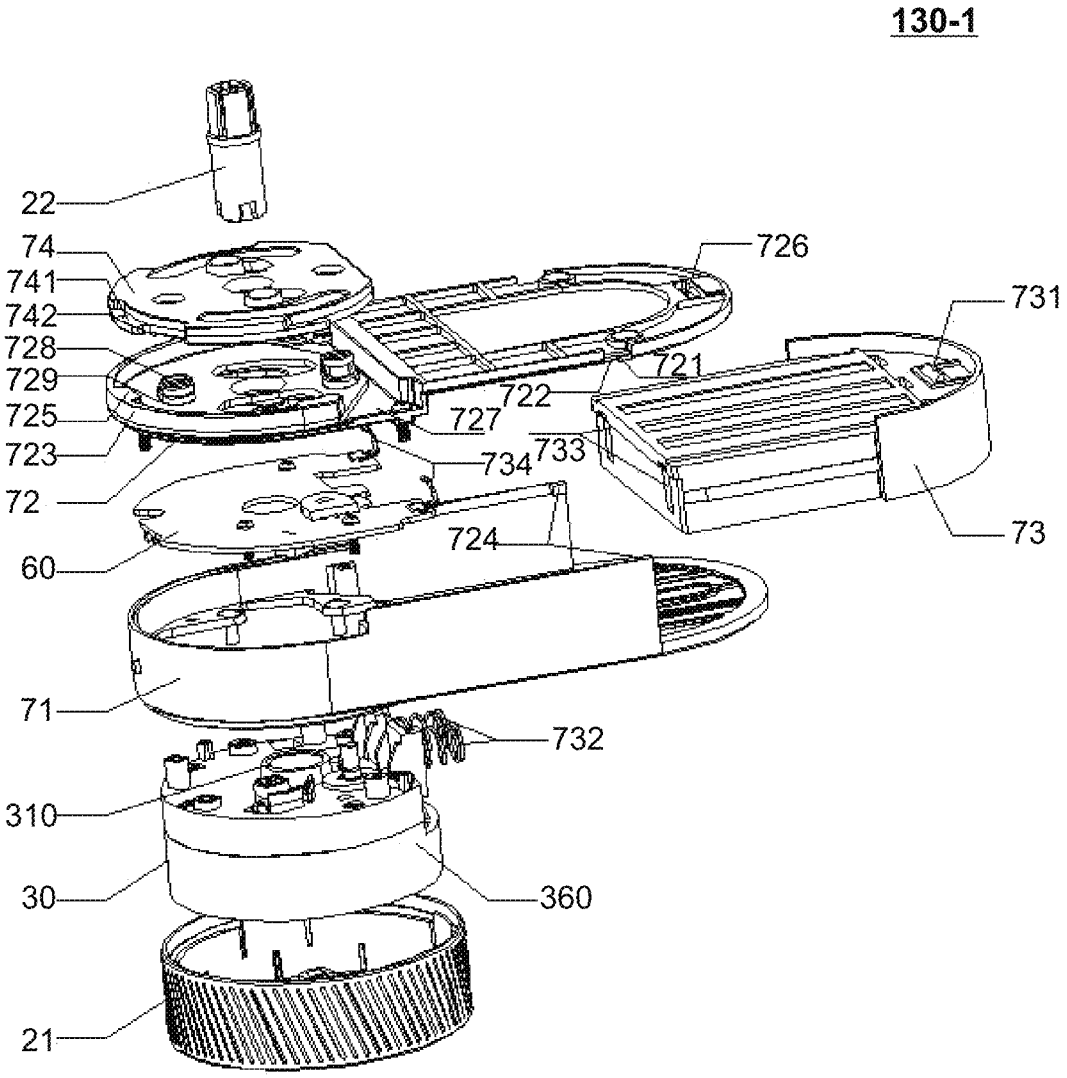
FIG. 4 is a schematic exploded view illustrating an assembly of a smart lock according to some embodiments of the present disclosure.
Figure 5:
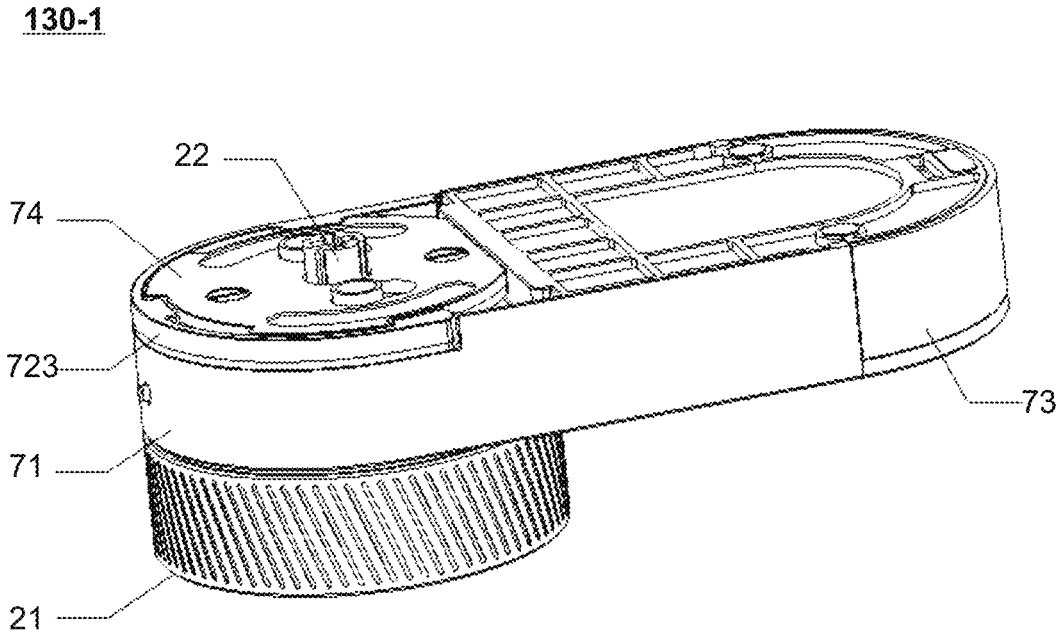
FIG. 5 is a schematic diagram illustrating a whole structure of a smart lock according to some embodiments of the present disclosure.

Referring to FIG. 4 and FIG. 5, FIG. 4 is a schematic exploded view illustrating an assembly of a smart lock according to some embodiments of the present disclosure, and FIG. 5 is a schematic diagram illustrating a whole structure of a smart lock according to some embodiments of the present disclosure.

As shown in FIG. 4 and FIG. 5, the driving module 270 of the smart lock 130-1 may include a driving component 12 and a lock body structure, and the mechanical structure 280 of the smart lock 130-1 may include a transmission assembly between the driving module 270 and the lock body structure. The lock body structure may include a lock body shaft and a bolt connected to the lock body shaft. The transmission assembly may include a lock body connection member 22 connected to the lock body structure. The lock body connection member 22 may be connected to the lock body shaft, and movement of the lock body connection member 22 may drive the lock body shaft to move, thereby driving the bolt to move in an unlocked position and a locked position. The lock body shaft and the bolt may be mounted on the door body, which are not illustrated in the drawings.

Figure 6:
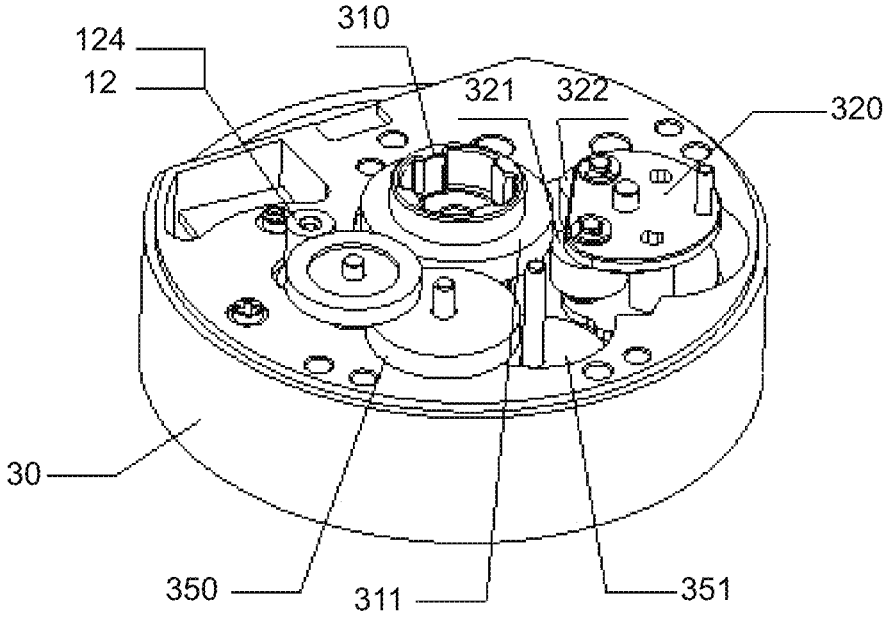
FIG. 6 is a schematic diagram illustrating an assembly relationship of a clutch mechanism according to some embodiments of the present disclosure.

As shown in FIG. 4, the driving component 12 (As shown in FIG. 6) and a manual knob 21 of the smart lock 130-1 may respectively drive, via a lock body transmission member 310, the lock body connection member 22 to move, thereby driving the lock body structure (not illustrated in the drawings) to move between an unlocked state and a locked state. The control module 230 of the smart lock 130-1 may include a control panel 60, which controls the start and stop of the driving component 12. The power supply module 250 of the smart lock 130-1 may include a battery compartment assembly 73, which is configured to supply power to operate the driving component 12.

In some embodiments, when the driving component 12 of the driving module 270 uses a motor, the driving module 270 may further include a reduction stage (e.g., a gear reduction mechanism 350). In some embodiments, the planet transmission assembly is disposed between a final-stage element of the reduction stage and the lock body connection member 22. For example, coupling or separation between the final-stage element and the planet transmission assembly may cause the driving module 270 and the lock body structure to be coupled or separated during a rotation transmission. The final-stage element refers to a last-stage element on the reduction stage from a transmission direction that the driving component 12 is an input end. As shown in the drawings, in some embodiments, an output shaft 124 of the driving component 12 (e.g., the motor) may be connected to the gear reduction mechanism 350 through a transmission connection. It may be understood that a final-stage driven gear 351 of the gear reduction mechanism 350 is the final-stage element or the final-stage gear. Referring to FIG. 6, FIG. 6 is a schematic diagram illustrating an assembly relationship of a clutch mechanism according to the embodiment.

Figure 7:
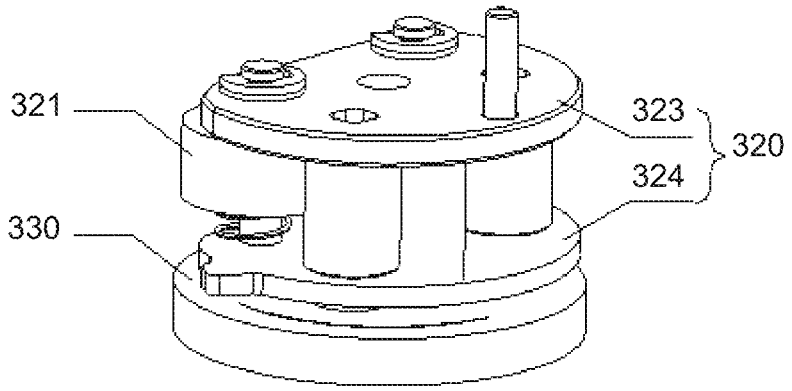
FIG. 7 is a schematic diagram illustrating a main structure of a clutch mechanism according to some embodiments of the present disclosure.

In some embodiments, the driving component 12 and the manual knob 21 of the smart lock 130-1 may be connected to the lock body connection member 22 respectively, and drive the lock body structure (not shown in the drawings), via the lock body connection member 22, to move. In some embodiments, the driving component 12 and the manual knob 21 may respectively transmit the motion to the lock body connection member 22 via the lock body transmission member 310, thereby driving the lock body structure (not shown in the drawings) to move. As shown in FIG. 6, in some embodiments, power transmission may be performed via an output gear 311 that is disposed on the lock body connection member 22 and rotated coaxially and the planet transmission assembly, so that the planet transmission assembly is driven, via the driving component 12, to rotate, and hence the lock body transmission member 310 is driven to rotate. In some embodiments, rotations of the manual knob 21 may drive, via a rotation connection between the manual knob 21 and the lock body transmission member 310, the lock body transmission member 310 to rotate. The clutch mechanism will be described in detail hereinafter in combination with the accompanying drawings. Referring to FIG. 7, FIG. 7 is a schematic diagram illustrating a main structure of a clutch mechanism according to some embodiments of the present disclosure.

As shown in FIG. 6 and FIG. 7, in some embodiments, a planet transmission assembly may be disposed between the output gear 311 and the final-stage gear (the final-stage driven gear 351) connected to the output shaft 124 of the driving component 12. The planet transmission assembly may include a sun gear 330, a planet carrier 320, and two planet gears (a first planet gear 321 and a second planet gear 322). The first planet gear 321 and the second planet gear 322 may be rotatably disposed on the planet carrier 320, and the sun gear 330 may be engaged with the two planet gears simultaneously. The driving component 12 can drive the sun gear 330 to rotate, and the sun gear 330 can drive the first planet gear 321 and the second planet gear 322 to rotate. When the sun gear 330 drives the first planet gear 321 and the second planet gear 322 to rotate, the planet carrier 320 may swing between a first position and a second position. For example, when the sun gear 330 drives the two planet gears to rotate along a first direction, the planet carrier 320 may swing along the first direction under the action of inertial force. In some embodiments, when the planet carrier 320 is in the first position, a first coupling relationship may be formed between the first planet gear 321 and the lock body connection member 22. When the planet carrier 320 is in the second position, a second coupling relationship may be formed between the second planet gear 322 and the lock body connection member 22. The first coupling relationship and the second coupling relationship may be understood as a transmission connection relationship. For example, in the first coupling relationship, the first planet gear 321 may be in transmission connection to the lock body connection member 22, and rotations of the first planet gear 321 driven by the sun gear 330 can drive the lock body connection member 22 to move, thereby driving the lock body structure disposed on the door body to move, that is, drive the lock body shaft and the bolt to unlock the smart lock. Correspondingly, in the second coupling relationship, the second planet gear 322 may be in a transmission connection to the lock body connecting member 22, and rotation of the second planet gear 322 can drive the lock body connection member 22 to move, thereby driving the lock body structure to move to lock the smart lock.

In some embodiments, the driving component 12 may include a motor and a connection member between the motor and the output shaft 124. In some embodiments, a flexible connection may be established between the motor and the output shaft 124. For example, the motor and the output shaft 124 may be connected via a connector. In some other embodiments, a rigid connection may be established between the motor and the output shaft 124. For example, the motor and the output shaft 124 may be directly connected and integrated as an entirety via a spline, etc. In some embodiments, similar to the driving motor in the above embodiments, the motor herein may include a DC motor, an AC induction motor, a permanent magnet motor, a switched reluctance motor, or the like, or any combination thereof. In some embodiments, the driving component 12 may include one or more motors.

Figure 8:
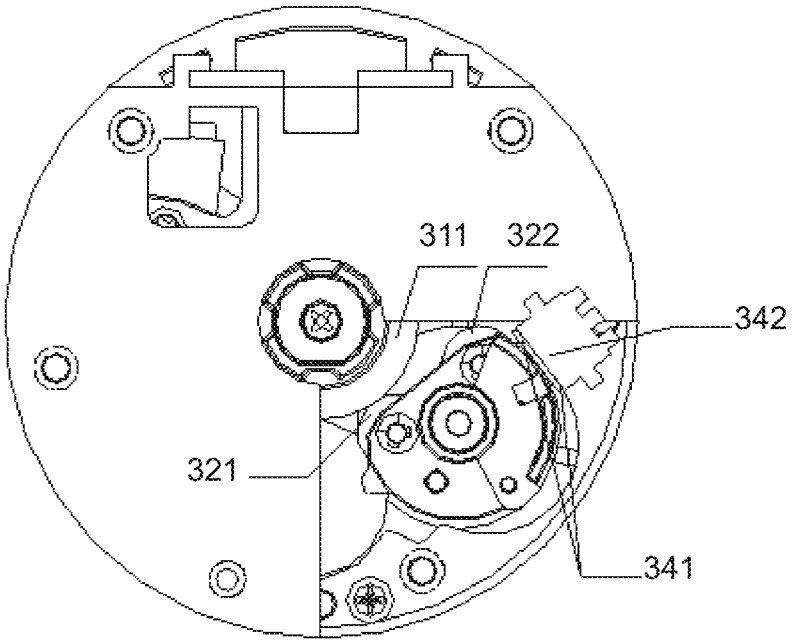
FIG. 8 is a schematic diagram illustrating a clutch mechanism under a first engagement relationship according to some embodiments of the present disclosure.
Figure 9:
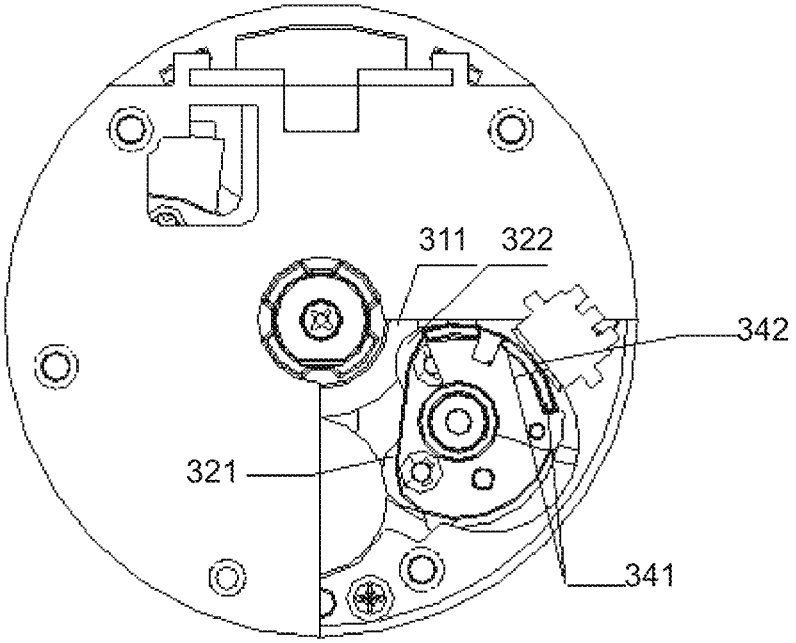
FIG. 9 is a schematic diagram illustrating a clutch mechanism under a second engagement relationship according to some embodiments of the present disclosure.

Still referring to FIG. 6 and FIG. 7, the sun gear 330 may be engaged with the final-stage driven gear 351. The two planet gears rotatably disposed on the planet carrier 320 may be located on both sides of a connection line of a rotation center of the sun gear 330 and a rotation center of the output gear 311 respectively, and include two engagement relationships corresponding to unlocking and locking respectively, which correspond to the first coupling relationship and the second coupling relationship as described above respectively. When the planet carrier 320 rotates clockwise, the first planet gear 321 may form a first engagement relationship with the output gear 311 (as shown in FIG. 8), which corresponds to the first coupling relationship. When the planet carrier 320 rotates counterclockwise, the second planet gear 322 may form a second engagement relationship with the output gear 311 (as shown in FIG. 9), which corresponds to the second coupling relationship.

In some embodiments, the planet carrier 320 may have a transitional rotation stroke that switches between the first position and the second position. The first position may correspond to the first engagement relationship, and the second position may correspond to the second engagement relationship. It should be noted that the "transitional rotation stroke" herein refers to a specific rotation stroke for switching from one engagement relationship to another engagement relationship, which is essentially configured to construct a separation state of the clutch mechanism. More descriptions regarding the separation state may be found elsewhere in the present disclosure (e.g., FIG. 10 and descriptions thereof).

In some embodiments, a clutch mechanism may be disposed between the lock body transmission member 310 that drives the lock body shaft to rotate and the final-stage driven gear 351 that is automatically driven. The two engagement relationships may correspond to automatic unlock and lock operations, respectively. In addition, the driving component 12 may be disconnected from the lock body transmission member 310 based on the setting of the transitional rotation stroke. At this time, the planet transmission assembly and the lock body connection member 22 may be in a non-coupled relationship. That is, the two planet gears and the lock body transmission member 310 may be in a non-transmission connection state, so that the two planet gears of the clutch mechanism and the lock body transmission member 310 (i.e., the lock body connection member 22) may be reliably separated. In practice, the manual unlocking operation may be realized without applying a large force, which may greatly improve the user experience, and provide a good technical guarantee for ensuring the manual and automatic operation conversion.

As shown in FIG. 7, in some embodiments, the planet carrier 320 may include a first plate 323 and a second plate 324 that are spaced apart from each other. The two planet gears may be disposed between the first plate 323 and the second plate 324. The sun gear 330 may be fixedly connected to the second plate 324 of the planet carrier 320, and located in a transmission member box 360 (as shown in FIG. 4), so that an overall space utilization rate is high. For instance, the planet carrier 320 in a normal state may be at an intermediate position between the first engagement relationship and the second engagement relationship. The intermediate position may be regarded as a clutch position. That is, at the position, an automatic driving side member of the clutch mechanism and the lock body transmission member 310 may be in a non-transmission connection state, which enables that the smart lock has a good manual operation experience under the normal state.

In some embodiments, for good manual-automatic operation switching performance, a detection manner configured to detect a rotation position may be further disposed. For instance, the present disclosure provides a detection device configured to detect the rotation position (or a rotation angle) of the planet carrier 320 to determine whether the planet carrier 320 is in a non-transmission state between the first position and the second position, so as to ensure that the driving module 270 is disconnected from the lock body structure along a transmission direction. In some embodiments, the detection device may include a sensor, and rotation angle information of the planet carrier 320 may be determined by obtaining a related signal, so that a current position of the planet carrier may be obtained. The sensor may include an infrared sensor, a gyroscope sensor, a Hall sensor, an angle sensor, or the like, or any combination thereof. In some embodiments, the detection device may further include a switch detection device. When the planet carrier 320 rotates to a predetermined position, the switch detection device may be triggered to obtain the current position of the planet carrier 320 and determine whether the planet carrier 320 is in the non-transmission connection position, that is, the separation position. The following takes the switch detection device as an example for a detailed description.

In some embodiments, the switch detection device may include a switch toggle 341 and a detection switch 342. In some embodiments, switch toggles may be disposed at both the first position and the second position of the planet carrier 320.

Figure 10:
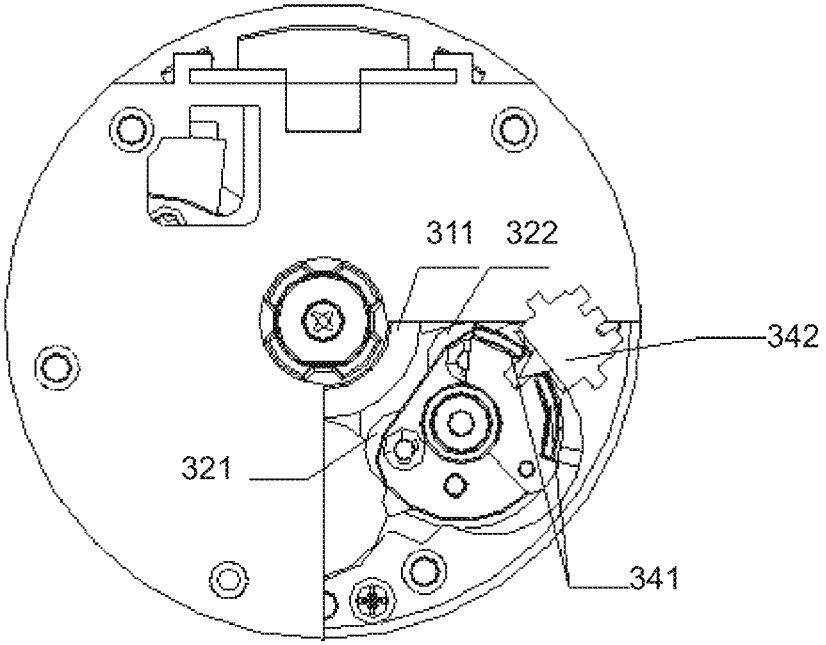
FIG. 10 is a schematic diagram illustrating a clutch mechanism under a separation relationship according to some embodiments of the present disclosure.
Figure 11:
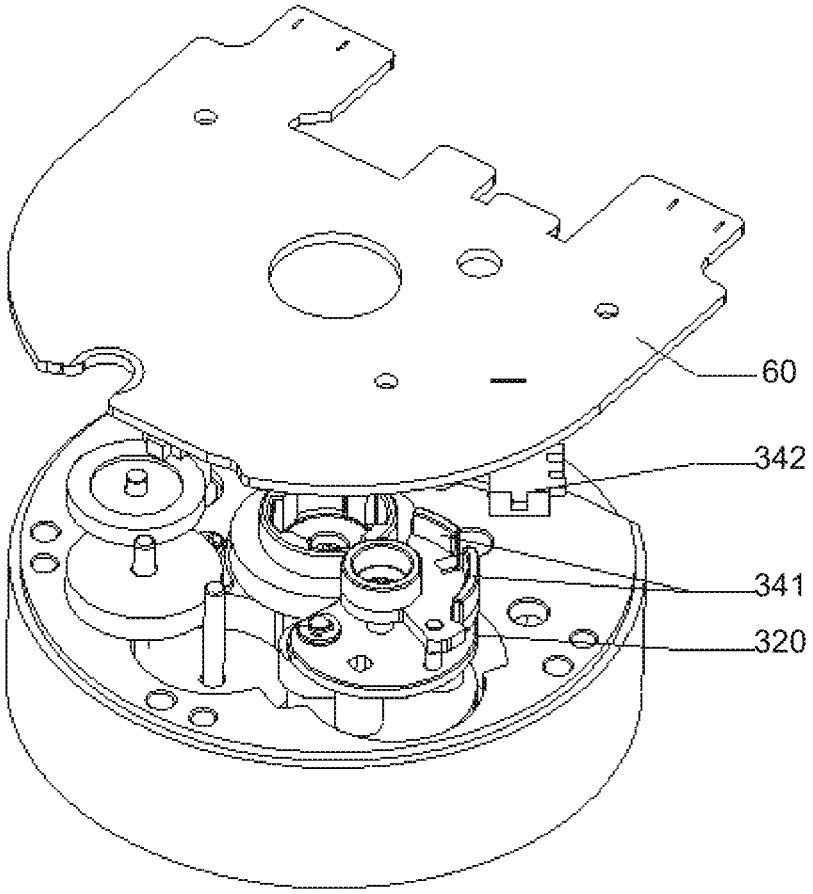
FIG. 11 is a schematic diagram illustrating an adaptation relationship between a switch toggle and a detection switch according to some embodiments of the present disclosure.

Referring to FIG. 11, FIG. 11 is a schematic diagram illustrating an adaptation relationship between a switch toggle and a detection switch according to some embodiments of the present disclosure. As shown in FIG. 11, the switch toggle 341 may be disposed on the planet carrier 320. Accordingly, the detection switch 342 may be disposed on the control panel 60 to further improve the utilization rate of the internal space. In some embodiments, the control module 230 may include the control panel 60 configured to control the driving module 270 to operate. The driving module 270 may act on the mechanical structure 280 to perform subsequent operations. The switch toggle 341 may be configured that when the planet carrier 320 forms the first engagement relationship and the second engagement relationship during a swing process, the detection switch 342 may be triggered to form a corresponding trigger signal respectively, and the trigger signal may be output to the control panel 60. Therefore, the control panel 60 can output a reverse rotation control signal based on the corresponding trigger signal, so that the planet carrier 320 is in the intermediate position. In some embodiments, the detection switch may include a photoelectric switch, a touch switch, an induction switch, or the like, or any combination thereof. Taking the touch switch as an example, the touch switch may be disposed with a pointer, and the switch toggle may be disposed a groove configured to accommodate the pointer. When the two planet gears are in a non-engagement state (as shown in FIG. 10), the pointer may be accommodated in the groove. The pointer may not be deformed at this time, and thus no trigger signal is generated, and the control panel does not need to output the reverse rotation control signal. When one of the two planet gears is in an engagement state (as shown in FIG. 8 and FIG. 9), the pointer may not be accommodated in the groove, but be deformed, and thus a trigger signal is generated, and the control panel can output the reverse rotation control signal to the driving component 12 based on the trigger signal, so that the planet carrier 320 may be in the intermediate position. In some embodiments, taking the case where the planet carrier 320 rotates clockwise to form the first engagement relationship for automatic unlocking as an example, when the planet carrier 320 rotates clockwise to unlock under a drive of the driving component 12 (e.g., the motor), in response to the detection switch 342 being triggered, the control panel 60 may output the reverse rotation control signal to the driving component 12 (e.g., the motor), and the planet carrier 320 may rotate counterclockwise to the intermediate position. That is, both planet gears may be in the non-engagement state. The reverse is also true. Therefore, after automatically driving the unlock and lock operations, the smart lock may be always maintained in the non-engagement position that can be manually operated at any time. That is, the planet gear assembly and the lock body connection member may be in the non-engagement state.

In some embodiments, after the smart lock performs the unlock and lock operations, the control panel 60 may control the driving component 12 to reversely rotate to cause the planet carrier 320 to enter the intermediate position immediately. In some embodiments, the control panel 60 may control the driving component 12 to reversely rotate within a predetermined time after the smart lock performs the unlock and lock operations. The predetermined time may be within a range from 0 hours to 3 hours. In some embodiments, the predetermined time may be within a range from 0 hours to 2 hours. The predetermined time may be within a range from 0 hours to 1 hour. The predetermined time may be within a range from 0 minutes to 40 minutes. The predetermined time may be within a range from 0 minutes to 20 minutes. The predetermined time may be within a range from 0 minutes to 10 minutes. In some embodiments, the control panel 60 may also immediately control the driving component 12 to reversely rotate in response to detecting that the user manually unlocks or locks the lock, so that the planet transmission assembly and the lock body connection member are in a clutched state, which is convenient for the user to open the door.

In addition, according to the moment the detection switch 342 is actually triggered, the control panel 60 may detect an actual rotation angle of the lock body shaft in real time for feedback adjustment. In some embodiments, from the moment the detection switch 342 is triggered, the control panel 60 may start to detect the actual rotation angle of the lock body shaft, and determine whether the lock body shaft has completed the locking or unlocking operation according to the actual rotation angle of the lock body shaft, so that the driving component 12 is controlled to reversely rotate at an appropriate time.

In some embodiments, the lock body may include a position sensor. Exemplary position sensor may include a Hall switch, a mechanical micro switch, or the like, or any combination thereof. In some embodiments, the lock body may include a plurality of Hall switches. The plurality of Hall switches may be disposed different positions along a circumferential direction. When the lock body shaft is moving, the plurality of Hall switches may be triggered to determine a current position of the lock body shaft, and the current position may be sent to the control panel 60. Then the control panel 60 may determine whether the unlocking or locking is completed based on the current position of the lock body shaft. In some embodiments, a count of Hall switches may be determined according to actual requirements. For example, the count of Hall switches may be 2, 3, 4, 5, 6, 8, 10, 12, 15, etc.

In some embodiments, whether the unlocking or locking is completed may be determined based on rotation angles of a detection subject (e.g., the door body shaft or the bolt). For example, the detection subject (e.g., the door body shaft or the bolt) may be in a transmission connection to a detected element. Rotation angles of the detected element may be detected through an infrared code disc, a magnetic code disc, a gyroscope, etc. More descriptions regarding the detection of the rotation angles may be found elsewhere in the present disclosure. The control panel 60 may determine whether the unlocking or locking is completed based on the rotation angles.

In addition, the lock body may include a mechanical micro switch. After the locking or unlocking is completed, the driving component 12 may reversely rotate so as to switch the smart lock to the operation vacancy state. When the mechanical micro switch is triggered, the current position of the lock body shaft may be determined, and the current position may be sent to the control panel 60. The control panel 60 may determine that the smart lock is switched to the operation vacancy state, and control the driving component 12 to stop.

In addition, the control panel 60 may also obtain a determination result indicating whether the clutch mechanism is in the separation state by taking a failure to receive a trigger signal as a condition, and output an instruction signal of the manual operation. That is, a control policy may be optimized, based on whether the trigger signal is received, to further obtain the determination result indicating that the clutch mechanism is in the separation state, and output the instruction signal of the manual operation, so that an operator accurately catches timing of the manual operation. In addition, when the planet transmission assembly is in the separation state, the detection switch 342 may not be triggered, so that the switch between the electric operation and the manual operation can be reliably realized. The instruction signal of the manual operation may include a sound prompt, a voice prompt, a light prompt, or the like, or any combination thereof.

In some embodiments, the switch toggle 341 may be disposed at the planet carrier 320 corresponding to an intermediate position of the first position and the second position. When the planet carrier 320 moves to the intermediate position, the corresponding switch toggle 341 may trigger the detection switch 342 and generate a trigger signal, and the trigger signal may be sent the control panel 60 to inform the control panel 60 that the planet carrier 320 is currently in the separation state. The control panel 60 may immediately control, in response to receiving the trigger signal, the driving component 12 to stop moving, so that the planet carrier 320 is maintained at the intermediate position.

In some embodiments, the mechanical structure 280 may further include a housing assembly configured to accommodate and/or support the transmission assembly 30, the driving component 12, the control panel 60, the battery compartment assembly 73, etc. For instance, as shown in FIG. 4 and FIG. 5, the housing assembly may include a housing 71 and a sealing plate 72. The housing 71 and the sealing plate 72 may be enclosed to form an inner chamber to accommodate internal components such as the transmission assembly 30, the control panel 60, etc. The manual knob 21 may be located on an outside of the housing 71. The driving component 12 and the manual knob 21 may drive, via the lock body transmission member 310 and the lock body connection member 22, the lock body shaft (not shown in the drawings) to rotate, respectively.

In some embodiments, for a good layout effect of related components on the smart lock 130-1, the transmission assembly 30 and the battery compartment assembly 73 may be arranged on the housing 71 along a same direction, for example, along a length direction of the housing 71 as shown in FIG. 4. For instance, the transmission assembly 30 may be disposed on one end of the housing 71 along the length direction, and the battery compartment assembly 73 may be disposed on the other end of the housing 71 along the length direction. The length direction of the housing 71 refers to a direction in which a longer side of the housing 71 is located.

As shown in FIG. 5, the other end of the housing 71 may be enclosed with the sealing plate 72 to form a lateral insertion opening. The battery compartment assembly 73 may be disposed in the inner chamber through the lateral insertion opening. Arranging the battery compartment assembly 73 along the length of the housing 71 may reduce a size occupation of the smart lock 130-1 along a thickness direction of the housing 71, and further reduce a space occupation of the smart lock 130-1 along the thickness direction, so that the smart lock 130-1 is more compact. The thickness direction can be understood as a direction parallel to a thickness of the door body when being mounted on the door body. It should be noted that in the present disclosure, the length direction, the thickness direction, etc., of the housing 71 may be understood as the length direction, the thickness direction, etc., of the smart lock 130-1.

In some embodiments, the control panel 60 may be at least partially overlapped between the sealing plate 72 and the transmission assembly 30 along the thickness direction of the housing 71, which may sufficiently utilize the space size of the housing 71 along the thickness direction, so that the smart lock 130-1 has a compact size along the thickness direction.

In some embodiments, parts of the smart lock 130-1 may be connected by screws. However, operations during assembling and maintenance may be relatively cumbersome, and require a plurality of people to cooperate during the assembling, which results in a low assembling efficiency. In some embodiments, for good overall assembling manufacturability, a detachable structure may be added to the parts (e.g., the sealing plate, the housing) to reduce the use of screws and improve the assembling efficiency.

First, a first detachable clamping mechanism may be disposed between the housing 71 and the sealing plate 72. The first detachable clamping mechanism may include a first stop block 724 and a first clamping block 721 that can be clamped with the first stop block 724. Referring to FIG. 4, the first stop block 724 may be disposed on the housing 71. Correspondingly, the sealing plate 72 may be correspondingly disposed with the first clamping block 721, and a side of the first clamping block 721 may be disposed with a through first notch 722. When the housing 71 and the sealing plate 72 are assembled, the housing 71 may be first aligned with the sealing plate 72, so that the first stop block 724 on the housing 71 can pass through the sealing plate 72 from a side of the sealing plate 72 close to the housing 71 to a side of the sealing plate 72 away from the housing 71 through the first notch 722; and then when the first stop block 724 reaches above a side of the first clamping block 721 (i.e., above the first notch 722), the sealing plate 72 or the housing 71 may be moved relatively laterally so that the first stop block 724 moves right above the first clamping block 721. Therefore, the housing 71 and the sealing plate 72 may be rapidly assembled. During disassembling, the operations need to be reversed.

Furthermore, a second detachable clamping mechanism may be disposed between the battery compartment assembly 73 and the sealing plate 72. The second detachable clamping mechanism may include a second notch 726 and an elastic buckle 731 matched with the second notch 726. As shown in FIG. 4, the sealing plate 72 may include the second notch 726. Correspondingly, the elastic buckle 731 may be disposed outside the housing of the battery compartment assembly 73. As the battery compartment assembly 73 is inserted and displaced, the elastic buckle 731 may be pressed and deformed, and the deformation may be released at the second notch 726, thereby achieving rapid assembling of the battery compartment assembly 73. Further, an elastic member 732 capable of supplying a force may be disposed on the transmission member box 360 of the transmission assembly 30, which is disposed corresponding to the battery compartment assembly 73. After the assembling, the battery compartment assembly 73 may be pressed against the elastic member 732 and thus the elastic member 732 may be deformed. When the second detachable clamping mechanism is released, the elastic member 732 may release elastic deformation energy to help the battery compartment assembly 73 to be rapidly separated from the housing 71.

Electrical connection contacts (not shown in the drawings) of the battery compartment assembly 73 may be placed in two inner grooves 733 of an insertion end of the battery compartment assembly 73, and correspondingly, the control panel 60 may be electrically connected to a battery contact elastic piece 734. After the battery compartment assembly 73 is inserted in place, each battery contact elastic piece 734 may be respectively placed in the corresponding inner groove 733 to form a reliable electrical connection.

In some embodiments, an outer surface of the clamped battery compartment assembly 73 may be substantially aligned with the outer surfaces of the housing 71 and the sealing plate 72, respectively. For instance, as shown in FIG. 5, the size and shape of the outer surface of each member may be in continuous transition.

In some embodiments, a thickness size of the smart lock 130-1 after the assembling may be within a range from 20 millimeters to 40 millimeters. In some embodiments, the thickness size may be within a range from 22 millimeters to 35 millimeters. In some embodiments, the thickness size may be within a range from 25 millimeters to 30 millimeters. For example, the thickness size of the smart lock 130-1 after the assembling may be 23.3 millimeters. In some embodiments, a length size of the smart lock after the assembling may be within a range from 100 millimeters to 180 millimeters. In some embodiments, the length size may be within a range from 130 millimeters to 150 millimeters. In some embodiments, the length size may be within a range from 140 millimeters to 145 millimeters. For example, the length size of the smart lock 130-1 after the assembling may be 143 millimeters or 144 millimeters. In some embodiments, a width size of the smart lock after the assembling may be within a range from 40 millimeters to 80 millimeters. In some embodiments, the width size may be within a range from 50 millimeters to 70 millimeters. In some embodiments, the width size may be within a range from 65 millimeters to 70 millimeters. For example, the width size of the smart lock 130-1 after the assembling may be 67 millimeters.

It should be noted that the "first detachable clamping mechanism" and the "second detachable clamping mechanism" herein are not limited to the structure and the mounting position shown in the drawings, as long as any structures or mounting positions that the functional requirements for the rapid assembling can be met are within the scope of the present disclosure.

In addition, the outer surface of the sealing plate 72 may include an inner recess portion 727 along the thickness direction. The inner recess portion 727 may be disposed opposite to the control panel 60. A rotation buckle plate 723 and an assembling plate 74 may be disposed at the inner recess portion 727 to facilitate the assembling operations.

Referring to FIG. 4 and FIG. 5, the rotation buckle plate 723 and the assembling plate 74 may be sequentially disposed in the inner recess portion 727. An axial limit matching pair may be disposed between the rotation buckle plate 723 and the sealing plate 72. After the assembling, an axial relative displacement between the rotation buckle plate 723 and the sealing plate 72 may be restricted. In addition, the rotation buckle plate 723 may be switched between an assembling operation station and a disassembling operation station in a plane perpendicular to the lock body relative to the sealing plate 72. For example, the rotation buckle plate 723 may be disposed with an arc-shaped hole 729 concentric with the lock body. Accordingly, the rotation buckle plate 723 may be fixed to the sealing plate 72 by screwing up a fastener 728 through the arc-shaped hole 729. A head of the fastener 728 and the rotation buckle plate 723 beside the arc-shaped hole 729 may construct the axial limit matching pair. In addition, a rotation amplitude of a rod of the fastener 728 in the arc-shaped hole 729 may meet rotation stroke requirements for switching the operation stations. The types of the fastener 728 may include a screw, a bolt, a rivet, or other types of pins.

In some embodiments, the assembling plate 74 may be embedded on an outer side of the rotation buckle plate 723. An axial clamping adaptation portion may be disposed between the assembling plate 74 and the rotation buckle plate 723. When the rotation buckle plate 723 is disposed at the assembling operation station, the axial clamping adaptation portion may form an axial limitation. That is, the assembling is completed. When the rotation buckle plate 723 is at the disassembling operation station, the axial clamping adaptation portion may be separated. That is, the disassembling operation may be performed according to actual needs.

Correspondingly, one end of the lock body connection member 22 configured to be connected to the lock body shaft may be connected to the lock body transmission member 310. The lock body connection member 22 and the lock body transmission member 310 may rotate synchronously. The other end of the lock body connection member 22 may protrude from the assembling plate 74 to drive the lock body shaft to rotate. That is, the lock body connection member 22 may pass through middle assembly process holes of the control board 60, the sealing board 72, the rotation buckle board 723, and the assembly board 74 in sequence.

It should be understood that different adaptation structures of the "axial clamping adaptation portion" between the assembling plate 74 and the rotation buckle plate 723 may be selected according to a product assembling space and a process implementation mode. For example, the "axial engagement fitting portion" may employ, but not be limited to, the adaptation structure as shown in the drawings.

As shown in FIG. 4, an outer edge of the rotation buckle plate 723 for embedding the assembling plate 74 may be disposed with a second stop block 725 formed by extending inwardly along a radial direction of the rotation buckle plate 723. Accordingly, the assembling plate 74 may be correspondingly disposed with a second clamping block 741. A through third notch 742 may be disposed on a side of the second clamping block 741. During assembling of the rotation buckle plate 723 and the assembling plate 74, the second stop block 725 of the rotation buckle plate 723 may reach above a side of the second clamping block 741 through the third notch 742 of the assembling plate 74, and then be relatively rotated and moved to right above the second clamping block 741, that is, the assembling operation station. An axial clamping adaptation portion may be formed to form an axial limitation, so that the assembling plate 74 is rapidly assembled. During a disassembling, the rotation buckle plate 723 only needs to be reversely rotated, which has better operability. For instance, As shown in FIG. 4, after the assembling, the size and shape of the outer surface of each member may be in continuous transition. As a whole, the smart lock according to the present disclosure has a good integration in all dimensions.

In addition, the lock body connection member 22 may include a step limit surface greater than the assembly process hole of the assembling plate 74, so as to form an axial limitation on the lock body connection member 22 after the assembling plate 74 is assembled. Therefore, the lock body connection member 22 may be prevented from being abnormally separated from the lock body.

In some embodiments, the driving component 12 may employ a motor, and may be integrated with the gear reduction mechanism 350, the clutch mechanism, and the lock body transmission member 310 in the transmission box 360 to improve the integration and assembly process of the whole machine. In some embodiments, the gear reduction mechanism 350 may include a straight gear transmission mechanism. Therefore, the integration is better, and the assembling operations of the whole machine are convenient, which has a better assembling manufacturability. Further, the gear reduction mechanism includes the straight gear transmission mechanism, which also greatly reduces the space occupation along the thickness direction, and can be widely used in a use environment where strict requirements are imposed on external sizes in the thickness direction.

In some embodiments, the transmission assembly 30 in the mechanical structure 280 may also include other clutch mechanisms other than the planet transmission assembly. In some embodiments, the clutch mechanism may include an output member and a lock body transmission member 310. The output member may be in a transmission connection to the driving component 12, and the lock body transmission member 310 may be in a transmission connection to the lock body connection member 22 (shown in FIG. 4 and FIG. 5). A shape matching between the output member and the lock body transmission member 310 may realize that the driving component 12 drives the lock body connection member 22 to rotate. Correspondingly, separation between the output member and the lock body transmission member 310 may cause that the transmission between the driving component 12 and the lock body connection member 22 is disconnected. In some embodiments, the transmission connection between the driving component 12 and the output member may include a bevel gear transmission or a straight gear transmission. The clutch mechanism will be described in detail hereinafter in combination with FIG. 2 to FIG. 15*e*.

Figure 12:
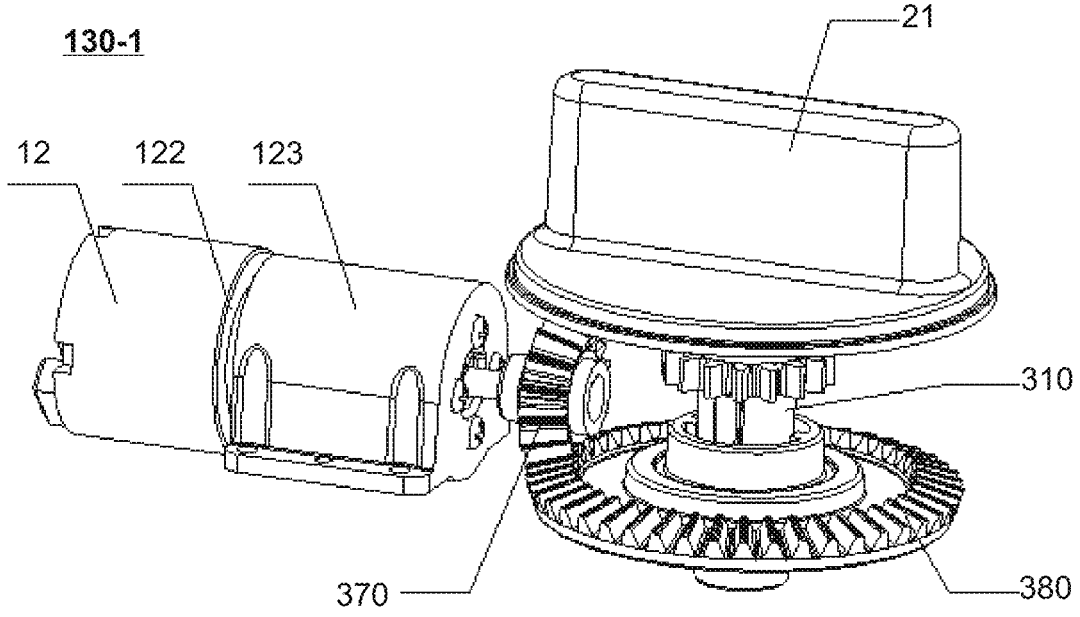
FIG. 12 is a schematic diagram illustrating an operation state of a clutch mechanism in a smart lock according to some embodiments of the present disclosure.

Referring to FIG. 12, FIG. 12 is a schematic diagram illustrating an operation state of a clutch mechanism in a smart lock according to some embodiments of the present disclosure. As shown in FIG. 12, the driving component 12 and the manual knob 21 of the smart lock may respectively drive, via the lock body transmission member 310, the lock body shaft (not shown in the drawings) to rotate. The lock body transmission member 310 and the output member (e.g., a driven bevel gear 380) may be coaxially disposed, so that a clutch mechanism is disposed between the lock body transmission member 310 and the output member. It may be understood that the output member is not limited to the driven bevel gear 380 shown in the drawings, as long as an element can be disposed between the driving component 12 and the lock body transmission member 310, and can be in the transmission connection to the driving component 12 and the lock body transmission member 310, for example, but not limited to, an output shaft, a straight gear, etc.

Figure 13:
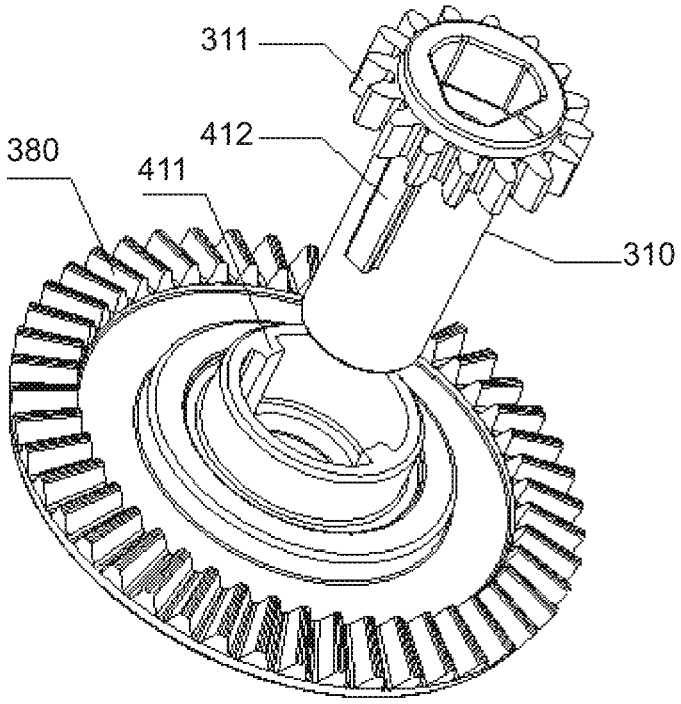
FIG. 13 is an exploded view illustrating an assembly of a clutch mechanism in a smart lock according to some embodiments of the present disclosure.
Figure 14:
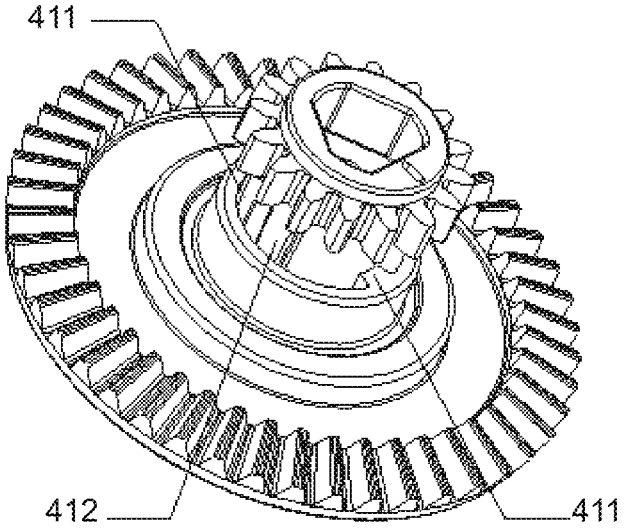
FIG. 14 is a schematic diagram illustrating an assembly relationship of a clutch mechanism in a smart lock according to some embodiments of the present disclosure.

In some embodiments, as shown in FIG. 13 and FIG. 14, an intermediate transmission member may be disposed with a first abutment member 411, and the lock body transmission member 310 may be disposed with a second abutment member 412. The first abutment member 411 and the second abutment member 412 may be abutted along a first direction to form a first abutment operation station. The first abutment member 411 and the second abutment member 412 may be abutted along a second direction to form a second abutment operation station. The first abutment member 411 and the second abutment member 412 may be separated from each other to form an operation vacancy. The first direction may be opposite to the second direction. In the first abutment operation station, the driving component 12 may drive the first abutment member 411 to continue to rotate to complete an unlock operation. In the second abutment operation station, the driving component 12 may drive the first abutment member 411 to continue to rotate to complete a lock operation. As shown in the drawings, the output shaft 124 (not shown in these drawings, but shown in FIG. 5) of the driving component 12 may be fixedly connected to a driving bevel gear 370, and the driven bevel gear 380 that is engaged with the driving bevel gear 370 may be considered as a middle transmission member.

Figure 15A:
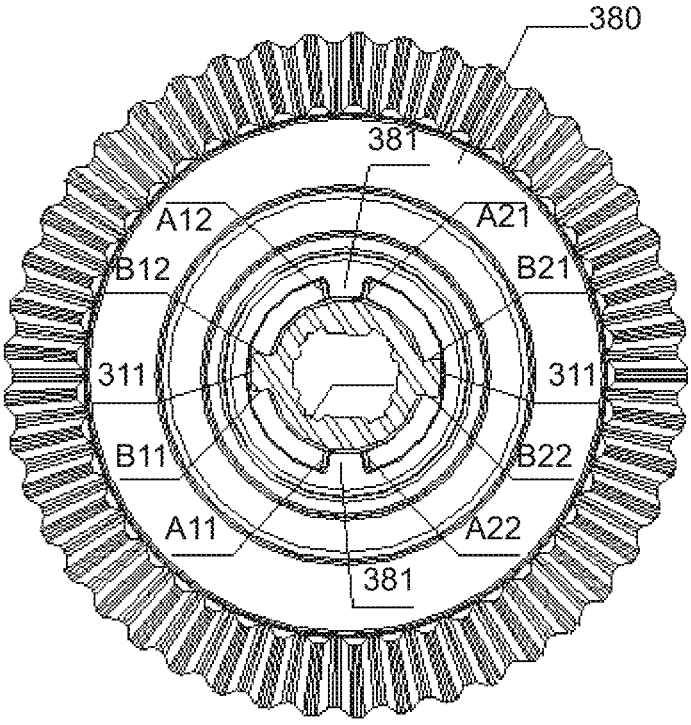
FIGS. 15*a*-15*e* are schematic diagrams illustrating clutch cooperation relationships of a clutch mechanism in different states according to some embodiments of the present disclosure, respectively.

One of the driven bevel gear 380 as the output member and the lock body transmission member 310 may be disposed with at least one pair of first circumferential limit parts (A11 and A12 are a pair, A21 and A22 are a pair), and the other of the driven bevel gear 380 and the lock body transmission member 310 may be disposed with at least one pair of second circumferential limit parts (B11 and B12 are a pair, and B21 and B22 are a pair). A pair of first circumferential limit parts and a corresponding pair of second circumferential limit parts may form a set of clutch adaptation pairs (A1-B1 is a set, and A2-B2 is a set). Each set of clutch adaptation pairs may be configured as follows: each pair of the first circumferential limit parts (A11 and A12, A21 and A22) are spaced apart along a circumferential direction, and each pair of the second circumferential limit parts (B11 and B12, B21 and B22) may be adapted to one corresponding pair of the first circumferential limit parts (A11 and A12, A21 and A22), respectively, to form an abutment operation station that is circumferentially abutting and adapting, that is, the first abutment operation station and the second abutment operation station. A predetermined rotation stroke between the lock body transmission member 310 and the output member (e.g., the driven bevel gear 380) may be switched between the two abutment operation stations. When the middle transmission member and the lock body transmission member 310 are disposed within the predetermined rotation stroke between the two abutment operation stations, the middle transmission member and the lock body transmission member 310 may be separated from each other and in the operation vacancy. That is, the transmission between the driving component 12 and the lock body connection members 22 may be disconnected at an angle. In some embodiments, the predetermined rotation stroke may be greater than or equal to an operation stroke of the manual knob 21. It should be noted that the "predetermined rotation stroke" herein refers to a specific rotation stroke for switching from one operation station to another operation station. In this embodiment, a set of clutch adaptation pairs can implement the basic functions of the clutch mechanism, and two or more sets of clutch adaptation pairs can also implement the basic functions of the clutch mechanism, which have better effects. Referring to FIG. 14 to FIG. 15*a*, two first abutment members 411 may be disposed on the driven bevel gear 380. Each of the first abutment members 411 may include two first circumferential limit parts (A11 and A22, A12 and A21) on both sides along a rotation direction. Correspondingly, the lock body transmission member 310 may be disposed with two second abutment members 412. Each of the second abutment members 412 may include two second circumferential limit parts (B11 and B12, B21 and B22) on both sides along the rotation direction. In other embodiments, a count of first abutment members 411 may be the same or different from a count of second abutment members 412. In other embodiments, the count of first abutment members 411 and/or the count of second abutment members 412 may be one, three, or more. In some embodiments, when at least one of the intermediate transmission member and the lock body transmission member 310 is disposed with two abutment members, the two abutment members may be uniformly distributed or may be non-uniformly distributed on the circumference. In some embodiments, a circumferential angle corresponding to two adjacent abutment members may be within a range from 45 degrees to 180 degrees. In some embodiments, the circumferential angle corresponding to two adjacent abutment members may be within a range from 60 degrees to 160 degrees. In some embodiments, the circumferential angle corresponding to two adjacent abutment members may be within a range from 90 degrees to 140 degrees. In some embodiments, the circumferential angle corresponding to two adjacent abutment members may be within a range from 100 degrees to 120 degrees. In some embodiments, the circumferential angle corresponding to two adjacent abutment members may be within a range from 160 degrees to 180 degrees. For example, the circumferential angle corresponding to two adjacent abutment members may be 180 degrees, 120 degrees, or 90 degrees.

Referring to FIG. 13 and FIG. 14, FIG. 13 is an exploded view illustrating an assembly of a clutch mechanism in a smart lock according to some embodiments of the present disclosure. FIG. 14 is a schematic diagram illustrating an assembly relationship of a clutch mechanism in a smart lock according to some embodiments of the present disclosure.

As shown in FIG. 15*a*, the clutch mechanism may be disposed with two pairs of first circumferential limit parts (A11 and A12, A21 and A22) and two pairs of second circumferential limit parts (B11 and B12, B21 and B22). In addition, the lock body transmission member 310 may be inserted into the driven bevel gear 380 to form a pivotal connection within the predetermined rotation stroke. Alternatively, the pivotal connection may also be reversely formed. That is, the driven bevel gear 380 may be inserted into the lock body transmission member 310. As long as adaptation hole walls and outer surfaces of the two pairs of first circumferential limit parts (A11 and A12, A21 and A22) and the two pairs of second circumferential limit parts (B11 and B12, B21 and B22) are configured, the configuration is within the scope of the present disclosure.

In some embodiment, in the pivotal connection, the first abutment member 411 may be an inner bump 381 extending radially inward on a hole wall of the driven bevel gear 380, and the second abutment member 412 may be an outer bump 382 extending radially outward on an outer surface of the lock body transmission member 310. The first circumferential limit parts (A11 and A12, A21 and A22) may be disposed on the inner bump 381, and the second circumferential limit parts (B11 and B12, B21 and B22) may be disposed on the outer bump 382. An inner size of the inner bump 381 may be less than an outer size of the outer bump 382. Therefore, the clutch adaptation pairs abutted each other may be formed. Referring to FIG. 15*a*, FIG. 15*a* is a schematic diagram illustrating a clutch cooperation relationship of a clutch mechanism in a state according to some embodiments of the present disclosure. FIG. 15*a* shows a cross section of the clutch adaptation pair. Two outer bumps 382 and two inner bumps 381 may be disposed, which are spaced apart along the circumferential direction. The clutch mechanism may be formed by using the adapted inner bumps and outer bumps, and axial sizes of the transmission member and the intermediate transmission member may not be increased, so that the lock body has a high integration in terms of design. The structure is simple and reliable, and the assembling process is good.

After the assembling, the lock body transmission member 310 may keep rotating synchronously with the lock body shaft, and the manual knob 21 and the lock body transmission member 310 may also keep rotating synchronously. In the clutch mechanism according to the embodiment, two abutted and adapted operation stations may be disposed between the driven bevel gear 380 that is automatically driven and the lock body transmission member 310, and the assembling relationship between the driven bevel gear 380 and the lock body transmission member 310 may be effectively utilized. In response to switching to manual driving, based on the setting of the predetermined rotation stroke, the clutch mechanism may ensure that the driving component 12 is disconnected from the transmission member and is in a non-transmission connection state.

Taking a manual unlock operation after the driving component 12 performs the lock operation as an example, the basic principle of the clutch mechanism according to the embodiment is described in detail hereinafter based on states shown in FIG. 15*a* to FIG. 15*e* (As shown in FIG. 15*a* to FIG. 15*e*, a clockwise rotation of the transmission member is the lock operation, and a counterclockwise rotation of the transmission member is the unlock operation). FIGS. 15*a* to 15*e* are schematic diagrams illustrating clutch cooperation relationships of a clutch mechanism in different states according to some embodiments of the present disclosure, respectively.

Figure 15B:
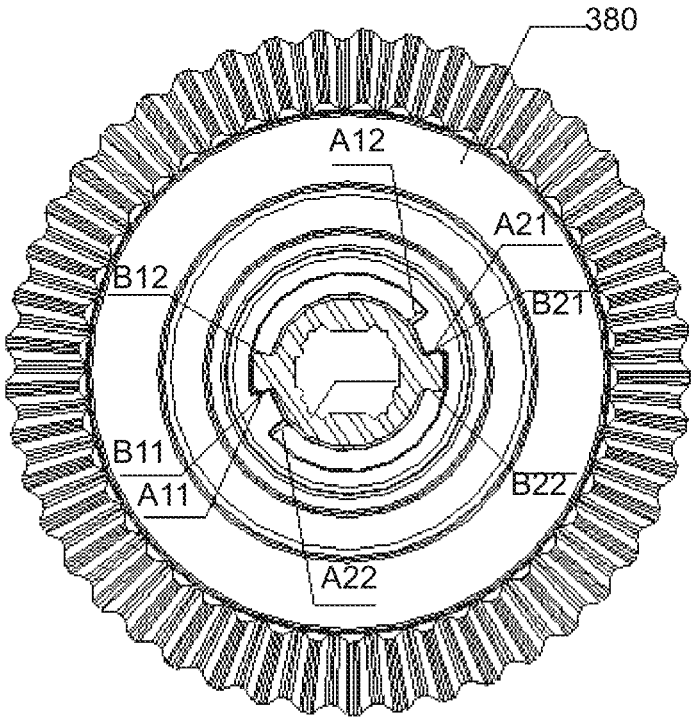
Figure 15C:
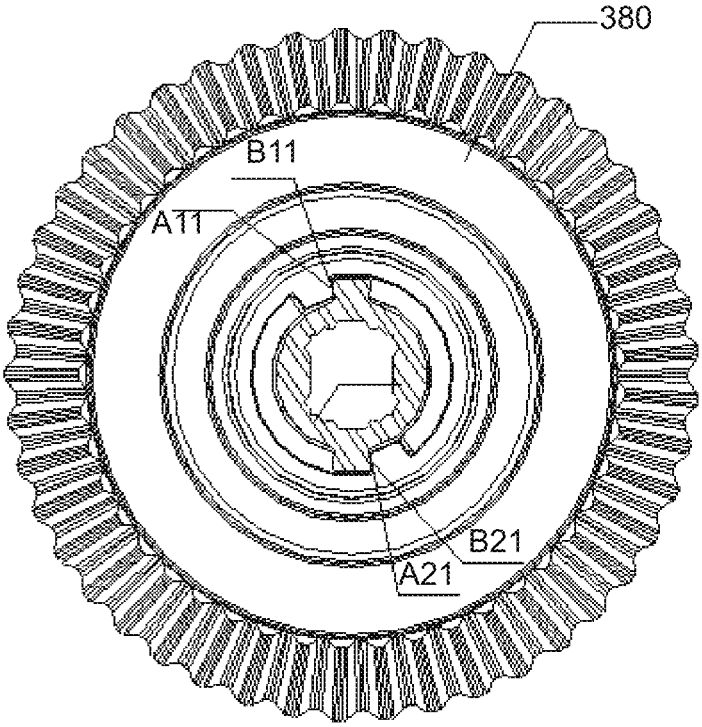

First, in a state as shown in FIG. 15*a*, the driving component 12 may drive the driven bevel gear 380 of a bevel gear engagement mechanism to rotate along the clockwise direction to a locked operation station as shown in FIG. 15*b*, that is, the second abutment operation station. The first circumferential limit portion A11 and the second circumferential limit portion B11 of the first set of clutch adaptation pair, and the first circumferential limit portion A21 and the second circumferential limit portion B21 of the second set of clutch adaptation pair at the locked operation station may be respectively circumferentially abutted and fitted. As the driving component 12 drives the driven bevel gear 380 to continue to rotate clockwise, the lock body transmission member 310 may rotate to a locked state as shown in FIG. 15*c* to complete the lock operation.

Figure 15D:
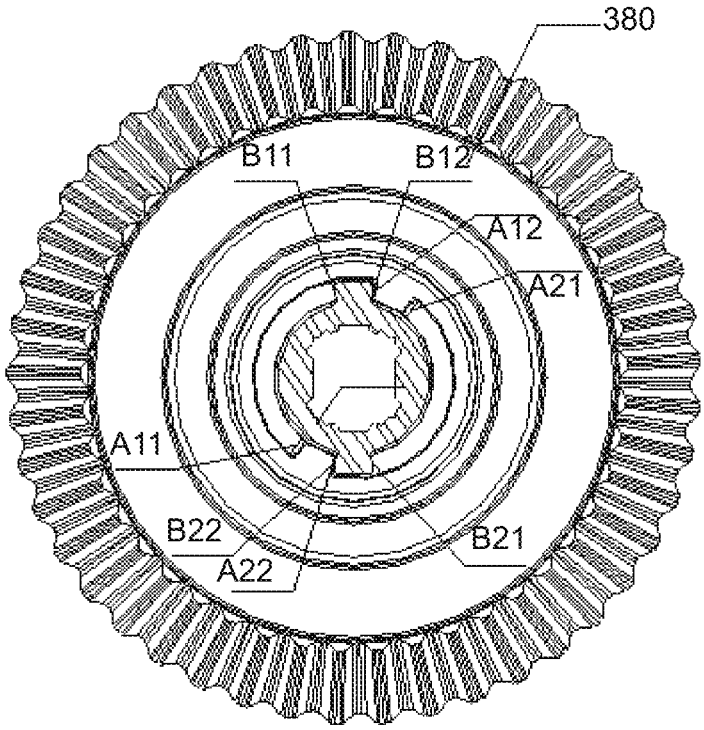

Next, the driving component 12 may drive the driven bevel gear 380 to rotate along the counterclockwise direction to the unlock operation station as shown in FIG. 15*d*, that is, the second abutment operation station. A rotation stroke of the driven bevel gear 380 from the locked operation station to the unlocked operation station may be the predetermined rotation stroke. The first circumferential limit portion A12 and the second circumferential limit portion B12 of the first set of clutch adaptation pair, and the first circumferential limit parts A22 and the second circumferential limit portion B22 of the second set of clutch adaptation pair at the unlocked operation station may be respectively circumferentially abutted and fitted.

Figure 15E:
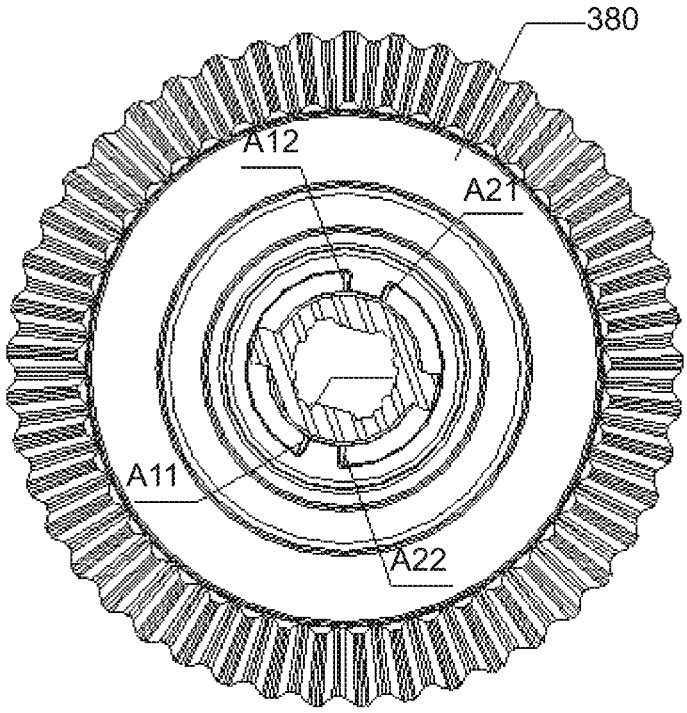

When it is necessary to switch to the manual unlock operation, the manual rotation 21 may be operated to drive the lock body transmission member 310 to rotate counterclockwise to complete the manual unlock operation as shown in FIG. 15*e*. During the manual operation, the lock body transmission member 310 may be gradually separated from the driven bevel gear 380, and no transmission connection may be between the lock body transmission member 310 and the output member. That is, the output shaft of the motor may not be linked. The user may apply a small torque to complete the manual operation, which greatly improves the user experience; and vice versa. When the driving component 12 continues to drive to perform the unlock operation, at the unlocked operation station as shown in FIG. 15*d*, as the driving component 12 drives the driven bevel gear 380 to rotate counterclockwise, the lock body transmission member 310 may be driven to rotate to the unlocked state.

The output member connected to the driving component 12 may be the driven bevel gear 380 of the bevel gear engagement mechanism, so that the driving component 12 and other parts in a transmission upstream of the transmission assembly of the smart lock 130-1 may be disposed along the length direction of the smart lock 130-1 (or a direction perpendicular to the lock body shaft in a mounting state), which further reduces a space occupation of the smart lock 130-1 relative to the thickness direction of the door body. The explanation of the length direction may be found elsewhere in the present disclosure. In some embodiments, the driving component 12 may include a rotation motor, and a gearbox 122 may be connected between the rotation motor and a bevel gear engagement pair in a transmission connection. As shown in the drawings, the gearbox 122 may be fixedly connected to the sealing plate 72 via a gearbox support frame 123.

In some embodiments, the control panel 60 may control the motor to reversely rotate within a predetermined time range after the motor rotates to an operation station to complete the unlock or lock operation. That is, the driven bevel gear 380 may rotate counterclockwise to drive the output member and the lock body transmission member 310 to be within the predetermined rotation stroke between the two abutment operation stations, so that the clutch mechanism is in the operation vacancy. The reverse rotation of the motor may indicate that the motor drives the driven bevel gear 380 to rotate clockwise during the unlock operation, and drives the driven bevel gear 380 to rotate counterclockwise during the lock operation. In some embodiments, an angle by which the motor reversely rotates, that is, the driven bevel gear 380 rotates counterclockwise, may be within a range from 45 degrees to 180 degrees. In some embodiments, the rotation angle of the motor may be within a range from 60 degrees to 145 degrees. In some embodiments, the rotation angle of the motor may be within a range from 90 degrees to 130 degrees. In some embodiments, the predetermined time range may be within a range from 1 second to 30 seconds. In some embodiments, the predetermined time range may be within a range from 1 second to 20 seconds. In some embodiments, the predetermined time range may be within a range from 1 second to 10 seconds. For example, the predetermined time may be 5 seconds. More descriptions regarding the detecting the angle by which the motor reversely rotates may be found elsewhere in the present disclosure, which is not repeated herein.

Figure 16:
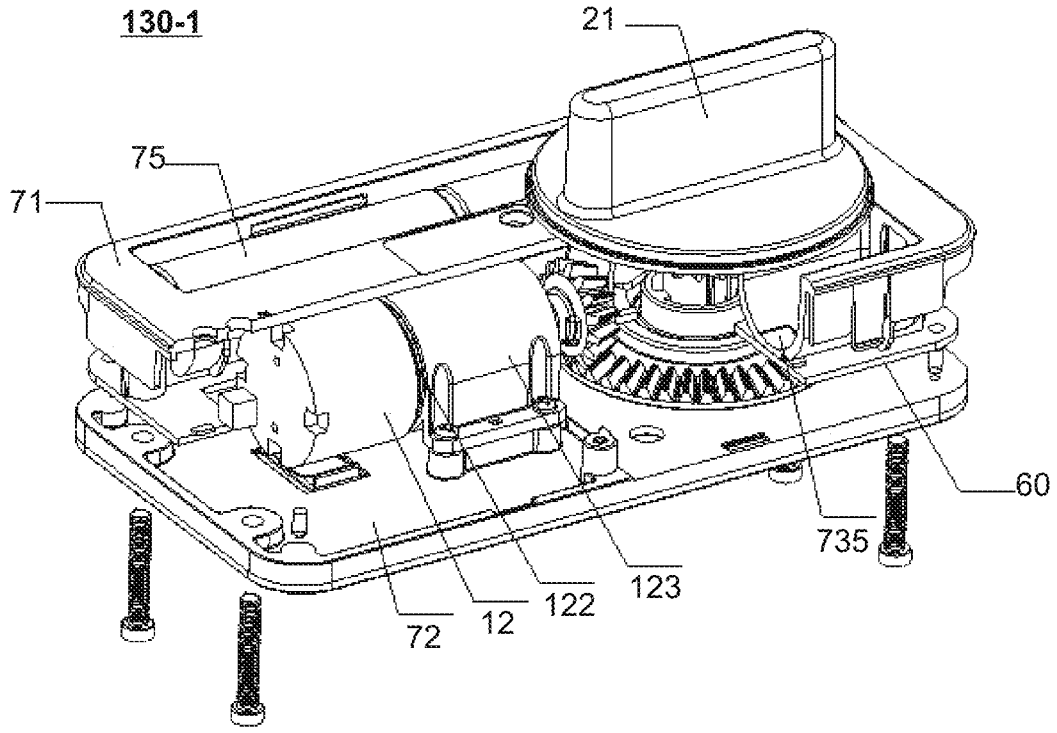
FIG. 16 is a schematic diagram illustrating a whole structure of a smart lock according to some embodiments of the present disclosure.

In some embodiments, in addition to the clutch mechanism and the transmission components of the smart lock 130-1, the embodiment also provides a complete layout scheme of the smart lock 130-1 applying the above embodiments. Referring to FIG. 16, FIG. 16 is a schematic diagram illustrating a whole structure of a smart lock (e.g., the smart lock 130-1) according to some embodiments of the present disclosure. In some embodiments, by assembling the components of the smart lock 130-1 in a reasonable order and disposing mounting positions more finely, the size of the smart lock 130-1 in the thickness direction (or in the axial direction of the lock body in the mounting state) may be reduced, which makes the structure more compact.

In some embodiments, the smart lock 130-1 may include the assembling plate 74 and the sealing plate 72 to form an inner chamber, wherein the transmission assembly 30 and the control panel 60 are both accommodated in the inner chamber. As shown in FIG. 16, the manual knob 21 of the transmission assembly may be located outside the assembling plate 74 so as to manually perform manual operations according to specific needs. The driving component 12 and the manual knob 21 of the driving module 270 may respectively drive, via the lock body transmission member 310 and the lock body connection member 22 (shown in FIG. 4), a lock body shaft (not shown in the drawings) to rotate.

Figure 17:
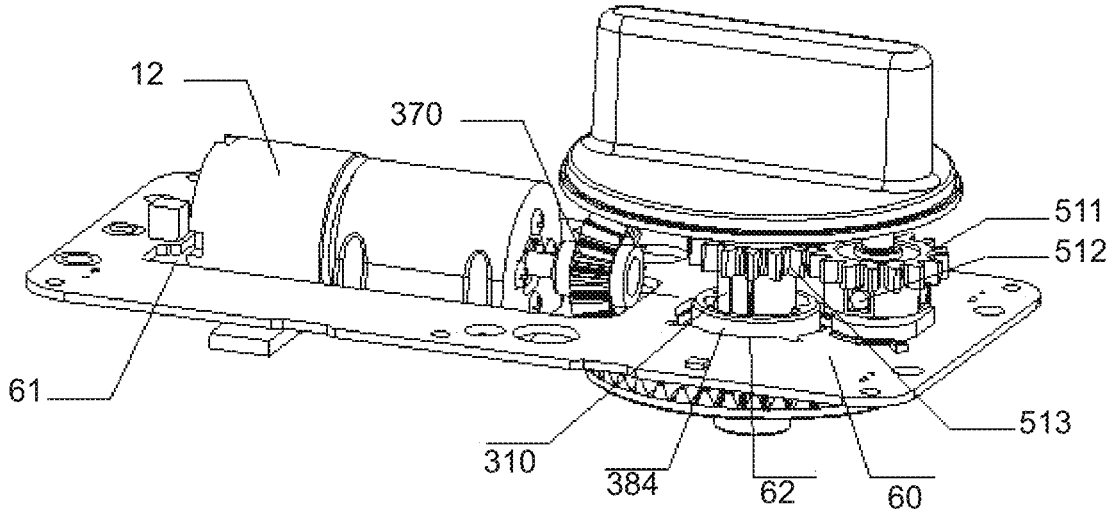
FIG. 17 is a schematic diagram illustrating an internal assembly of a smart lock shown in FIG. 13.

The control panel 60 that is configured to achieve a control function of the whole apparatus may be disposed parallel to the sealing plate 72 and the housing 71. As shown in FIG. 16, the control panel 60 may be substantially disposed in a middle position of the inner chamber, thereby forming a spacing on the space to adapt to a spatial arrangement of the driven bevel gear 380, so that engagement teeth of the driven bevel gear 380 are disposed on a side of the control panel 60 close to the sealing plate 72, and functional requirements of connecting signal components are met. Referring to FIG. 17, FIG. 17 is a schematic diagram illustrating an internal assembly of the control panel 60, the driving module 270 (e.g., the driving component 12), and the mechanical structure 280 (e.g., the transmission assembly 30).

As shown in FIG. 16 and FIG. 17, the control panel 60 may include two wearing openings, that is, a first wearing opening 61 and a second wearing opening 62. The driving component 12 fixed on the sealing plate 72, the driving bevel gear 370 in the bevel gear engagement pair, and transmission members therebetween may extend from the first wearing opening 61 to the inner chamber on the other side of the control panel 60. The "transmission member" may include, for example, but not limited to, the gearbox 122 according to the embodiment. Meanwhile, the lock body transmission member 310 may be in a transmission connection to the driven bevel gear 380 via the second wearing opening 62. In some embodiments, the engagement teeth of the driven bevel gear 380 may be disposed on a side of the control panel 60 close to the sealing plate 72, and extended to a shaft sleeve 384 on the other side (close to the side of the assembling plate 74) of the control panel 60. Therefore, the transmission connection between the lock body transmission member 310 and the shaft sleeve 384 of the driven bevel gear 380 may be realized, which ensures that there is no interference in the assembling of the driving component 12, the output part, and the intermediate transmission member.

For accuracy of the control of the whole apparatus, a rotation angle detection manner may be further added. As shown in FIG. 17, a gear 513 to be detected may be fixedly arranged on the lock body transmission member 310. For example, the gear 513 to be detected and the lock body transmission member 310 may coaxially rotate. Correspondingly, the other side of the control panel 60 close to the lock body transmission member 310 may be disposed with a detection gear 511 adapted to the gear 513 to be detected, and an angle sensor 512 and the detection gear 511 may coaxially rotate to obtain an angle signal and output the obtained angle signal to the control panel 60. Accordingly, an actual rotation angle of the lock body shaft may be detected in real time for feedback adjustment, and the detection transmission chain only involves a pair of gear engagement relationships, which ensures the detection accuracy to a greatest extent. In some embodiments, the angle sensor 512 may also be replaced with other types of sensors, including but not limited to, a gyroscope sensor, a Hall sensor, an infrared sensor, etc. In some embodiments, a mounting position of the angle sensor 512 may also be directly disposed on the lock body transmission member 310, or disposed on other rotation components that are in the transmission connection to the lock body shaft.

In some embodiments, a current position of the lock body shaft may be detected to improve the accuracy of the control of the whole apparatus. The lock body may include a position sensor (e.g., one or more Hall switches). The one or more Hall switches may be disposed different positions along a circumferential direction. When the lock body shaft is moving, the one or more Hall switches may be triggered to determine the current position of the lock body shaft. Accordingly, the current position of the lock body shaft may be detected in real time for feedback adjustment. More descriptions regarding the Hall switches may be found elsewhere in the present disclosure (e.g., FIG. 11 and descriptions thereof).

Figure 18:
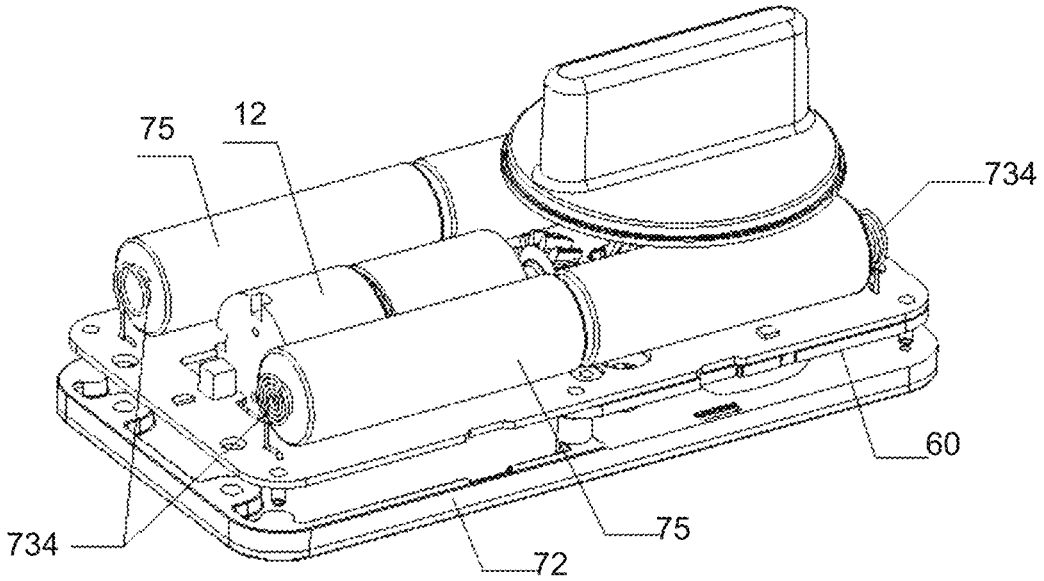
FIG. 18 is a schematic diagram illustrating a battery arrangement relationship of a smart lock shown in FIG. 13.

In addition, in some embodiments, in order to further improve product integration and achieve a better layout of the overall apparatus, a mounting position of the battery compartment assembly 73 may be further optimized. Referring to FIG. 18, FIG. 18 is a schematic diagram illustrating a battery arrangement relationship of a smart lock shown in FIG. 13. In some embodiments, as shown in FIG. 18, a battery compartment 735 configured to accommodate the battery compartment assembly 73 may be embedded on the outer side of the assembling plate 74. Battery contact elastic pieces 734 electrically connected to the control panel 60 may be respectively disposed at end portions of the battery compartment 735. In some embodiments, a count of battery compartments 735 may be two, which are disposed on both sides axisymmetrically with respect to the driving component 12, and the two battery compartments 735 may extend inward to the control panel 60 to effectively utilize the inner chamber on both sides of the driving component 12 in the lock. That is, the space in the width and thickness directions of the housing 71 may be fully utilized. In addition, a structure of the battery compartment 735 may also include an internal strength support structure.

Further, the detection gear 511 may be disposed on an opposite side of the driven bevel gear 380 with respect to the driving bevel gear 370 and disposed between the two battery compartments 735, so that the size of the housing 71 along the length direction is fully used. On the whole, the smart lock according to the present disclosure may have high integration in all dimensions.

In some embodiments, a size of the smart lock along the width direction may be within a range from 40 millimeters to 80 millimeters. In some embodiments, the size of the smart lock along the width direction may be within a range from 50 millimeters to 70 millimeters. In some embodiments, the size of the smart lock along the width direction may be within a range from 63 millimeters to 68 millimeters. For example, the size of the smart lock along the width direction may be 65 millimeters. In some embodiments, a size of the smart lock along the thickness direction may be within a range from 30 millimeters to 70 millimeters. In some embodiments, the size of the smart lock along the thickness direction may be within a range from 33 millimeters to 60 millimeters. In some embodiments, the size of the smart lock along the thickness direction may be within a range from 40 millimeters to 60 millimeters. In some embodiments, the size of the smart lock along the thickness direction may be within a range from 50 millimeters to 55 millimeters. For example, the size of the smart lock along the width direction may be 33.8 millimeters. In some embodiments, a size of the smart lock along the length direction may be within a range from 110 millimeters to 140 millimeters. In some embodiments, the size of the smart lock along the length direction may be within a range from 120 millimeters to 130 millimeters. In some embodiments, the size of the smart lock along the length direction may be within a range from 123 millimeters to 127 millimeters. For example, the size of the smart lock along the length direction may be 125 millimeters.

The mechanical structure 280 of the smart lock 130-1 may further include a housing assembly configured to accommodate and support the transmission assembly 30, the driving component 12, the control panel 60, the battery compartment assembly 73, etc. In some embodiments, the housing assembly may include a housing 71, a sealing plate 72, and an assembling plate 74. The sealing plate 72 may be configured to form an inner accommodation chamber with the housing 71 to accommodate the above parts. The assembling plate 74 may be fixedly connected to the sealing plate 72 and the housing 71. During an actual mounting process, the assembling plate 74 may be mounted to the door body, so that the smart lock 130-1 may be mounted and fixed to the door body. In some embodiments, the assembling of the sealing plate 72 and the assembling plate 74 is an important part of the mounting process of the smart lock 130-1. The sealing plate 72 and the assembling plate 74 are usually directly connected via screws. By connecting the sealing plate 72 and the assembly 74 by adding an intermediate member, the connection may be more secure, and the assembling and disassembling processes may be more convenient.

In some embodiments, the smart lock 130-1 may include the sealing plate 72 and the assembling plate 74. The sealing plate 72 and the assembling plate 74 of the smart lock 130-1 are usually connected and fixed by the fastener 728 (e.g., a screw). For instance, during mounting, the assembling plate 74 is first fixed to the lock body shaft of the door body via bolts; then after the sealing plate 72 is aligned with a connection position of the assembling plate 74, the bottom plate needs to be held by hand to prevent deviation of the position; and finally, the sealing plate 72 and the assembling plate 74 are fixed by the fastener 728. The mounting manner has a low efficiency and requires constant concentration during the mounting. In some embodiments, an intermediate plate 76 may also be disposed between the sealing plate 72 and the assembling plate 74, and the assembling and disassembling of the sealing plate 72 and the assembling plate 74 may be achieved by rotating the intermediate plate 76 between two positions.

Figure 19:
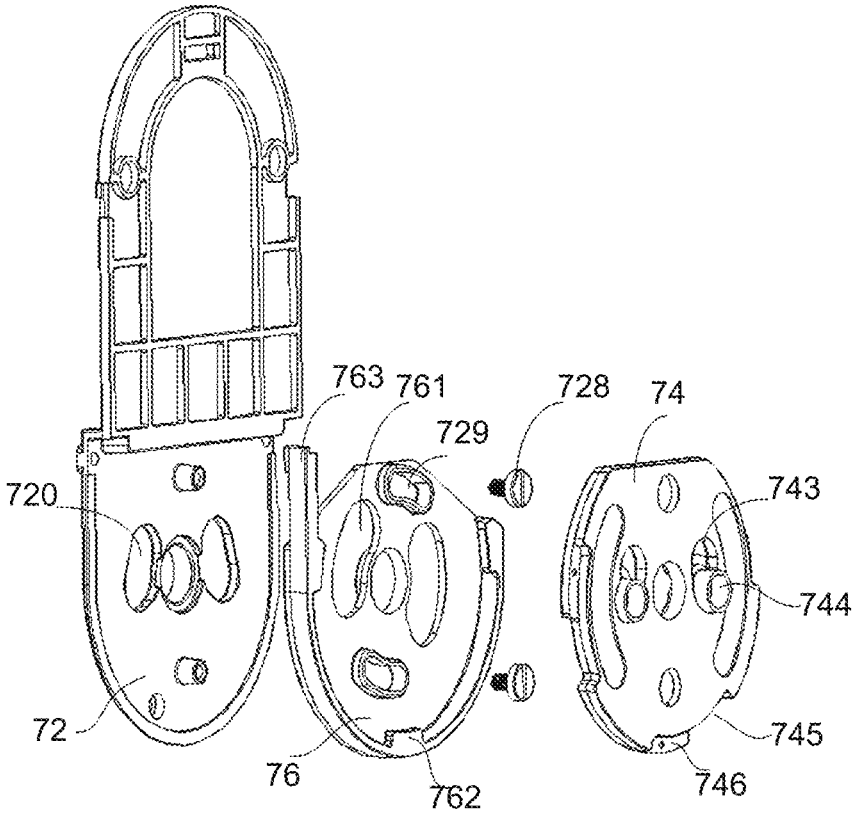
FIG. 19 is an exploded view illustrating a connection structure between a sealing plate and an assembly plate according to some embodiments of the present disclosure.
Figure 20:
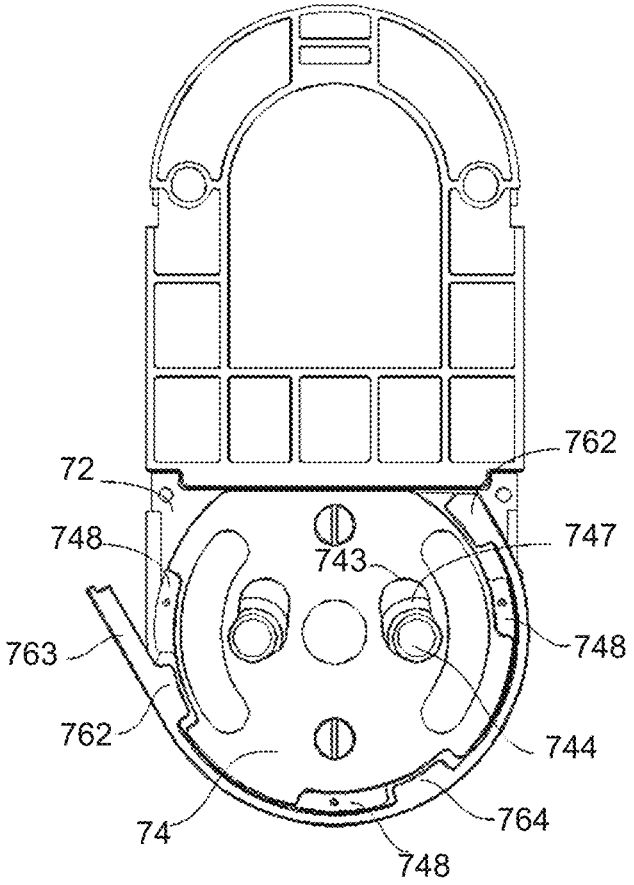
FIG. 20 is a schematic diagram illustrating a structure shown in FIG. 19 when a first clamping member and a second clamping member are in a disengaged state.
Figure 21:
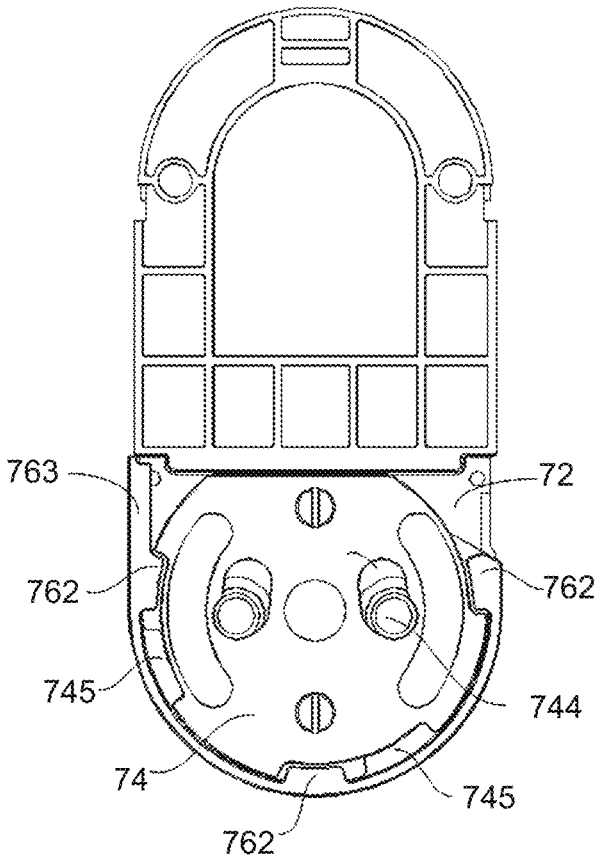
FIG. 21 is a schematic diagram illustrating a structure shown in FIG. 19 when a first clamping member and a second clamping member are in a clamping state.
Figure 22:
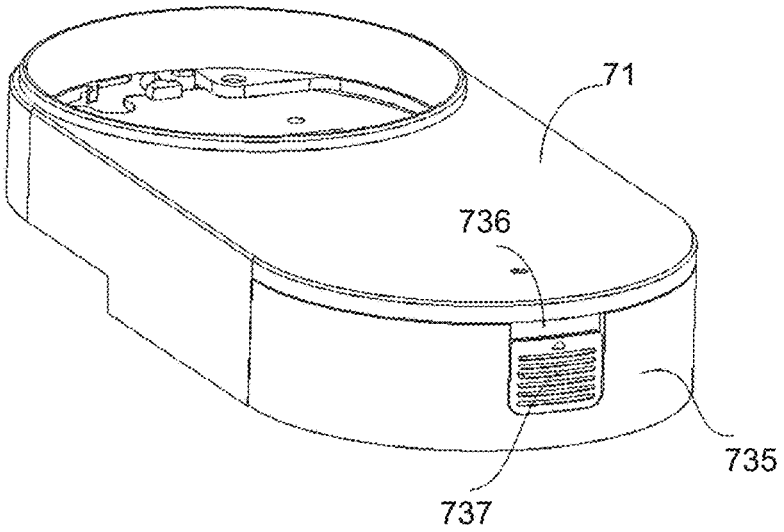
FIG. 22 is a schematic diagram illustrating a structure of a battery compartment assembly of a smart lock in a mounting state according to some embodiments of the present disclosure.
Figure 23:
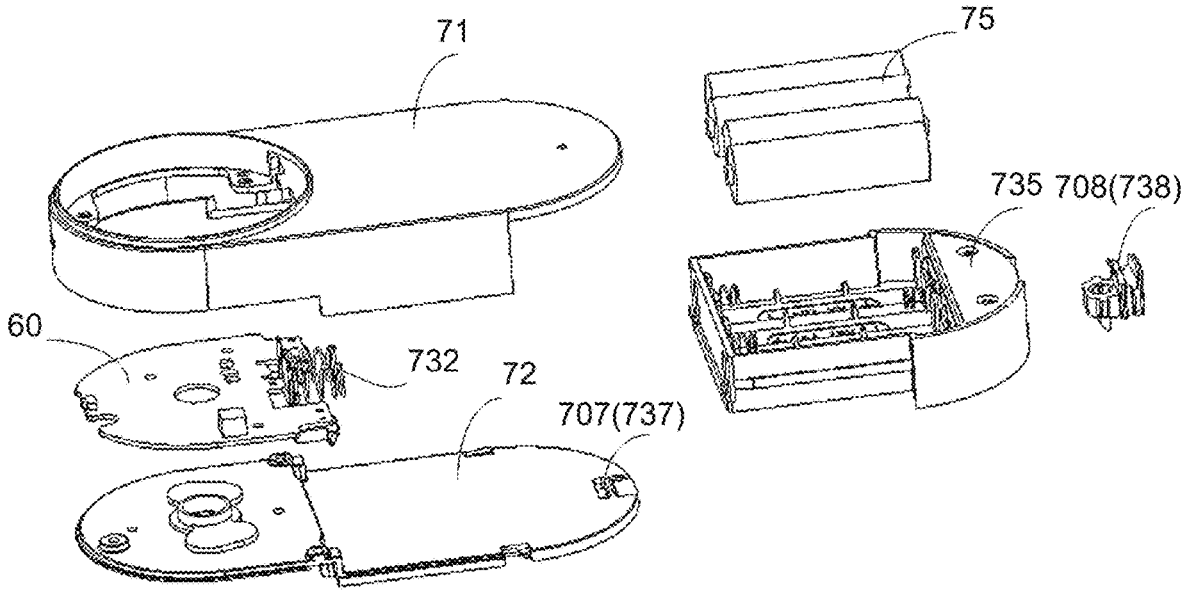
FIG. 23 is an exploded view illustrating a portion of a smart lock shown in FIG. 22.

Referring to FIG. 19 to FIG. 23, FIG. 19 is an exploded view illustrating a connection structure between a sealing plate and an assembly plate according to some embodiments of the present disclosure; FIG. 20 is a schematic diagram illustrating a structure shown in FIG. 19 when a first clamping member and a second clamping member are in a disengaged state; FIG. 21 is a schematic diagram illustrating a structure shown in FIG. 19 when a first clamping member and a second clamping member are in a clamping state; FIG. 22 is a schematic diagram illustrating a structure of a battery compartment assembly of a smart lock in a mounting state according to some embodiments of the present disclosure; and FIG. 23 is an exploded view illustrating a portion of a smart lock shown in FIG. 22.

As shown in FIG. 19 to FIG. 21, in some embodiments, a housing assembly of the smart lock 130-1 may include the sealing plate 72, the intermediate plate 76, and the assembling plate 74 disposed in sequence. The intermediate plate 76 and the sealing plate 72 may be rotatably connected, and an axial limit member may be also disposed between the intermediate plate 76 and the sealing plate 72 to limit an axial position between the sealing plate 72 and the intermediate plate 76, so that the sealing plate 72 and the intermediate plate 76 are only capable of rotating relative to each other, but incapable of separating from each other. In some embodiments, the intermediate plate 76 may include a first clamping member 762, and the assembling plate 74 may be include a second clamping member 746 adapted to the first clamping member 762. When the intermediate plate 76 rotates relative to the sealing plate 72, the first clamping member 762 may be driven to rotate so that the first clamping member 762 is clamped with the second clamping member 746. Therefore, the intermediate plate 76 may be fixed to the assembling plate 74, and thus mounting and fixation of the assembling plate 76 and the sealing plate 72 are achieved. In some embodiments, the first clamping member 762 and the second clamping member 746 may be respectively disposed at edge positions of the intermediate plate 76 and the sealing plate 72.

A process of assembling the assembling plate 76 and the sealing plate 72 may be as follows. The assembling plate 74 may be fixed to the lock body shaft. During the mounting, after the assembling plate 74 is fixed to the lock body shaft by fixing bolts, the sealing plate 72 may be placed at a position for mounting. At this time, the intermediate plate 76 may be pressed against the assembling plate 74, and the intermediate plate 76 may be rotated to an initial position, wherein the initial position refers to a state where the first clamping member 762 and the second clamping member 746 are completely separated as shown in FIG. 20. Then the intermediate plate 76 may be rotated relative to the sealing plate 72 and the assembling plate 74. Rotation of the intermediate plate 76 may drive the first clamping member 762 to rotate until the first clamping member 762 is clamped and fixed to the second clamping member 746 as shown in FIG. 21. In this time, the intermediate plate 76 may be fixed to the sealing plate 72 by the axial limit member, and the intermediate plate 76 may be fixed to the assembling plate 74 by clamping between the first clamping member 762 and the second clamping member 746. Therefore, the assembling plate 74 and the sealing plate 72 may be mounted and fixed. During the mounting and fixing process, the assembling plate 74 and the sealing plate 72 may be fixed without operations such as bolt tightening, etc. The operations may be simple, time-saving, and efficient.

In some embodiments, referring to FIG. 19, the smart lock 130-1 may further include the fastener 728. The intermediate plate 76 may be disposed with the arc-shaped hole 729. A front end (tip) of the fastener 728 may pass through the arc-shaped hole 729, and be fixed to the sealing plate 72. A rear end of the fastener 728 may extend out of the other end of the arc-shaped hole 729. A diameter of the rear end of the fastener 728 may be greater than a width of the arc-shaped hole 729, so that the fastener 728 can slide along the arc-shaped hole 729 and restrict the intermediate plate 76 from being separated from the sealing plate 72 along the axial direction. That is, the fastener 728 may form the axial limit member. In some embodiments, the fastener 728 may include a screw, a bolt, etc., and a form of the fastener 728 is not specifically limited herein. In the embodiment, a count of arc-shaped holes 729 may not be limited. For example, in the embodiment, the count of arc-shaped holes 729 may be set to two, three, four, etc. The count of corresponding fasteners 728 may be the same as the count of arc-shaped holes 729.

In other embodiments, a chute with a C-shaped cross section may be disposed on one of a side surface of the intermediate plate 76 facing the sealing plate 72 and a side surface of the sealing plate 72 facing the intermediate plate 76, and a slide block slidable in the chute may be disposed on the other of the side surface of the intermediate plate 76 facing the sealing plate 72 and the side surface of the sealing plate 72 facing the intermediate plate 76. For example, the chute with the C-shaped cross section may be disposed on the side surface of the intermediate plate 76 facing the sealing plate 72, and the slide block slidable in the chute may be disposed on the side surface of the sealing plate 72 facing the intermediate plate 76. The intermediate plate 76 may also rotate relative to the sealing plate 72, and the slide block may be used as the axial limit member. A difference from the above embodiments may be that the fastener 728 is used as the axial limit member, and the relative rotation between the intermediate plate 76 and the sealing plate 72 is achieved via the arc-shaped hole 729 and the fastener 728, which simplifies the overall structural design, reduces the complexity in machining, and saves the cost.

In some embodiments, for faster and more convenient assembling and disassembling, the intermediate plate 76 may be improved so that the intermediate plate 76 may be rapidly and conveniently clamped with or separated from the assembling plate 74.

In the above embodiment, the intermediate plate 76 may be disposed with an operation portion 763. The operation portion 763 can extend out of an outer side of an edge of the sealing plate 72. When the intermediate plate 76 rotates such that the first clamping member 762 and the second clamping member 746 are clamped, the operation portion 763 may rotate to an inner side of the edge of the sealing plate 72. For instance, before the first clamping member 762 and the second clamping member 746 are completely clamped, the operation portion 763 may be located on the outer side of the edge of the sealing plate 72. That is, in an initial state of the mounting, as shown in FIG. 20, the operation portion 763 can extend out of the edge of the sealing plate 72, and an operator can manually pull the operation portion 763 from the outer side to rotate the intermediate plate 76. When the intermediate plate 76 rotates such that the first clamping member 762 and the second clamping member 746 are clamped, as shown in FIG. 21, since the operation portion 763 is disposed on the inner side of the edge of the sealing plate 72 and is blocked by the sealing plate 72, the operation portion 763 may be prevented from being manually pulled from the outer side, so that mis-operations such as accidental touches are effectively avoided.

In some embodiments, one of the first clamping member 762 and the second clamping member 746 may be a clamping groove, and the other of the first clamping member 762 and the second clamping member 746 may be a clamping plate 748 adapted to the clamping groove. For example, the first clamping member 762 may be a clamping groove, and the second clamping member 746 may be a clamping plate 748 adapted to the clamping groove. When the intermediate plate 76 rotates, the first clamping member 762 may be driven to rotate until the clamping plate 748 is located in the clamping groove. A structure of the clamping groove is not limited in the present disclosure. In some embodiments, the clamping groove may be such configured that a depth direction of the clamping groove is perpendicular to an axial direction of the intermediate plate 76, and the axial direction of the intermediate plate 76 may be understood as a direction perpendicular to a plane where the intermediate plate 76 is located. After the clamping plate 748 enters the clamping groove from an end portion, a side wall of the clamping groove can act on the clamping plate 748 to restrict the clamping plate 748 from separating from the clamping groove. Alternatively, the clamping groove may be such configured that a depth direction of the clamping groove is parallel to the axial direction of the intermediate plate 76. At this time, the clamping groove may be set to a structure with a C-shaped cross section. A width of an opening of the clamping groove may less than a thickness of the clamping plate 748, so that the clamping plate 748 is restricted in the clamping groove after the clamping plate 748 enters the clamping groove from the end portion of the clamping groove along a circumferential direction.

In the embodiment, when the clamping groove is such configured that the depth direction of the clamping groove is perpendicular to the axial direction of the intermediate plate 76, the following two cases may be present.

A first case may be referred to FIG. 19 to FIG. 21. In some embodiments, the first clamping member 762 is a clamping groove, the second clamping member 746 is the clamping plate 748, and a flange 764 may be inward disposed on a side of the intermediate plate 76 facing the assembling plate 74. The flange 764 and a surface of the intermediate plate 76 may form the clamping groove. And a notch 745 adapted to the clamping groove may be disposed on an edge of the assembling plate 74. An edge of the notch 745 may form the clamping plate 748. The inward flange 764 refers to the flange 764 disposed radially inward along the side of the assembling plate 74 facing the intermediate plate 76, which simplifies structures of the intermediate plate 76 and the assembling plate 74 and optimizes the manufacturing process.

A second case is that when the first clamping member 762 is the clamping plate 748, and the second clamping member 746 is the clamping groove, and the flange 764 is disposed inward on the side of the assembling plate 74 facing the intermediate plate 76. The clamping groove may be formed on the flange 764 and a surface of the assembling plate 74. In addition, the edge of the intermediate plate 76 may be disposed with the notch 745 adapted to the clamping groove. The edge of the notch 745 may form the clamping plate 748.

During the mounting, when the intermediate plate 76 is rotated to the initial position, the clamping groove may be just at the notch 745, and then the intermediate plate 76 may be rotated so that the edge of the notch 745 (the plate 748) enters the clamping groove from the end portion of the clamping groove.

In some embodiments, a count of clamping members 762 and a count of second clamping members 746 has a certain influence on a connection stability of the intermediate plate 76 and the assembling plate 74.

In some embodiments, the count of first clamping members 762 may be the same as the count of second clamping members 746, and at least two first clamping members 762 and at least two second clamping members 746 may be disposed at intervals along a circumferential direction of the intermediate plate 76. As shown in FIG. 20 and FIG. 21, in some embodiments, three first clamping members 762 and three second clamping members 746 may be respectively disposed, so as to fix the intermediate plate 76 and the assembling plate 74 from three different positions along the circumferential direction. Therefore, the connection between the intermediate plate 76 and the assembling plate 74 may be more stable. In some embodiments, when the count of first clamping members 762 is greater than two, the first clamping members 762 may be uniformly distributed or may be non-uniformly distributed with respect to the circumference of the intermediate plate 76. In some embodiments, the count of second clamping members 746 may be the same as the count of first clamping members 762, and arrangement positions of the second clamping members 746 relative to the assembling plate 74 may correspond to arrangement positions of the first clamping members 762 relative to the intermediate plate 76. Therefore, in the mounting state, the first clamping members 762 may be clamped with the second clamping members 746. In some embodiments, the count of first clamping members 762 may be one.

In some embodiments, different door bodies may have different lock body structures, including lock body shafts and bolts of different types, shapes, and materials. Therefore, in order to improve the applicability of the smart lock 130-1, members adapted to different lock body shafts may be additionally disposed on the assembling plate 74, so that the smart lock 130-1 is applied to more types of lock body shafts. In some embodiments, As shown in FIG. 19, the assembling plate 74 may be disposed with two fixing holes 743, and may be fixed to the lock body shaft by fixing bolts passing through the fixing holes 743. The fixing bolts may be movable in the fixing holes 743 to change a distance between the two fixing bolts. Since there are many types of old smart locks and mounting processes thereof are different, the assembling plate 74 of the smart lock 130-1 may be adapted to more locks by setting a distance between the two fixing bolts of the assembling plate 74 to be adjustable, which improves the adaptability of the assembling plate 74 without damaging or replacing the old lock body shaft.

Further, in some embodiments, the fixing hole 743 may be disposed with a fixing sleeve 744 slidable along the fixing hole 743. The fixing sleeve 744 may extend out of the fixing hole 743 towards one end of the sealing plate 72, and may be radially outward disposed with an extension edge 747. The extension edge 747 may be abutted an edge of the fixing hole 743. That is, a diameter of the extension side 747 may be greater than a width of the fixing hole 743 to prevent the fixing sleeve 744 from separating from the fixing hole 743. During the mounting, a fixing bolt may pass through the fixing sleeve 744, and a rear end (an end away from the tip) of the fixing bolt may be abutted the extension edge 747 of the fixing sleeve 744. The extension edge 747 may be abutted the edge of the fixing hole 743, so that a forced region of the edge of the fixing hole 743 is increased to avoid a situation that the edge of the fixing hole 743 is deformed, etc., due to a large tightening force of the fixing bolt.

In some embodiments, the sealing plate 72 may be disposed with a reserved groove 720 corresponding to the fixing hole 743, and the intermediate plate 76 may be disposed with a reserved hole 761 corresponding to the fixing hole 743. For instance, the assembling plate 74 may be fixed to the lock body shaft by a fixing bolt passing through the fixing hole 743. The configuration of the reserved hole 761 and the reserved groove 720 may provide a sufficient mounting space for the rear end of the fixing bolt, and may prevent the rear end of the fixing bolt from interfering with the intermediate plate 76 or the sealing plate 72 while ensuring a small overall volume. The interference may be understood as collision or friction between the parts. For example, friction between the rear end of the fixing bolt and the intermediate plate 76 or the sealing plate 72 may reduce the service life of these parts.

In some embodiments, as shown in FIG. 22 and FIG. 23, the smart lock 130-1 may further include a battery compartment assembly 73 (as shown in FIG. 4) and the housing 71. The battery compartment assembly 73 may include a battery 75 and a battery compartment 735 configured to accommodate the battery. The housing 71 may be disposed on a side of the sealing plate 72 away from the assembling plate 74, and a mounting chamber configured to accommodate the battery compartment 735 may be formed between the housing 71 and the sealing plate 72. An opening end of the mounting chamber may be disposed with a first buckle 737. An inner wall of the mounting chamber opposite to the opening end may be disposed with an elastic member 732. The smart lock 130-1 may also include a second buckle 738. When the battery compartment 735 is disposed in the mounting chamber and the first buckle 737 and the second buckle 738 are in a buckled state, the battery compartment 735 can tightly compress the elastic member 732. When the first buckle 737 and the second buckle 738 are separated, the elastic member 732 in the compressed state can act on the battery compartment 735, so that the battery compartment 735 is ejected out of the mounting chamber. With the configuration, the battery compartment 735 does not need to be disposed with a rear cover, which facilitates the replacement of the battery 75. The present disclosure does not limit the structure of the mounting chamber. For instance, the mounting chamber may be an independent chamber. For example, the sealing plate 72 or the panel may be disposed with a baffle. The baffle may form an inner wall of the mounting chamber away from the opening. The elastic member 732 may be disposed on the baffle. Alternatively, the control panel 60 and a transmission assembly may be also disposed between the sealing plate 72 and the housing 71, and the elastic member 732 may be fixedly disposed on the transmission assembly.

Further, in some embodiments, the first buckle 737 may include an insertion hole or an insertion groove 707, and the second buckle 738 may include an insertion plug 708 adapted to the insertion hole or the insertion groove 707. Alternatively, the first buckle 737 and the second buckle 738 may be configured as protrusions and buckle rings. When the battery compartment 735 is placed in the mounting chamber, the buckle ring may be fastened to the protrusion, so that the battery compartment 735 is prevented from moving away from the elastic member 732. The structure of the insertion plug 708 and the insertion hole or the insertion groove 707 may be buckled and separated only by pushing and pulling the insertion plug 708, thereby simplifying the mounting operations.

Furthermore, in some embodiments, a slideway 736 may be disposed at an end of the battery compartment 735 away from the elastic member 732, and the insertion plug 708 may be slidable along the slideway 736 to achieve the engagement and disengagement between the insertion plug 708 and the insertion hole or the insertion groove 707. In the embodiment, the insertion hole or the insertion groove 707 may be disposed on the sealing plate 72 (a bottom wall of the mounting chamber) or the housing 71 (a top wall of the mounting chamber), which is not limited herein. Alternatively, in the embodiment, an insertion hole may be disposed on one of the sealing plate 72 and the housing 71, and the insertion hole or the insertion groove 707 may be disposed on the other of the sealing plate 72 and the housing 71. For example, the sealing plate 72 may be disposed with an insertion hole, the housing 71 may be disposed with the insertion groove 707 or the sealing plate 72 may be disposed with the insertion groove 707, and the housing 71 may be disposed with an insertion hole. Two ends of the insertion plug 708 may act on the sealing plate 72 and the casing 71, respectively, and a middle portion of the insertion plug 708 may limit the battery compartment 735. The configuration that the battery compartment 735 is disposed with the slideway 736 and the insertion plug 708 slides along the slideway 736 may simplify the overall structure. In addition, the insertion plug 708 may be integrally molded with the battery compartment 735 to prevent the insertion plug 708 from being lost during the replacement of the battery 75.

The mechanical structure 280 of the smart lock 130-1 may further include a housing assembly configured to accommodate and support the transmission assembly 30, the driving component 12, the control panel 60, the battery compartment assembly 73, etc. At least one of the transmission assembly 30, the battery compartment assembly 73, and the driving component 12 may further include a plurality of parts. In some embodiments, during the assembling process of the smart lock 130-1, the various parts need to be assembled and fixed one by one in order, which is laborious and time-consuming.

In some embodiments, several parts of the smart lock 130-1 may be integrated into several modules, so that the assembling of the smart lock 130-1 is more systematic and modular. During the assembling, the modules only need to be assembled in order, which realizes modularized assembling, and further effectively improves the assembling efficiency. Integrating the parts into several modules may be understood as grouping the parts. Each group may correspond to a module, and parts on each module may be considered as an entirety. After assembling the several entireties, the assembling of the smart lock 130-1 may be completed. During the actual operation process, the parts on the several modules may be connected and fixed in advance, and the operator may directly assemble the several modules. In some embodiments, parts belonging to a same module may also be assembled first, and then the modules may be assembled. The same operations may be applied during the disassembling. The modules may be disassembled first, and then the parts on the modules may be disassembled or replaced. In some embodiments, all the parts of the smart lock 130-1 may be modularized. The smart lock 130-1 may be integrated into a plurality of modules such as two modules, three modules, four modules, five modules, etc. Merely by way of example, the smart lock 130-1 may be integrated into four modules in the present disclosure. In other embodiments, some parts of the smart lock 130-1 may also be modularized. For example, the transmission assembly and the driving component may be integrated into one module, and remaining parts may not be integrated.

When the smart lock 130-1 is integrated into four modules, as an example, discrete parts in the smart lock 130-1 may be integrated to four modules, including the sealing plate assembly, the battery compartment assembly 73, the housing 71, and the manual knob 21.

Figure 24:
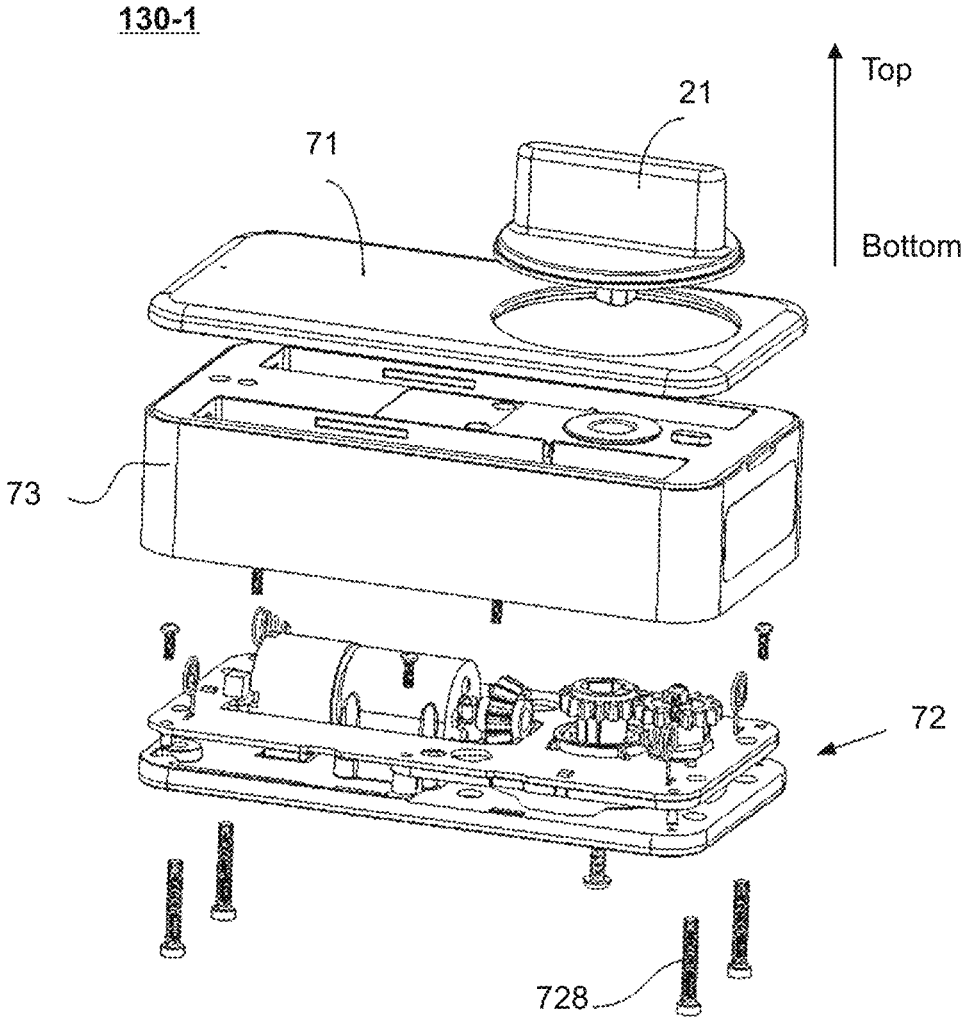
FIG. 24 is a schematic diagram illustrating a structure of a smart lock according to some embodiments of the present disclosure.
Figure 25:
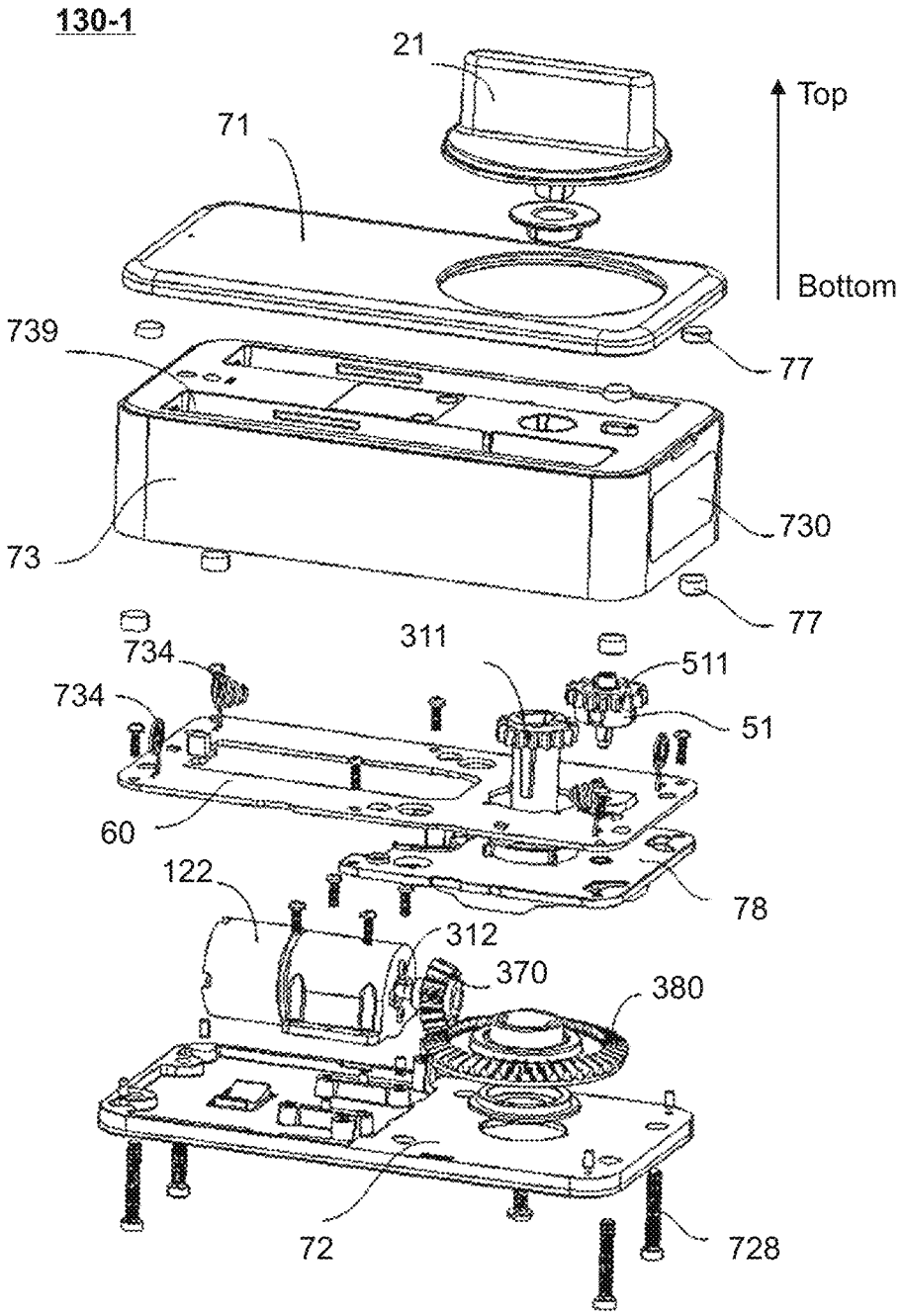
FIG. 25 is an exploded view illustrating a smart lock shown in FIG. 24.

In view of the problem of rapid assembling of the smart lock 130-1 with a complicated structure, another embodiment of the present disclosure provides a smart lock 130-1 that may be rapidly assembled. Referring to FIG. 24 and FIG. 25, FIG. 24 is a schematic diagram illustrating a structure of a smart lock according to some embodiments of the present disclosure; and FIG. 25 is an exploded view illustrating a smart lock shown in FIG. 24. In some embodiments, as shown in FIG. 24, the smart lock 130-1 may include a sealing plate assembly, the battery compartment assembly 73, the housing 71, and the manual knob 21 that are sequentially disposed from bottom to top (referring to a direction shown in FIG. 24). The sealing plate assembly may be integrated with the control panel 60, the sealing plate 72, and the gearbox 122 and a transmission assembly fixedly disposed on the sealing plate 72. In some embodiments, discrete parts in the smart lock 130-1 may be integrated onto the four modules, including the sealing plate assembly, the battery compartment assembly 73, the housing 71, and the manual knob 21. During the assembling, the sealing plate 72, the battery compartment assembly 73, the manual knob 21, and the housing 71 may be mounted in sequence. The assembling of the smart lock 130-1 employs a design technique of overlapping the parts, which simplifies the assembling operations of the smart lock 130-1, and effectively improves the assembling efficiency.

In some embodiments, As shown in FIG. 25, the smart lock 130-1 may further include the control panel 60 disposed parallel with the sealing plate 72, and a portion (e.g., the driven bevel gear 380) of structures of the gearbox 122 and the transmission assembly 30 may be fixedly disposed on the sealing plate 72. The control panel 60 may be disposed above the sealing plate 72, and the portion of the structures of the gearbox 122 and the transmission assembly 30 may pass through the control panel 60 respectively. The gearbox 122 may be integrated with a driving component (e.g., a motor) and a reduction stage (e.g., the gear reduction mechanism shown in FIG. 6) in a transmission connection to an output shaft of the driving component.

In some embodiments, the transmission assembly may include a driving member and a driven member that is in the transmission connection to the driving member. The driving member may be in the transmission connection to a rotation output portion 312 of the gearbox 122, and the driven member may be connected to the lock body shaft, so that rotation of the gearbox 122 drives, via the transmission assembly, the lock body shaft to rotate, thereby unlocking or locking the smart lock. Rotation axes of the driving member and the rotation output portion 312 may be parallel or overlapped with each other. In some embodiments, the driving member and/or the driven member may include gears, and may also include other elements that can achieve a rotation transmission. When the driving member and/or the driven member include the gears, the gears may include straight gears, bevel gears, or the like, or any combination thereof. That is, in one or more embodiments of the present disclosure, the driving member may be a driving gear, and the driven member may be a driven gear or the output gear 311. The driving gear may be the driving bevel gear 370.

For instance, referring to FIG. 25, the transmission assembly may include a driving bevel gear 370 (referred to as the driving member) and the output gear 311 (referred to as the driven member) that are in the transmission connection. One end of the driving bevel gear 370 may be in the transmission connection to the output portion 312 of the gearbox 122, and the other end of the driving bevel gear 370 may be connected to the output gear 311. The output gear 311 may be in the transmission connection to the lock body shaft of the smart lock 130-1. The gearbox 122 may drive, via the transmission assembly 30 (shown in FIG. 4), the lock body shaft to rotate to unlock or lock the lock body structure. In some embodiments, the output portion 312 of the gearbox 122 may be considered as the output shaft 124 of the driving component 12.

The housing 71 may cover a battery groove 739 of the battery compartment assembly 73. The manual knob 21 may pass through the housing 71 and the battery compartment assembly 73, and be in a coaxial transmission with the output gear 311. That is, the lock body shaft may be rotated by the rotation of the gearbox 122 and the rotation of the manual knob 21, which achieve the unlocking or locking of the lock body structure.

In some embodiments, integrating a plurality of parts into a plurality of modules may optimize the layout of the smart lock 130-1, improve the assembling efficiency, and protect the parts. For instance, a motor may be integrated into the gearbox 122 according to the embodiment. According to the embodiment, the motor and a plurality of transmission gears may be integrated into the gearbox 122. First, a structure of the sealing plate 72 may be simplified, and the motor and the plurality of transmission gears may not be exposed, so that multi-stage gear transmission is projected, and interference (e.g., collision, friction, etc.) with external parts is prevented. The configuration of the gearbox 122 may also separate the motor and transmission gears with the external environment, which reduces noise generated when the internal motor rotates and the transmission gears are engaged and transmitted, thereby achieving noise reduction. In addition, the control panel 60 may be disposed above the sealing plate 72, and the gearbox 122 and the transmission assembly may pass through the control panel 60 respectively, so that the overall structure of the sealing plate assembly 1 is compact, and a height of the sealing plate 72 is reduced, thereby causing the overall structure of the smart lock 130-1 more compact. Therefore, integration of the plurality of parts may cause the smart lock 130-1 more systematic, which simplifies the structure of the smart lock 130-1, reduces the noise, and prolongs the service life.

In some embodiments, the sealing plate 72 and the battery compartment assembly 73 may be fixedly connected through a screw connection, a bonding connection, a welding connection, etc. In some embodiments, the sealing plate 72 and the battery compartment assembly 73 may be connected by the fastener 728. In some embodiments, the battery compartment assembly 73 and the housing 71 may be detachably connected, for example, through a magnetic connection, a plug connection, etc. In some embodiments, the battery compartment assembly 73 and the housing 71 may be fixed by a magnetic connection member 77. After assembling the smart lock 130-1, the sealing plate 72 and the battery compartment assembly 73 do not need to be disassembled frequently. Therefore, the sealing plate 72 and the battery compartment assembly 73 may be fixed by the fastener 728, and the connection may be relatively stable. For instance, the sealing plate 72 and the control panel 60 may be disposed with mounting holes for the fastener 728 to pass through. The fastener 728 may pass through the control panel 60 upward from the bottom of the sealing plate 72 and be fixedly connected to the battery compartment assembly 73, thereby achieving the assembling between the sealing plate 72 and the battery compartment assembly 73, and hence the assembling or disassembling is convenient. The battery compartment assembly 73 and the housing 71 may be fixed by the magnetic connection member 77, which facilitates the replacement of the battery in the battery compartment assembly 73 and facilitates subsequent use.

Further, in some embodiments, the battery compartment assembly 73 and the housing 71 may be respectively bonded with the magnetic connection member 77. Alternatively, during fabrication of the battery compartment assembly 73 and the housing 71, the magnetic connection member 77 may be buried in an upper portion of the battery compartment assembly 73 and an inside of the housing 71. The adhesive fixation may simplify the manufacturing process, reduce the cost, and cause the mounting more convenient.

In some embodiments, a power connection of the battery may be achieved in other manners in addition to a connection wire. In some embodiments, the battery compartment assembly 73 may further include a battery contact elastic piece 734. One end of the battery contact elastic piece 734 may be welded and fixed to the control panel 60, and the other end of the battery contact elastic piece 734 may be inserted into the battery compartment assembly 73 and connected to the battery in the battery compartment assembly 73. When the battery contact elastic piece 734 is inserted into the battery compartment assembly 73, the battery in the battery compartment assembly 73 may supply power to the control panel 60 via the battery contact elastic piece 734. That is, the battery in the battery compartment assembly 73 may supply power to the control panel 60 via the battery contact elastic piece 734, and then the control panel 60 may distribute the power to the parts that need power, such as the motor, the first detection assembly 51, etc. In the embodiment, the power transmission of the battery is achieved by the battery contact elastic piece 734. Compared with the power transmission achieved by the connection wire, the internal structure of the panel is simplified and the internal structure is more regular. For instance, one end of the battery contact elastic piece 734 may be welded and fixed to the control panel 60. When the battery compartment assembly 73 is mounted above the sealing plate 72 during the assembling, the other end of the battery contact elastic piece 734 may just be inserted into the battery compartment assembly 73 and achieve a circuit transmission between the battery and the control panel 60, so that the mounting is more convenient.

In some embodiments, the transmission assembly 30 may further include an intermediate transmission member disposed between the driving member and the driven member. One end of the intermediate transmission member may be in the transmission connection to the driving member, and the other end of the intermediate transmission member may be in the transmission connection to the driven member. In some embodiments, the intermediate transmission member may include gears, and may also be other parts or members that can achieve the rotation transmission connection. In some embodiments, under the action of the intermediate transmission member, rotation axes of the driving member and the driven member may be parallel or non-parallel. For example, the rotation axes of the driving member and the driven member may be perpendicular to each other. In some embodiments, the intermediate transmission member may also be referred to as an intermediate gear, including a straight gear or a bevel gear (e.g., the driven bevel gear 380 as shown in FIG. 25).

For instance, referring to FIG. 25, in some embodiments, the transmission assembly may further include the driven bevel gear 380. The driven bevel gear 380 may be in the coaxial transmission with the output gear 311 and engaged with the driving bevel gear 370. An axis of the bevel gear 380 may be perpendicular to an axis of the driving bevel gear 370. That is, a rotation axis of the output portion 312 of the gearbox 122 may be disposed perpendicular to the axis of the output gear 311. Since the output portion of the gearbox 122 is in a rotation motion, the output portion may be referred to as a rotation output portion. In some embodiments, the axis of the output portion 312 may also be configured to be parallel to the axis of the output gear 311. Compared with the configuration that the axis of the output portion 312 is parallel to the axis of the output gear 311, the configuration that the axis of the output portion 312 is perpendicular to the axis of the output gear 311 may cause the internal structure of the sealing plate 72 more compact, so that a height (a top-to-bottom direction as indicated by the arrow in FIG. 25) of the panel is effectively reduced, and an outline size of the panel of the smart lock is reduced. For instance, as shown in FIG. 25, the driven bevel gear 380 is a disc gear that is in the coaxial transmission with the output gear 311, and the axis of the driven bevel gear 380 is perpendicular to the rotation axis of the output portion 312. Alternatively, two or more driven bevel gears 380 may be disposed, which is not limited herein.

In some embodiments, a bracket 78 may be also integrated on the sealing plate assembly. The bracket 78 may be disposed between the control panel 60 and the sealing plate 72 to support the control panel 60 and the transmission assembly, which ensures that the control panel 60 and the sealing plate 72 are stably connected. In addition, a stability of the engagement transmission between the transmission gears of the transmission assembly may also be ensured, and deflection which affects the transmission may be prevented. In the embodiment, the structure of the bracket 78 may not be limited, and the structure may be designed according to a specific structure between the control panel 60 and the sealing plate 72 and situations of the parts.

In some embodiments, the smart lock 130-1 may further include the first detection assembly 51 configured to detect a state of the smart lock. For instance, the first detection assembly 51 may also be integrated on the sealing plate 72. The first detection assembly 51 may include a position sensor (e.g., the angle sensor 512 as shown in FIG. 17) and the detection gear 511 engaged with the output gear 311. The position sensor may be configured to detect a rotation angle of the detection gear 511, so as to determine a position of the lock body shaft to obtain current state information of the smart lock 130-1, and send the state information to the control panel 60. The control panel 60 may perform subsequent operations based on the current state information. For example, the control panel 60 may send the state information to a user terminal to inform a user of the current state of the smart lock 130-1. In some embodiments, the first detection assembly 51 may be integrated on the sealing plate 72 to simplify the internal structure of the smart lock 130-1 and facilitate the assembling operations. In some other embodiments, the first detection assembly 51 may also be configured to directly detect the rotation angle of the output gear 311 without configuration of the detection gear 511. The first detection assembly 51 may detect the rotation angle of the detection gear 511 to facilitate a position arrangement of the first detection assembly 51. In addition, by configuration of a transmission ratio of the output gear 311 and the detection gear 511, the first detection assembly 51 can accurately detect the rotation angle of the output gear 311 engaged with the detection gear 511, thereby obtaining the position of the lock body shaft.

In some embodiments, for a long battery life, one or more parts of the smart lock 130-1 may support a dormant state, that is, a low power consumption state, and may be waken up when a smart lock operation is required. In some embodiments, the first detection assembly 51 may further include a wake-up unit. In response to detecting that the detection gear 511 acts, the wake-up unit may be triggered to send a wake-up signal to the position sensor. The position sensor may be in the dormant state until receiving the wake-up signal from the wake-up unit. For instance, under normal conditions, the position sensor in the first detection assembly 51 may be in the dormant state to reduce a power consumption and maintain continuous operation. When the lock body shaft rotates, the output gear 311 may rotate accordingly. The output gear 311 and the detection gear 511 may trigger the wake-up unit to send the wake-up signal to the position sensor to wake up the position sensor, so that the first detection assembly 51 detects the rotation angle of the detection gear 511 to obtain the current state information of the smart lock 130-1.

Further, in some embodiments, the wake-up unit may include a detection element and a component paired with the detection element. In some embodiments, the wake-up unit may include a Hall sensor and a magnetic member. The magnetic member may be fixedly disposed on the detection gear 511 or the output gear 311. The Hall sensor and the position sensor may be both fixedly disposed on the control panel 60 (e.g., the fixation may be implemented by welding, etc., which is not limited herein). When the lock body shaft rotates, the output gear 311 or the detection gear 511 may be driven to move, so that the magnetic member rotates relative to the Hall sensor. At this time, the Hall sensor may be triggered to send the wake-up signal to the position sensor to wake up the position sensor. In some embodiments, the magnetic member may be in a block, a sheet structure, a magnetic ring, etc. Alternatively, in the embodiment, the wake-up unit may also be configured as an infrared code disc, etc., which is not limited herein.

In some embodiments, the control panel 60 may also include an antenna configured to achieve a signal connection with an external controller (e.g., a mobile phone, a remote control, etc.). The battery compartment assembly 73 may include a metal housing. A position corresponding to the antenna on a side wall of the housing may be also disposed with a window 730. The window 730 may be blocked by a plastic member.

In some embodiments, the housing of the battery compartment assembly 73 may be made of a metal material, which ensures an overall mechanical strength of the battery compartment assembly 73. The window 730 may facilitate the signal connection between the internal antenna and the external controller to avoid signal shielding. The window 730 may be blocked by the plastic member to prevent dust from entering the interior and ensure the interior clean. For instance, a shape of the window 730 may not be limited. The position of the window 730 may be defined according to the position of the antenna. A manner of fixing the plastic member and the window 730 may not be limited. For example, the plastic member and the window 730 may be adhered or clamped.

In some embodiments, the present disclosure also relates to an improvement to the detection module 210. The detection module 210 may be configured to obtain identity confirmation information of a user, obtain a movement position of the driving module 270 in the smart security device 130, and obtain current state information of the smart security device 130. In some embodiments, the detection module 210 may be applicable to a plurality of scenarios, for example, detecting a state of a smart lock (a state of a bolt), detecting a state of a door body, detecting a retracted position of a motor, detecting a motion of the smart lock, etc. Correspondingly, in some embodiments, the detection module 210 may include the first detection assembly 51 and the control panel 60 connected to the first detection assembly 51, and be configured to detect a current position of a lock body shaft, and then determine the state of the smart lock of the lock body structure. In some embodiments, the detection module 210 may further include the second detection assembly 52 and the control panel 60 connected to the second detection assembly 52, and be configured to detect the retracted position of the motor, for example, detecting a reverse rotation angle of the first abutment member.

In some embodiments, detecting the state of the smart lock may refer to detecting whether the bolt is in a locked position or in an unlocked position. In some embodiments, detecting the state of the door body may refer to detecting whether the door body is in a closed state or an open state. In some embodiments, detecting the retracted position of the motor may refer to detecting whether the motor is in a non-transmission connection state, an operation vacancy, or a clutch position. In the position or state, the motor as the driving component may be separated from the lock body connection member in terms of motion transmission. That is, the transmission between the motor and the lock body connection member may be disconnected. In some embodiments, a detection of a smart lock motion refers to waking up the control panel 60 in the standby state by detecting the motion of the lock body shaft, so that some elements on the control panel 60 (e.g., sensors with higher power consumption) remain in a low power consumption state when no smart lock operation is performed. The elements may be in a normal power consumption state until the control panel 60 is waken up, so that power consumption of the power supply module 250 is reduced. The above detections are respectively described in detail hereinafter.

In some embodiments, the smart lock state detection, the door body state detection, and the motor retraction position detection (or the clutch position detection) may be performed based on rotation angles of detected elements that are in a transmission connection to a detection target (e.g., the door body or the bolt). The detection manners may include an infrared code disc, a magnetic code disc, a gyroscope, etc. When the infrared code disc is used for detection, black and white color bars may be disposed on the detected element (e.g., the driving bevel gear 370 or the driven bevel gear 380), a count of pulses may be detected by using an infrared pair tube, and a position of the detection target (e.g., the lock body shaft) may be determined based on the count of pulses. When the magnetic code disc is used for detection, a magnetic ring may be fixed on the detected element (e.g., the driving bevel gear 370 or the driven bevel gear 380), a count of pulses may be detected by a Hall sensor, and the position of the detection target (e.g., the lock body shaft) may be determined based on the count of pulses. When the gyroscope is used for detection, the gyroscope may be fixed on the detection element (e.g., the door body, the smart lock 130-1, the driving bevel gear 370, or the driven bevel gear 380). The gyroscope may rotate with the gear, and the gyroscope may obtain the angle, and thus the position of the detection target (e.g., the lock body shaft) may be determined.

Figure 26:
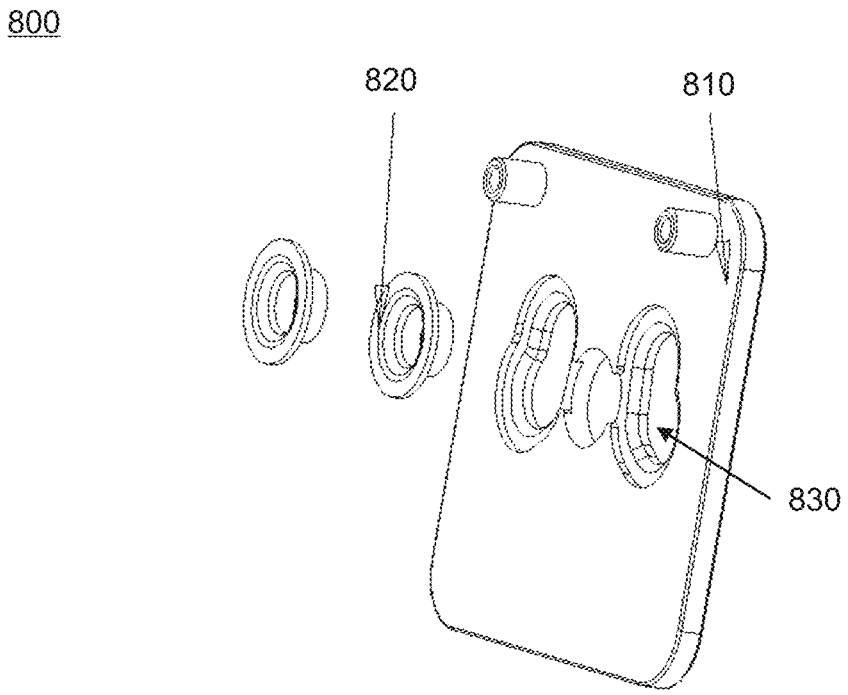
FIG. 26 is an exploded view illustrating a mounting plate assembly according to some embodiments of the present disclosure.
Figure 27:
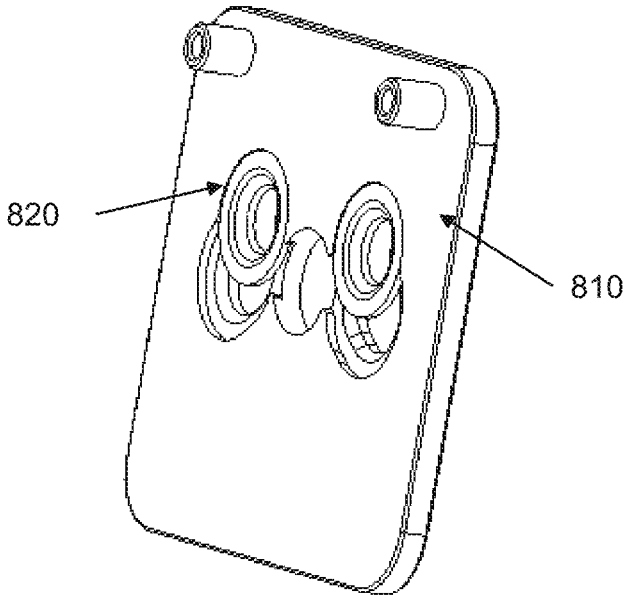
FIG. 27 is a schematic diagram illustrating a structure shown in FIG. 26 when the mounting plate assembly is in an assemble state.
Figure 28:
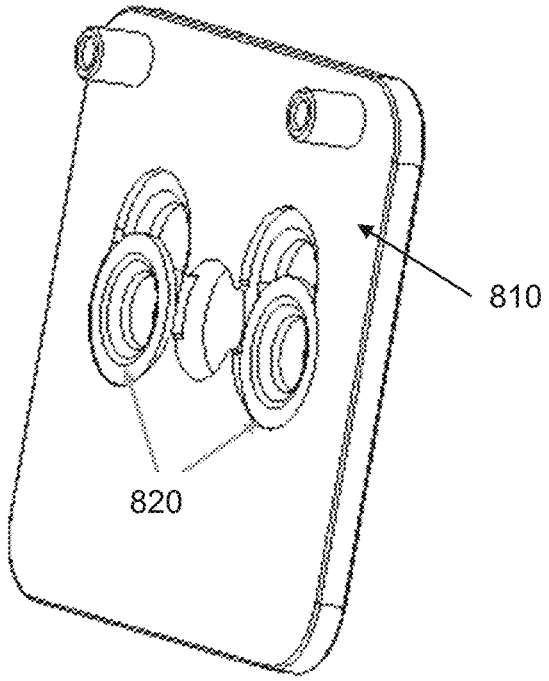
FIG. 28 is a schematic diagram illustrating a structure shown in FIG. 26 when the mounting plate assembly is in another assemble state.

Referring to FIG. 26 to FIG. 28, FIG. 26 is an exploded view illustrating a mounting plate assembly according to some embodiments of the present disclosure; FIG. 27 is a schematic diagram illustrating a structure shown in FIG. 26 when the mounting plate assembly is in an assemble state; FIG. 28 is a schematic diagram illustrating a structure shown in FIG. 26 when the mounting plate assembly is in another assemble state.

As shown in FIG. 26 to FIG. 28, in some embodiments, the smart lock 130-1 may include a mounting plate assembly 800. The mounting plate assembly 800 may be configured to mount the smart lock 130-1. In some embodiments, the mounting plate assembly 800 may include a mounting plate 810 and one or more sliding components 820.

The mounting plate 810 may be disposed between a door and the smart lock 130-1. A shape of the mounting plate 810 may include a regular shape (e.g., a circle, a square, an ellipse, etc.) or an irregular shape. A material of the mounting plate 810 may include a metal material (e.g., copper, stainless steel, etc.), a non-metallic material (e.g., wood, rubber, etc.), or a combination thereof. A size (e.g., an area, a thickness, etc.) of the mounting plate 810 may be determined according to actual requirements (e.g., a size of the smart lock 130-1, a mounting requirement, etc.).

In some embodiments, the mounting plate 810 may be disposed with one or more sliding holes 830. The one or more sliding holes 830 may be configured to accommodate the one or more sliding components 820. A shape of one of the one or more sliding holes 830 may include a regular shape (e.g., a circle, a square, an ellipse, etc.) or an irregular shape. For example, a shape of one sliding hole 830 may be a butterfly shape that includes two inclined elliptical racetrack-shaped mounting holes on both sides and a circular mounting hole in the middle. Therefore, the sliding component 820 may be adjusted by sliding in the sliding hole 830 to improve the adaptability of the mounting plate assembly 800. In some embodiments, the one or more sliding components 820 may be movably fixed on the mounting plate 810 through the one or more sliding holes 830. For example, the one or more sliding components 820 may be movably fixed on the mounting plate 810 by riveting. As another example, a sliding rail may be disposed around the one or more sliding holes 830 in the mounting plate 810, and the one or more sliding components 820 may be mounted on the sliding rail. Accordingly, the one or more sliding components 820 may be moved along the sliding rail. Referring to FIG. 27 and FIG. 28, two sliding components 820 may be moved in two sliding holes 830, respectively. A distance between the two sliding components 820 may be different when the two sliding components 820 are in different assemble states. For example, a first distance between the two sliding components 820 in FIG. 27 is less than a second distance between the two sliding components 820 in FIG. 28. Therefore, the distance between the two sliding components 820 may be adjusted according to actual requirements, which improves the adaptability of the mounting plate assembly 800, and ensures reliability of the assembly.

In some embodiments, a count of the one or more sliding holes 830 may be same as a count of the one or more sliding components 820. That is, each sliding hole 830 may correspond to one sliding component 820. In some embodiments, the count of the one or more sliding holes 830 may be same as the count of the one or more sliding components 820. That is, one sliding hole 830 may correspond to at least two sliding components 820, or at least two sliding holes 830 may correspond to one sliding component 820.

It should be noted that the mounting plate assembly 800 is merely for illustration, and not intended to limit the scope of the present disclosure. It should be understood that for persons having ordinary skills in the art, after understanding the principle of the system, it may be possible to arbitrarily combine various modules, or form subsystems to connect with other modules without departing from the principle. In some embodiments, the mounting plate assembly 800 may include a plurality of mounting plates, each of which includes a sliding hole for accommodating a sliding component. A distance between the plurality of mounting plates may be adjusted to mount smart locks with different sizes.

Figure 29:
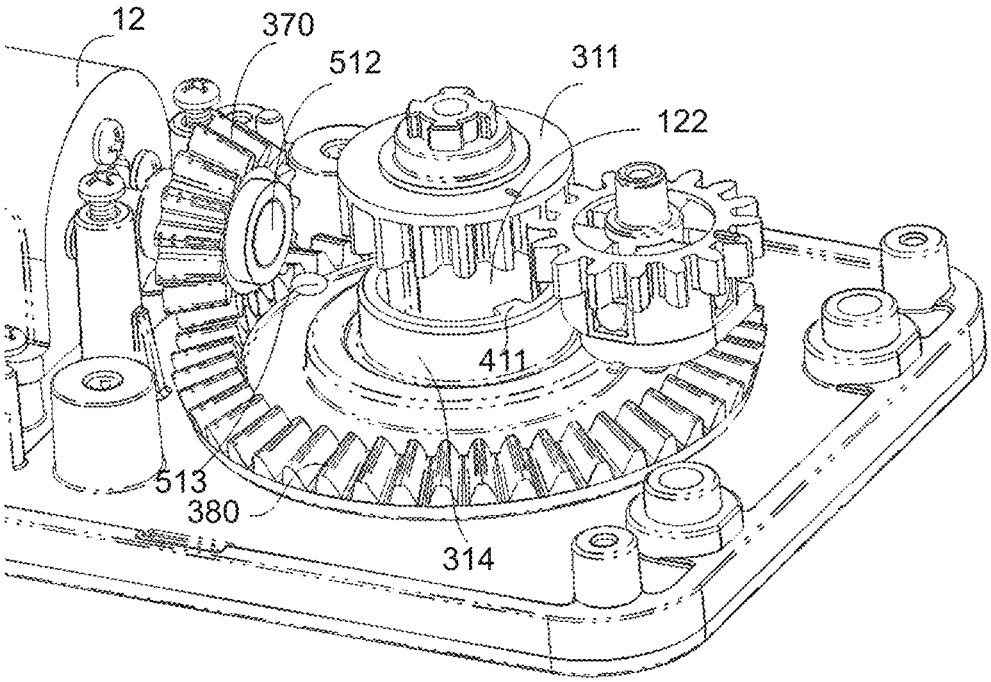
FIG. 29 is a schematic diagram illustrating a driving structure of a smart lock according to some embodiments of the present disclosure.
Figure 30:
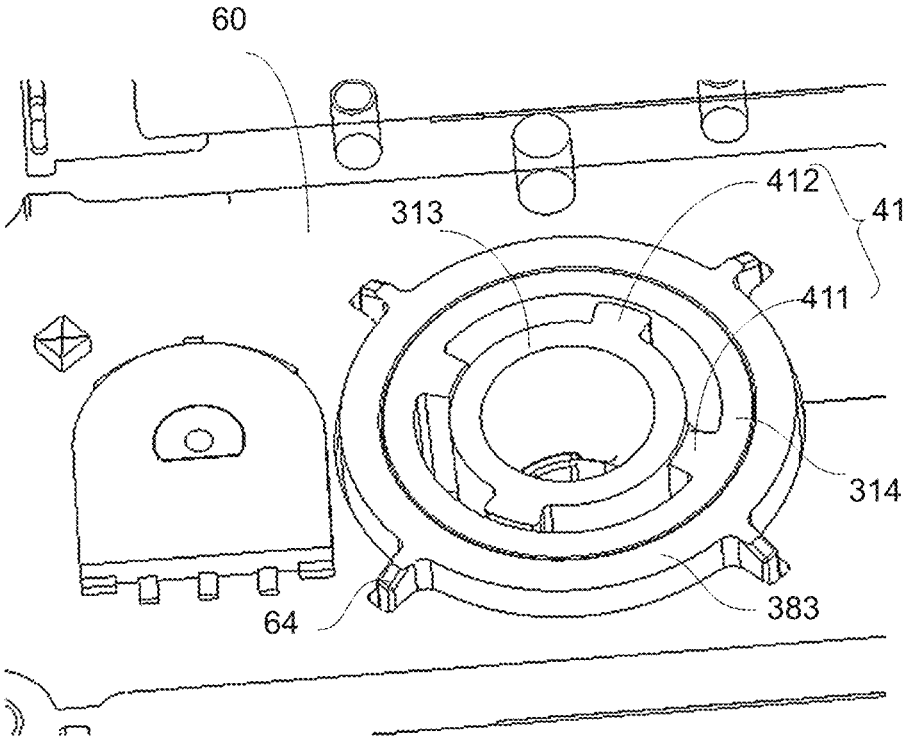
FIG. 30 is a schematic diagram illustrating a structure of a connection between an output gear and a driven bevel gear of a smart lock shown in FIG. 29.
Figure 31:
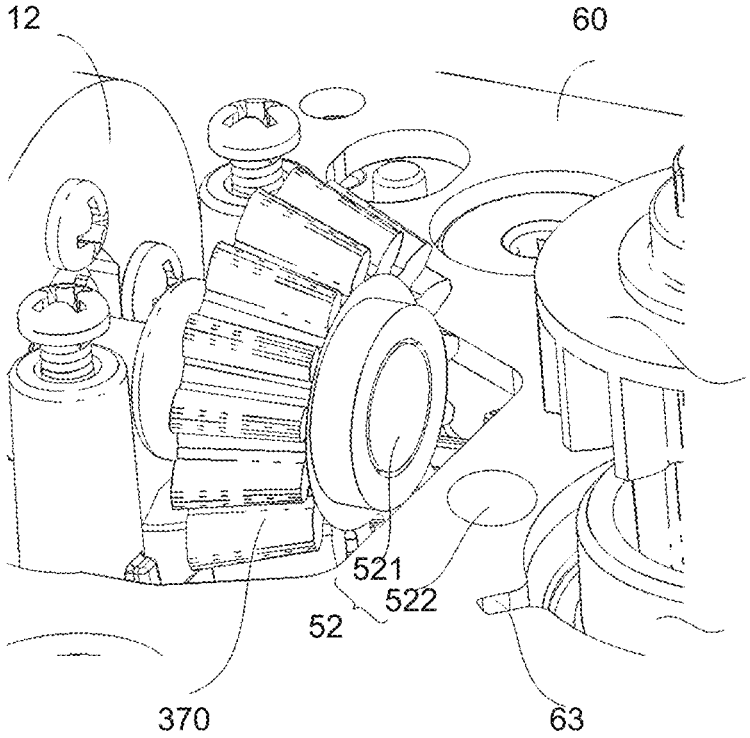
FIG. 31 is a schematic diagram illustrating a partial structure of a driving bevel gear of a smart lock shown in FIG. 29.

Taking the clutch structure in one or more embodiments illustrated in FIG. 12 to FIG. 14 as an example, the detection schemes may be illustrated in detail. Referring to FIG. 29 to FIG. 31, FIG. 29 is a schematic diagram illustrating a driving structure of a smart lock according to some embodiments of the present disclosure; FIG. 30 is a schematic diagram illustrating a structure of a connection between an output gear and a driven bevel gear of a smart lock shown in FIG. 29; and FIG. 31 is a schematic diagram illustrating a partial structure of a driving bevel gear of a smart lock shown in FIG. 29.

In some embodiments, the clutch mechanism in the mechanical structure 280 may also include other clutch mechanisms (e.g., a transmission assembly) other than the planet transmission assembly. In some embodiments, the transmission assembly may be configured to connect the driving component 12 and the lock body shaft in a transmission connection. The transmission assembly may include a connection portion 41 and a gear engagement assembly. The gear engagement assembly may be configured to connect the driving component 12 and the lock body shaft. The connection portion 41 may be forward rotated or reversely rotated. When the driving component 12 forward rotates, the lock body connection member 22 may be driven to rotate via the transmission assembly. When the driving component 12 reversely rotates, the transmission between the driving component 12 and the lock body shaft may be disconnected. The transmission assembly will be described in detail hereinafter in combination with FIG. 29 to FIG. 31.

As shown in FIG. 29 to FIG. 31, in some embodiments, the smart lock 130-1 may include the driving component 12, the transmission assembly, the control panel 60, and the second detection assembly 52 connected to the control panel 60. The driving component 12 may include a driving motor, and the second detection assembly 52 may be configured to detect a retreated position of the motor. For example, a separation angle between the driven bevel gear 380 and the output gear 311 in the transmission direction may be detected by detecting a retreat angle of the driven bevel gear 380 relative to the output gear 311. In some embodiments, the transmission assembly may include the connection portion 41 and a gear engagement assembly. The gear engagement assembly may include the driving bevel gear 370, the output gear 311, and the driven bevel gear 380. The driving bevel gear 370 may be in a transmission connection to an output shaft of the driving component 12, and the output gear 311 may be in a coaxial transmission with the lock body shaft.

In some embodiments, the connection portion 41 may include the first abutment member 411 and the second abutment member 412. Rotation of the driving bevel gear 370 may drive the first abutment member 411 to rotate, and the second abutment member 412 may be fixedly connected to the output gear 311. In some embodiments, the control panel 60 may control the forward rotation and the reverse rotation of the driving component 12 (e.g., the driving motor). The forward rotation of the driving component 12 may drive, via the driving bevel gear 370, the first abutment member 411 to rotate to be abutted the second abutment member 412, so that the lock body shaft is rotated and the lock body is locked. The lock body is not suitable for a manual operation by a user when the lock body is locked. The reverse rotation of the driving component 12 may drive the first abutment member 411 to reversely rotate to be separated from the second abutment member 412. The lock body is suitable for the manual operation by the user when the lock body shaft is separated.

In some embodiments, the second detection assembly 52 may detect a rotation angle of the transmission assembly (e.g., the driving bevel gear 370, the driven bevel gear 380, etc.). In some embodiments, the second detection assembly 52 may be configured to detect a rotation angle of the first abutment member 411. When the driving component 12 forward rotates so that the lock body shaft is in the locked state, the control panel 60 of the smart lock 130-1 can control the driving component 12 to reversely rotate so that the first abutment member 411 reversely rotate until a reverse rotation angle of the first abutment member 411 reaches a preset separation angle. When the first abutment member 411 reversely rotates at the preset separation angle, the output shaft of the driving component 12 may be separated from the lock body shaft. The user does not need to overcome a resistance from the driving component 12 during opening or closing the door with a key outdoors or with the knob (e.g., the manual knob 21) indoors. Therefore, the operations are simple and convenient.

The forward rotation and the reverse rotation are merely for the convenience of description of the present disclosure, rather than indicating or implying a specific orientation in which the driving component 12 rotates. The forward rotation of the driving component 12 enables the first abutment member 411 to be abutted the second abutment member 412, and drives the output gear 311 and the lock body shaft to rotate, thereby achieving locking of the lock body. Correspondingly, the reverse rotation of the driving component 12 by the preset separation angle enables the first abutment member 411 to be separated from the second abutment member 412.

In some embodiments, the preset separation angle which the first abutment member 411 needs to be rotated may be any angle within a predetermined angle stroke, as long as the first abutment member 411 and the second abutment member 422 may be separated from each other. In some embodiment, the preset separation angle may be within a range from 10 degrees to 180 degrees. In some embodiments, the preset separation angle may be within a range from 20 degrees to 150 degrees. In some embodiments, the preset separation angle may be within a range from 30 degrees to 120 degrees. In some embodiments, the preset separation angle may be within a range from 60 degrees to 90 degrees.

In some embodiments, the second detection assembly 52 may be configured to detect the rotation angle of the first abutment member 411 in real time, and send the detected rotation angle to the control panel 60. When the rotation angle of the first abutment member 411 fails to reach the preset separation angle, the control panel 60 may control the driving component 12 to continue to reversely rotate until the rotation angle of the first abutment member 411 reaches the preset separation angle. The process that the second detection assembly 52 detects the rotation angle of the first abutment member 411 and sends the detected angle to the control panel 60, and how the control panel 60 controls the rotation of the driving component 12 based on the rotation angle are well known to those skilled in the art, which is not repeated herein for brevity of description.

In some embodiments, using the bevel gear engagement may also simplify the overall structure and facilitate the structural arrangement.

In the above embodiments, an axis of the driving bevel gear 370 may be perpendicular to an axis of the output gear 311, and the transmission assembly may further include the driven bevel gear 380 engaged with the driving bevel gear 370. The driven bevel gear 380 may be disposed coaxially with the output gear 311. The first abutment member 411 may be fixedly connected to the driven bevel gear 380. In the embodiment, the driving bevel gear 370 and the output gear 311 may also be coaxially disposed, and the first abutment member 411 may be disposed on the driving bevel gear 370. When the driving component 12 drives the driving bevel gear 370 to rotate, the driving bevel gear 370 may drive the first abutment member 411 to rotate to abut the second abutment member 412 and separate from the second abutment member 412. The axis of the driving bevel gear 370 and the axis of the output gear 311 may be perpendicularly disposed to facilitate the arrangement of the driving component 12, which is conducive to miniaturization of the smart lock. Moreover, in the embodiment, a count of driven bevel gears 380 may not be limited. For example, one driven bevel gear 380 may be disposed in the embodiment, which is engaged with the driving bevel gear 370 and fixed to the first abutment member 411. Alternatively, a plurality of driven bevel gears 380 that are in engagement transmission connection with each other may be disposed, wherein one is engaged with the driving bevel gear 370, and another is coaxial with the output gear 311 and fixedly connected to the first abutment member 411. The configuration of one driven bevel gear 380 may simplify the overall structure and facilitate the structural arrangement.

In some embodiments, the driven bevel gear 380 may be disposed with a first sleeve 313. The first abutment member 411 may be disposed on a side wall of the first sleeve 313. The output gear 311 may be disposed with a second sleeve 314. The second abutment member 412 may be disposed on a side wall of the second sleeve 314. The first sleeve 313 and the second sleeve 314 may be coaxially disposed and sleeved on each other. In the embodiment, as shown in FIG. 30, the first sleeve 313 may be sleeved on the outside of the second sleeve 314. At this time, the first abutment member 411 may be disposed on an inner wall of the first sleeve 313, and the second abutment member 412 may be disposed on an outer wall of the second sleeve 314. Alternatively, the first sleeve 313 may also be sleeved on the inner side of the second sleeve 314. At this time, the first abutment member 411 may be disposed on an outer wall of the first sleeve 313, the second abutment member 412 may be disposed on an inner wall of the second sleeve 314. Such two arrangement manners are both available, which are not limited herein. In addition, the sleeve sleeved on the inside may also be configured as a solid structure. The sleeve structures that are sleeved on each other may cause the smart lock lighter.

Further, in some embodiments, a count of first abutment members 411 and a count of second abutment members 412 may not be limited, and may be determined according to actual conditions. In some embodiments, the count of first abutment members 411 and the count of second abutment members 412 may be two. The two first abutment members 411 may be uniformly disposed along a circumferential direction of the first sleeve 313, and the two second abutment members 412 may be uniformly disposed along a circumferential direction of the second sleeve 314. In the way, a force generated by abutting the first abutment member 411 against the second abutment member 412 may be reduced, and the service life and the abutting stability may be ensured.

In the above embodiment, as shown in FIG. 30, the transmission assembly may further include a hollow shaft 383. The control panel 60 may be disposed between the driven bevel gear 380 and the output gear 311. The hollow shaft 383 may pass through the control panel 60 and be fixed to the control panel 60. The first sleeve 313 and the second sleeve 314 may be both disposed in the hollow shaft 383. No specific requirement may be imposed for the manner of fixing the hollow shaft 383 to the control panel 60. As shown in FIG. 30 and FIG. 31, in the embodiment, the control panel 60 may be disposed with a through hole through which the hollow shaft 383 passes through. A fixing notch 63 may be disposed along a circumferential direction of the through hole, and a fixing block 64 may be disposed on an outer wall of the corresponding hollow shaft 383. The fixing block 64 may be fitted with the fixing notch 63 to realize the fixation therebetween, thereby preventing the hollow shaft 383 from rotating. Alternatively, the side wall of the hollow shaft 383 and the control panel 60 may also be fixed by bonding or other manners, which is not limited herein.

In some embodiments, a type of the second detection assembly 52 is not limited. The second detection assembly 52 may be a magnetic induction assembly (e.g., a magnetic member 521 and a magnetic encoder 522), an infrared code disc, a gyroscope, an accelerometer, etc. In some embodiments, the second detection assembly 52 may include the magnetic member 521 and the magnetic encoder 522. The magnetic member 521 may be fixedly disposed to the driving bevel gear 370 or the driven bevel gear 380, and the magnetic encoder 522 may obtain, via the rotation of the magnetic member 521, the rotation angle of the first abutment member 411, and send the rotation angle to the control panel 60. The magnetic member 521 may be in a block shape, a strip shape, a magnetic ring, etc., which is not limited herein.

Alternatively, in the embodiment, the second detection assembly 52 may also be configured as the infrared code disk. For example, black and white color bars may be disposed on the driving bevel gear 370 or the driven bevel gear 380, a count of pulses may be detected by the infrared pair tube, and the rotation angle may be obtained based on the count of pulses. Alternatively, the second detection assembly 52 may also be configured as a magnetic code disc. For example, a magnetic ring may be fixedly disposed on the driving bevel gear 370 or the driven bevel gear 380, a count of pulses may be detected by the Hall sensor, and the rotation angle may be obtained based on the count of pulses. Optionally, the second detection assembly 52 may also be configured as a gyroscope. The gyroscope may be fixedly connected to the driving bevel gear 370 or the driven bevel gear 380, and the gyroscope may obtain the rotation angle while the gyroscope is rotating.

Detecting the rotation angle of the first abutment member 411 by the magnetic member 521 and the magnetic encoder 522 may achieve a high detection accuracy, a strong anti-interference capability, a mounting easiness, and a low power consumption of the second detection assembly 52.

Further, the magnetic member 521 may be fixedly disposed at an axial center of the driving bevel gear 370 or an axial center of the driven bevel gear 380. The configuration eliminates needs for additional compensation during a calculation process, which simplifies the calculation process and improves the detection accuracy of the magnetic encoder 522.

In addition, the magnetic encoder 522 in the embodiment may be welded and fixed to the control panel 60. In the embodiment, a position of the magnetic encoder 522 may not be limited. For example, the magnetic encoder 522 may be fixed to a mounting plate, etc., of the driving component 12. The magnetic encoder 522 and the control panel 60 may be fixedly connected, so that the overall structure is more regular. In addition, after the magnetic encoder 522 is fixedly connected to the control panel 60, a distance between the magnetic encoder 522 and the magnetic member 521 may be within a detectable range, thereby ensuring the detection accuracy.

In some embodiments, the detection module 210 may also be applicable to a scenario where the control panel 60 is rapidly waken up. The rapid wake-up indicates that a product with high power consumption (e.g., the control panel 60) is in the standby state or the dormant state and does not operate, and the control panel 60 may be waken up by a real-time detection of a low power consumption element (e.g., the sensor). Due to the high power consumption of the control panel 60, in order to ensure the battery life, the control panel 60 may be maintained in the standby state. By rapidly waking up the control panel 60, the control panel 60 may perform subsequent operations timely. Therefore, the use performance of the smart lock may be ensured while reducing the power consumption. In some embodiments, the accelerometer may be fixed on the lock body shaft, and the accelerometer may detect whether the lock body shaft is moving under the low power consumption. When the lock body shaft rotates, an acceleration motion may be generated, and hence the accelerator may be waken up. Therefore, the accelerometer may wake up the control panel 60 for subsequent operations. In other embodiments, an electric brush may also be disposed on the gear rigidly connected to the lock body shaft, and a corresponding code disc may be disposed on the control panel 60. Once the lock body shaft is moved, a position of the electric brush may change. The control panel 60 may be waken up by detecting an electrical signal.

In some embodiments, whether the control panel 60 needs to be waken up may be determined by detecting whether the lock body shaft generates a motion. When it is detected that the lock body shaft generates a motion, a wake-up signal may be sent to the control panel 60 to wake up the control panel 60. In some embodiments, whether the lock body shaft generates a motion may be determined by detecting whether a member that is in a transmission connection to the lock body shaft moves. In some embodiments, an induction element may be added to the lock body shaft and a part that is in the transmission connection to the lock body shaft, and the induction element may detect motions of the lock body shaft and the part that is in the transmission connection to the lock body shaft.

In some embodiments, the detection module 210 may include an induction assembly 80. The induction assembly 80 may include a first induction element 81 and a second induction element 82. The first induction element 81 may be fixedly disposed relative to the lock body connection member, and the second induction element 82 may rotate relative to the first induction element 81. The movement of the lock body connection member may drive the first induction element 81 to move relative to the second induction element 82, and trigger the first induction element 81 or the second induction element 82 to send a wake-up signal to the control module 230.

Figure 34:
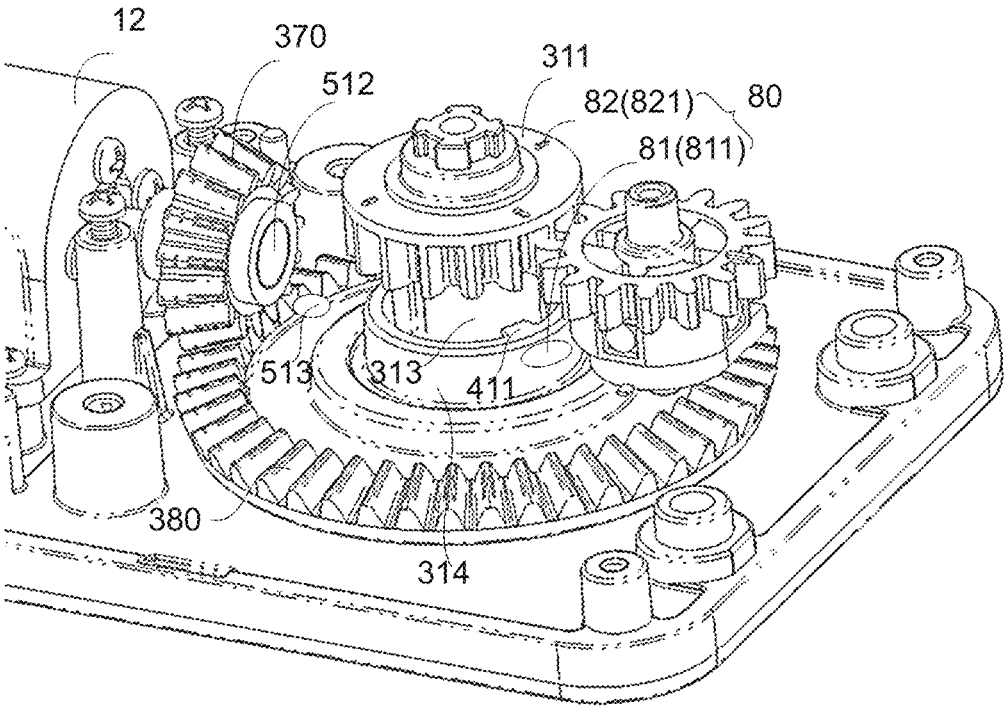
FIG. 34 is a schematic diagram illustrating another smart lock system according to some embodiments of the present disclosure.
Figure 35:
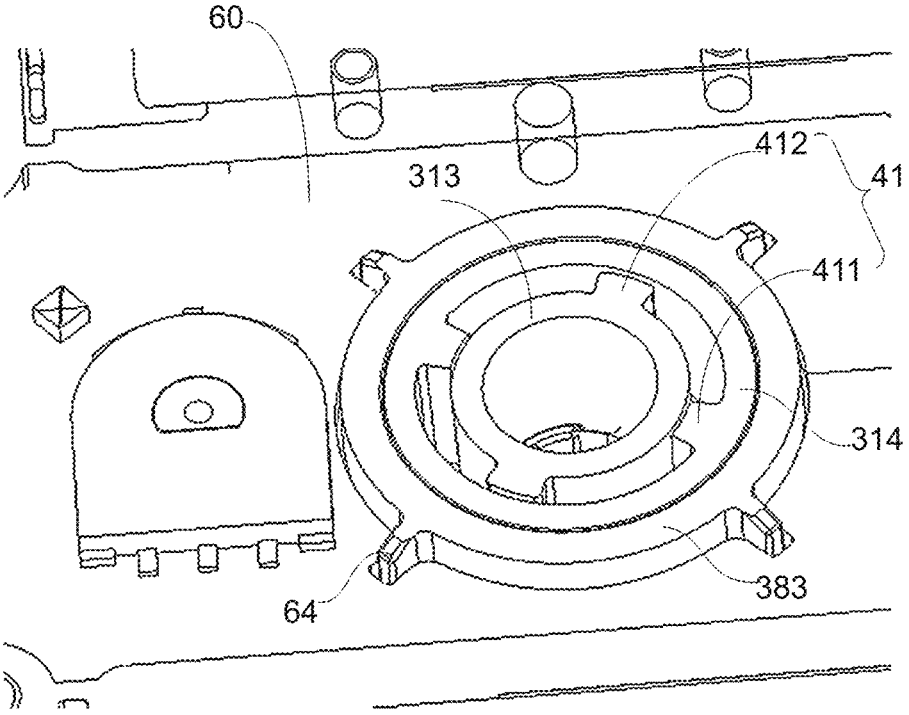
FIG. 35 is a schematic diagram illustrating a structure of a connection between an output gear and a driven bevel gear of a smart lock shown in FIG. 34.
Figure 36:
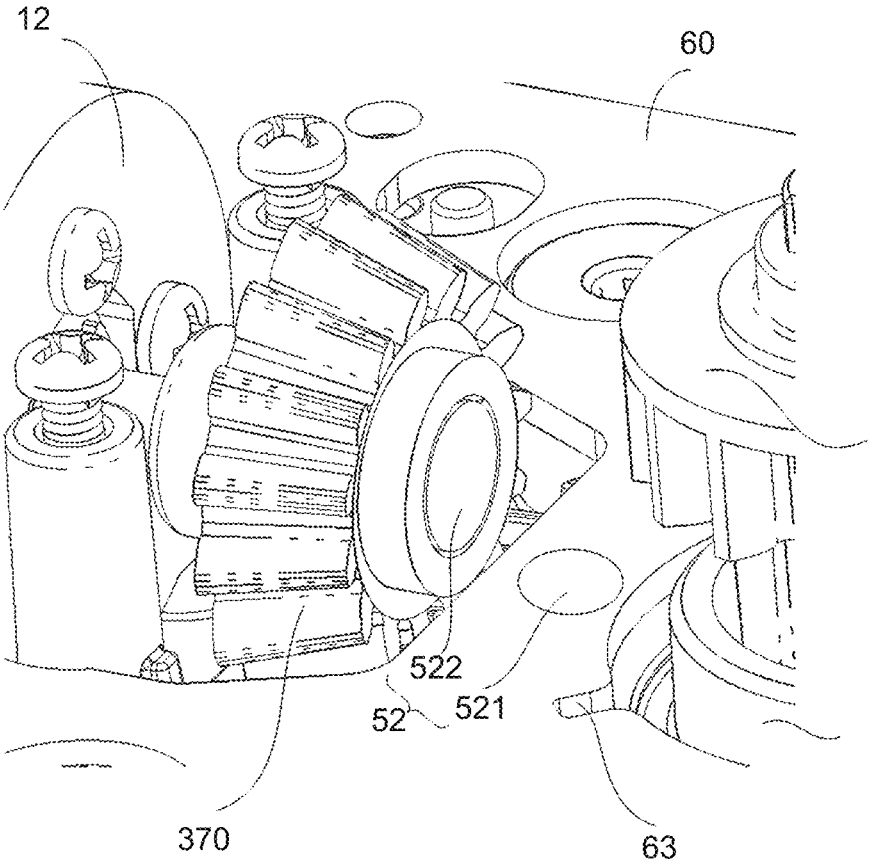
FIG. 36 is a partial schematic diagram illustrating a partial structure of a driving bevel gear of a smart lock shown in FIG. 34.

Referring to FIG. 34 to FIG. 36, FIG. 34 is a schematic diagram illustrating another smart lock system according to some embodiments of the present disclosure; FIG. 35 is a schematic diagram illustrating a structure of a connection between an output gear and a driven bevel gear of a smart lock shown in FIG. 34; and FIG. 36 is a partial schematic diagram illustrating a partial structure of a driving bevel gear of a smart lock shown in FIG. 34.

As shown in FIG. 34 to FIG. 36, in some embodiments, the smart lock 130-1 may include the driving component 12, the transmission assembly 30, the control panel 60, a lock body structure, and the induction assembly 80. In some embodiments, the induction assembly 80 may include the first induction element 81 and the second induction element 82. The first induction element 81 may be signally connected to the control panel 60. One of the first induction element 81 and the second induction element 8 may be fixed relative to a lock body shaft of the lock body structure, and rotate relative to the other. That is, in the two induction elements, one induction element may be relatively fixed to the lock body shaft, and rotated relative to the other induction element under the driving of the lock body shaft.

For instance, the driving component 12 can drive, via the transmission assembly, the lock body shaft to rotate to unlock or lock the lock body structure. When the driving component 12 drives, via the transmission assembly, the lock body shaft to rotate, the induction element relatively fixed to the lock body shaft may rotate relative to the other induction element, and the first induction element 81 may be triggered to send a wake-up signal to the control panel 60. The control panel 60 may be in a dormant state until the first induction element 81 sends the wake-up signal to the control panel 60.

In some embodiments, the first induction element 81 may be fixed relative to the lock body shaft and send the wake-up signal to the control panel 60, or the second induction element 82 may be fixed relative to the lock body shaft, which is not limited herein. In addition, how the second induction element 82 sends the wake-up signal to the control panel 60 to wake up the control panel 60 is the related art well known to those skilled in the art, which is not repeated herein for brevity of description.

In some embodiments, under normal circumstances, in order to reduce power consumption, the control panel 60 of the smart lock 130-1 may be in the low power consumption state, and rotation of the lock body may be detected in real time by the first induction element 81 and the second induction element 82. When the lock body shaft rotates, the two induction elements may rotate relative to each other, and the first induction element 81 can immediately wake up the control panel 60 for subsequent operations. That is, the control panel 60 is in the dormant state (the low power consumption state) until the lock body shaft rotates and the control panel 60 receives the wake-up signal from the first induction element 81, and thus the fast wake-up function is implemented so that the subsequent operations may be rapidly performed. The smart lock 130-1 according to the embodiment may ensure the use performance while reducing the power consumption.

In some embodiments, the first induction element 81 may be a sensor, and the second induction element 82 may be an element that can be detected by the sensor. A type of the sensor is not limited in the present disclosure, which may be, for example, an electric brush, a Hall sensor, an accelerometer, etc. The first induction element 81 as the electric brush and the Hall sensor may be taken as an example for illustration.

In some embodiments, the first induction element 81 is a Hall sensor 811, which is signally connected to the control panel 60 and sends the wake-up signal to the control panel 60 in response to being triggered, and the second induction element 82 is a magnetic induction element 821. Alternatively, in the embodiment, the first induction element 81 may be configured as a code disc, and the second induction element 82 may be configured as the electric brush fixed relative to the lock body shaft. When the lock body shaft rotates, the electric brush may rotate relative to the code disc. That is, a position of the electric brush on the code disc may change. At this time, the code disc may be triggered and send a wake-up signal to the control panel 60 to wake up the control panel 60 for subsequent operations.

A solution of configuring the first induction element 81 as the Hall sensor 811 and configuring the second induction element 82 as the magnetic induction element 821 may simplify the overall structure. In addition, the Hall sensor 811 may be triggered even in the case of being not directly connected to the magnetic induction element 821. Therefore, the mounting is convenient, the reliability is good, and the cost is low. Further, no direct contact between the Hall sensor 811 and the magnetic induction element 821 may reduce friction when the two elements rotate relative to each other, and ensure the service life.

In the present disclosure, a count of first induction elements 81 and a count of magnetic induction elements 821 are not limited. The count of first induction elements 81 may be the same as or different from the count of magnetic induction elements 821.

In the above embodiment, the count of Hall sensors 811 and/or the count of magnetic induction elements 821 may be at least two, and uniformly arranged along a circumferential direction of the lock body shaft. For example, the count of Hall sensors 811 may be at least two, and the Hall sensors may be uniformly disposed along the circumferential direction of the lock body shaft. Alternatively, the count of magnetic induction elements 821 may be at least two, the magnetic induction elements 821 may be uniformly disposed along the circumferential direction of the lock body shaft. Alternatively, the count of Hall sensors 811 and the count of magnetic induction elements 821 may be at least two, respectively. In this case, the count of Hall sensors may be the same as or different from the count of magnetic induction elements, and the elements may be uniformly disposed along the circumferential direction of the lock body shaft. For example, the count of Hall sensors 811 may be set to one, and the count of magnetic induction elements 821 may be set to four. The four magnetic induction elements 821 may be uniformly disposed along the circumferential direction of the lock body shaft, so that the Hall sensor 811 is triggered when the lock body shaft rotates at most 90 degrees, and sends the wake-up signal to the control panel 60. Therefore, when the lock body shaft rotates, the control panel 60 may be waken up timely for subsequent operations.

In some embodiments, the lock body may include a position sensor (e.g., one or more Hall switches and one or more mechanical micro switches). When the lock body shaft rotates, the one or more Hall switches and one or more mechanical micro switches may be triggered, and the control panel 60 may be waken up timely for subsequent operations.

In some embodiments, the transmission assembly 30 may include the connection portion 41, a driving member (e.g., the driving bevel gear 370), and a driven member (e.g., the output gear 311). The connection portion 41 may be configured to be connected the driving member and the driven member in a transmission connection. The driving member (e.g., the driving bevel gear 370) may be in the transmission connection to the output shaft 124 of the driving component 12 or the output portion 312 of the gearbox 122, and the driven member (e.g., the output gear 311) may be in the transmission connection to the lock body shaft of the lock body structure. In some embodiments, the connection portion 41 may include the first abutment member 411 and the second abutment member 412. The rotation of the driving member (e.g., the driving bevel gear 370) may drive the first abutment member 411 to rotate. The second abutment member 412 may be fixedly connected to the driven member (e.g., the output gear 311). The control panel 60 may control forward rotation and reverse rotation of the driving component 12. The forward rotation of the driving component 12 may cause the driving bevel gear 370 to drive the first abutment member 411 to rotate to be abutted the second abutment member 412, so that the lock body shaft rotates and the lock body is locked. The reverse rotation of the driving component 12 may drive the first abutment member 411 to reversely rotate to be separated from the second abutment member 412.

In some embodiments, the detection module 210 may detect the motion of the lock body shaft, and rapidly wake up the control panel 60 based on the motion generated by the lock body shaft. In some embodiments, the detection module 210 may also determine a rotation angle of the lock body shaft, and determine, based on the rotation angle, whether the lock body shaft is in a locked state. The control panel 60 may switch between manual/automatic unlocking modes based on the lock body shaft in the locked state.

In the embodiment, the smart lock 130-1 may include the second detection assembly 52. The second detection assembly 52 may be configured to detect a rotation angle of the first abutment member 411. When the driving component 12 forward rotates so that the lock body shaft is in the locked state, the control panel 60 of the smart lock 130-1 can control the driving component 12 to reversely rotate so that the first abutment member 411 reversely rotate until a reverse rotation angle of the first abutment member 411 reaches a preset separation angle. When the first abutment member 411 reversely rotates to the preset separation angle, the output shaft of the driving component 12 may be separated from the lock body shaft. A user does not need to overcome a resistance from the driving component 12 during opening or closing the door with a key outdoors or with the knob (e.g., the manual knob 21) indoors. Therefore, the operations are simple and convenient.

The forward rotation and the reverse rotation are merely for the convenience of description of the present disclosure, rather than indicating or implying a specific orientation in which the driving component 12 rotates. The forward rotation of the driving component 12 enables the first abutment member 411 to be abutted the second abutment member 412, and drives the output gear 311 and the lock body shaft to rotate, thereby achieving locking of the lock body. Correspondingly, the reverse rotation of the driving component 12 by the preset separation angle enables the first abutment member 411 to be separated from the second abutment member 412.

In some embodiments, the preset separation angle which the first abutment member 411 needs to be rotated may be set based on a structure of the lock body, which is not limited herein. The second detection assembly 52 may be configured to detect the rotation angle of the first abutment member 411 in real time, and send the detected rotation angle to the control panel 60. When the rotation angle of the first abutment member 411 fails to reach the preset separation angle, the control panel 60 may control the driving component 12 to continue to reversely rotate until the rotation angle of the first abutment member 411 reaches the preset separation angle. The process that the second detection assembly 52 detects the rotation angle of the first abutment member 411 and sends the detected angle to the control panel 60, and how the control panel 60 controls the rotation of the driving component 12 based on the rotation angle are well known to those skilled in the art, which is not repeated herein for brevity of description.

In some embodiments, a rotation axis of the driving member (e.g., the driving bevel gear 370) may be perpendicular to a rotation axis of the driven member (e.g., the output gear 311). In some embodiments, the transmission assembly may further include an intermediate transmission member (e.g., the driven bevel gear 380) engaged with the driving member (e.g., the driving bevel gear 370). The intermediate transmission member may be coaxial with the driven member. As shown in FIG. 34, the driven bevel gear 380 may be coaxial with the output gear 311, and the first abutment member 411 may be fixedly connected to the driven bevel gear 380.

In other embodiments, the driving member and the driven member may also be coaxially disposed, and the first abutment member 411 may be disposed on the driving member. When the driving component 12 drives the driving member to rotate, the driving member can drive the first abutment member 411 to rotate to abut the second abutment member 412 and separate from the second abutment member 412.

The axis of the driving member (e.g., the driving bevel gear 370) and the axis of the driven member (e.g., the output gear 311) may be perpendicularly disposed to facilitate the arrangement of the driving component 12, which is conducive to miniaturization of the smart lock. Moreover, in some embodiments, a count of intermediate transmission members (e.g., the driven bevel gears 380) may not be limited. For example, one driven bevel gear 380 may be disposed in the embodiment, which is engaged with the driving bevel gear 370 and is fixed to the first abutment member 411. Alternatively, a plurality of driven bevel gears 380 that are in the engagement transmission connection with each other may be disposed, wherein one is engaged with the driving bevel gear 370, and another is coaxial with the output gear 311 and fixedly connected to the first abutment member 411. The configuration of one driven bevel gear 380 may simplify the overall structure and facilitate the structural arrangement.

In some embodiments, referring to FIG. 34 to FIG. 35, the intermediate transmission member (for example, the driven bevel gear 380) may be disposed with the first sleeve 313. The first abutment member 411 may be disposed on a side wall of the first sleeve 313. The driven member (e.g., the output gear 311) may be disposed with the second sleeve 314. The second abutment member 412 may be disposed on a side wall of the second sleeve 314. The first sleeve 313 and the second sleeve 314 may be coaxially disposed and sleeved on each other. In the embodiment, as shown in FIG. 35, the first sleeve 313 may be sleeved on the outside of the second sleeve 314. At this time, the first abutment member 411 may be disposed on an inner wall of the first sleeve 313, and the second abutment member 412 may be disposed on an outer wall of the second sleeve 314. Alternatively, the first sleeve 313 may also be sleeved on the inner side of the second sleeve 314. At this time, the first abutment member 411 may be disposed on an outer wall of the first sleeve 313, the second abutment member 412 may be disposed on an inner wall of the second sleeve 314. Such two arrangement manners are both available, which are not limited herein. In addition, the sleeve sleeved on the inside may also be configured as a solid structure. The sleeve structures that are sleeved on each other may cause the smart lock lighter.

In some embodiments, a count of first abutment members 411 and a count of second abutment members 412 may not be limited. and may be determined according to actual conditions. The count of first abutment members 411 and the count of second abutment member 412 may be related to an angular range that can be rotated in the reverse rotation and the forward rotation. The greater the count of first abutment members 411 and the count of second abutment members 412 is, the smaller the angle range of rotation may be. In some embodiments, the count of first abutment members 411 and the count of second abutment members 412 may be two. The two first abutment members 411 may be uniformly disposed along a circumferential direction of the first sleeve 313, and the two second abutment members 412 may be uniformly disposed along a circumferential direction of the second sleeve 314. In the way, a force generated by abutting the first abutment member 411 against the second abutment member 412 may be reduced, and the service life and the abutting stability may be ensured.

In the above embodiment, as shown in FIG. 35, the transmission assembly may further include the hollow shaft 383. The control panel 60 may be disposed between the driven bevel gear 380 and the output gear 311. The hollow shaft 383 may pass through the control panel 60 and be fixed to the control panel 60. The first sleeve 313 and the second sleeve 314 may be both disposed in the hollow shaft 383. No specific requirement may be imposed for the manner of fixing the hollow shaft 383 to the control panel 60. As shown in FIG. 35 and FIG. 36, in the embodiment, the control panel 60 may be disposed with a through hole through which the hollow shaft 383 passes through. The fixing notch 63 may be disposed along a circumferential direction of the through hole, and the fixing block 64 may be disposed on an outer wall of the corresponding hollow shaft 383. The fixing block 64 may be fitted with the fixing notch 63 to realize the fixation therebetween, thereby preventing the hollow shaft 383 from rotating. Alternatively, the side wall of the hollow shaft 383 and the control panel 60 may also be fixed by bonding or other manners, which is not limited herein.

In some embodiments, the second detection assembly 52 may include the magnetic member 521 and the magnetic encoder 522. The magnetic member 521 may be fixedly disposed to the driving bevel gear 370 or the driven bevel gear 380, and the magnetic encoder 522 may obtain, via the rotation of the magnetic member 521, the rotation angle of the first abutment member 411, and send the rotation angle to the control panel 60.

Structures of the magnetic induction member 821 and the magnetic member 521 may not be limited. For example, the structure may include a block shape, a strip shape, a magnetic ring, etc.

Alternatively, in the embodiment, the second detection assembly 52 may also be configured as the infrared code disk. For example, black and white color bars may be disposed on the driving bevel gear 370 or the driven bevel gear 380, a count of pulses may be detected by the infrared pair tube, and the rotation angle may be obtained based on the count of pulses. Alternatively, the second detection assembly 52 may also be configured as a magnetic code disc. For example, a magnetic ring may be fixedly disposed on the driving bevel gear 370 or the driven bevel gear 380, a count of pulses may be detected by the Hall sensor, and the rotation angle may be obtained based on the count of pulses. Optionally, the second detection assembly 52 may also be configured as a gyroscope. The gyroscope may be fixedly connected to the driving bevel gear 370 or the driven bevel gear 380, and the gyroscope may obtain the rotation angle while the gyroscope is rotating. Detecting the rotation angle of the first abutment member 411 by the magnetic member 521 and the magnetic encoder 522 may achieve a high detection accuracy, a strong anti-interference capability, a mounting easiness, and a low power consumption of the second detection assembly 52.

In some embodiments, the magnetic member 521 may be fixedly disposed at an axial center of the driving bevel gear 370 or an axial center of the driven bevel gear 380. The configuration eliminates needs for additional compensation during a calculation process, which simplifies the calculation process and improves the detection accuracy of the magnetic encoder 522.

In some embodiments, the second induction element 82 (the magnetic induction element 821) may be fixed to the lock body shaft, the output gear 311, or the indoor knob (the manual knob 21) for opening and closing the door, so that the second induction element 82 and the lock body shaft are relatively fixed. The first induction element 81 (the Hall sensor 811) may be welded and fixed to the control panel 60 and send a wake-up signal to the control panel 60.

In the embodiment, positions of the magnetic encoder 522 and the Hall sensor 811 are not limited. For example, the magnetic encoder 522 or the Hall sensor 811 may be fixed to a mounting plate of the drive mechanism, or the like. The magnetic decoder 522 and the Hall sensor 811 may be fixedly connected to the control panel 60. Therefore, the overall structure may be more regular. In addition, after the magnetic encoder 522 and the Hall sensor 811 are fixedly connected to the control panel 60, a distance between the Hall sensor 811 and the magnetic induction element 821 and a distance between the magnetic encoder 522 and the magnetic member 521 may be within a detectable range, thereby ensuring the detection accuracy.

In some embodiments, the manner for detecting a state of the smart lock may include disposing a gyroscope on the lock body shaft, and determining the state of the smart lock by detecting the rotation angle of the lock body shaft via the gyroscope. In some embodiments, the door state detection may be achieved by mounting a gyroscope sensor and an accelerometer inside the smart lock or on the door body, and the gyroscope sensor may detect an angular velocity of the smart lock and the door body at any time. In some embodiments, a coordinate axis of the gyroscope sensor may be configured to determine whether the door is in the closed state. For example, when the coordinate axis of the gyroscope sensor is within a determined door closing angle range, the processing module 220 may determine that the door is in the closed state. As another example, when the coordinate axis of the gyroscope sensor is not within the determined door closing angle range, the processing module 220 may determine that the door is in the open state. In some alternative embodiments, the manners for detecting the state of the smart lock may further include performing detection using a Hall sensor, an electric brush, a code disc, etc. The detecting the state of the door body or the state of the lock body using the gyroscope will be described in detail hereinafter.

In some embodiments, the smart lock 130-1 may be mounted on the door body, and the gyroscope sensor and the accelerometer may be mounted inside the smart lock 130-1 or on the door body. The gyroscope sensor may detect an angular velocity of the smart lock 130-1 and an angular velocity of the door at any time, and send the detected angular velocity to the processing module 220 and/or a storage module. The accelerometer may detect a motion acceleration of a bolt of the door body of the smart lock 130-1, and send a detected acceleration signal to the processing module 220 and/or a storage device. In some embodiments, the accelerometer may be configured to detect the state of the lock body, the state (open or closed) of the door body, and whether the door body in the open state shakes.

In some embodiments, the coordinate axis of the gyroscope sensor may be configured to determine whether the door body is in the closed state. For example, when the coordinate axis of the gyroscope sensor is within the determined door closing angle range, the processing module 220 may determine that the door is in the closed state. As another example, when the coordinate axis of the gyroscope sensor is not within the determined door closing angle range, the detection module 210 may determine that the door is in the open state.

The smart lock system may eliminate a static error of the gyroscope sensor, so that the detected door angle is more accurate. In some embodiments, the smart lock system may eliminate accumulated errors of the gyroscope sensor, and improve the accuracy of identifying the state of the door.

In some embodiments, the static error may refer to the noise generated by the gyroscope sensor itself in a static environment. It should be noted that in the present disclosure, the noise refers to any factor that may affect an indicator of the gyroscope sensor. For example, in an ideal state, the indicator of the gyroscope sensor should be 0. However, due to various factors (e.g., a material, a structure, manufacturing process defects, etc., of the gyroscope sensor), the indicator of the gyroscope sensor is a number not equal to 0. The indicator may be considered as the static error.

In some embodiments, the processing module 220 may control the gyroscope sensor to be stationary, and acquire the angular velocity of the gyroscope sensor in a stationary state for at least a predetermined time (also referred to as a third predetermined time in the present disclosure) as the static error. For example, the processing module 220 may acquire the angular velocity of the gyroscope sensor for at least 5 seconds in the stationary state, and perform integration on the angular velocity within at least 5 seconds to obtain the angle within at least 5 seconds as the static error. In some embodiments, the processing module 220 may determine, based on the angular velocity and the static error acquired by the gyroscope sensor in the operation state, the angular velocity of the gyroscope sensor after the static error is eliminated. For example, the processing module 220 may integrate the angular velocity acquired within a specific time period (e.g., 5 seconds, 10 seconds, 15 seconds, 20 seconds, etc.) of the gyroscope sensor in the operation state, and obtain an angle within the specific time period (e.g., 5 seconds, 10 seconds, 15 seconds, 20 seconds, etc.). An angle with the static error of the gyroscope sensor eliminated may be obtained by subtracting the static error from the angle. In some embodiments, the third predetermined time may be predetermined by a machine or a user. For example, the third predetermined time may be 2 seconds, 5 seconds, 8 seconds, 10 seconds, 15 seconds, 20 seconds, etc. Values of the third predetermined time are only reference values, which are not limited herein. In practice, the third predetermined time is determined as long as an accumulation error of the gyroscope sensor is eliminated. In some embodiments, the processing module 220 may store the static error of the gyroscope sensor in the storage module.

In some embodiments, when the processing module 220 determines that the static error of the gyroscope sensor has been eliminated, the processing module 220 may control the gyroscope sensor and/or the accelerometer to enter the operation state. In some embodiments, the gyroscope sensor may detect the angular velocity of the smart lock 130-1 and the door body at any time in the operation state. In some embodiments, the accelerometer may detect the acceleration of the smart lock 130-1 and the door body in the operation state.

In some embodiments, the static error and the accumulated error may be collectively referred to as comprehensive errors. With the accumulation of time, the deviation of the gyroscope sensor may constantly accumulate, thereby forming an accumulated error, which leads to an error in the determination of the state of the door. For example, the angle of the door obtained by the processing module 220 may be −2 degrees. However, a minimum angle of the door is 0 degrees, and the angle shall not be a negative value. In this case, it may be actually considered that the door is in the closed state, and the negative angle is caused by the accumulated error of the gyroscope sensor. As another example, the angle of the door obtained by the processing module 220 may be 1 degree. However, the door cannot be opened at such a small angle. In this case, it may be considered that the door is actually closed and a small door opening angle (e.g., 1 degree) is caused by the accumulated error of the gyroscope sensor. Generally, if the angle of the door is a negative value, it is most likely that the door is closed, and the negative angle is caused by the accumulated error of the gyroscope sensor. If the angle of the door is a positive value, it is likely that the door is in the open state, or the door is in the closed state which is induced by the accumulated error of the gyroscope sensor.

Therefore, during eliminating the accumulated error of the gyroscope sensor, selection of a door angle threshold is more critical. For example, a reasonable door angle threshold or angle range may be selected, so that when the door angle is within the predetermined angle range, the door is actually closed but the accumulated error of the gyroscope sensor causes the angle to be not 0. When the angle is not within the angle range, the door is actually open. In some embodiments, when it is detected that the angle of the door fed back by the gyroscope sensor is within the predetermined angle range (also referred to as a first predetermined angle range in the present disclosure) and is maintained for a predetermined time (also referred to a fourth predetermined time in the present disclosure), the processing module 220 may calibrate the angle of the door to 0 degrees. For example, when it is detected that the angle of the door fed back by the gyroscope sensor is within a range from −4 degrees to 4 degrees and is maintained for 20 seconds, the processing module 220 may calibrate the angle of the door to 0 degrees. As another example, when it is detected that the angle of the door fed back by the gyroscope sensor is within a range from −3 degrees to 3 degrees and is maintained for 15 seconds, the processing module 220 may calibrate the angle of the door to 0 degrees. As still another example, when it is detected that the angle of the door fed back by the gyroscope sensor is within a range from −2 degrees to 2 degrees and is maintained for 10 seconds, the processing module 220 may calibrate the angle of the door to 0 degrees.

In some embodiments, the first predetermined angle range may be determined by a machine or a user. For example, the first predetermined angle range may be within a range from −5 degrees to 5 degrees. In some embodiments, the first predetermined angle range may be within a range from −4.5 degrees to 4.5 degrees. In some embodiments, the first predetermined angle range may be within a range from −4 degrees to 4 degrees. In some embodiments, the first predetermined angle range may be within a range from −3.5 degrees to 3.5 degrees. In some embodiments, the first predetermined angle range may be within a range from −3 degrees to 3 degrees. In some embodiments, the first predetermined angle range may be within a range from −2.5 degrees to 2.5 degrees. In some embodiments, the first predetermined angle range may be within a range from −2 degrees to 2 degrees. In some embodiments, the fourth predetermined time may be determined by a machine or a user. For example, the fourth predetermined time may be 5 seconds, 8 seconds, 10 seconds, 15 seconds, 20 seconds, etc. Values of the first predetermined angle range and the fourth predetermined time are merely reference values, which are not limited herein. In practice, the first predetermined angle range and the fourth predetermined time are determined as long as the accumulation error of the gyroscope sensor is eliminated.

In some embodiments, when it is detected that the angle of the door fed back by the gyroscope sensor is within a second predetermined angle range and is maintained for a fifth predetermined time, the processing module 220 may calibrate the angle of the door to 0 degrees. For example, when it is detected that the angle of the door fed back by the gyroscope sensor is less than −1 degrees and is maintained for 5 seconds, the processing module 220 may calibrate the angle of the door to 0 degrees. As another example, when it is detected that the angle of the door fed back by the gyroscope sensor is less than −2 degrees and is maintained for 3 seconds, the processing module 220 may calibrate the angle of the door to 0 degrees.

In some embodiments, the second predetermined angle range may be determined by a machine or a user. For example, the second predetermined angle range may be less than −5 degrees. In some embodiments, the second predetermined angle range may be less than −4.5 degrees. In some embodiments, the second predetermined angle range may be less than −4 degrees. In some embodiments, the second predetermined angle range may be less than −3.5 degrees. In some embodiments, the second predetermined angle range may be less than −3 degrees. In some embodiments, the second predetermined angle range may be less than −2.5 degrees. In some embodiments, the second predetermined angle range may be less than −2 degrees. In some embodiments, the fifth predetermined time may be determined by a machine or a user. For example, the fifth predetermined time may be 1 second, 2 seconds, 3 seconds, 4 seconds, 5 seconds, etc. Values of the second predetermined angle range and the fifth predetermined time are merely reference values, which are not limited herein. In practice, the second predetermined angle range and the fifth predetermined time are determined as long as the accumulation error of the gyroscope sensor is eliminated. In some embodiments, the processing module 220 may store the accumulated error of the gyroscope sensor in the storage module.

In some embodiments, the dormant state may refer to a default state of the gyroscope sensor and/or the accelerometer when delivered from factory. In some embodiments, the dormant state may refer to a non-operation state or a low power consumption state of the gyroscope sensor and/or the accelerometer. In the dormant state, most or all elements of the gyroscope sensor may be in the non-operation state. For example, elements that perform the angular velocity detection may be in the non-operation state. In addition, when the gyroscope sensor is in the dormant state, elements or interfaces related to the wake-up function, and elements or interfaces related to power supplying are still in the operation state. Similarly, when the accelerometer is in the dormant state, most or all elements of the accelerometer may be in the non-operation state, and only elements or interfaces related to the wake-up function and power supply are still in the operation state.

Merely by way of example, the accelerometer may support three different states, that is, a dormant state, a low power consumption operation state, and a high power consumption operation state. The low power consumption operation state may refer to a state in which the accelerometer fails to accurately calculate the acceleration value, but may roughly determine whether the acceleration is equal to 0 or greater than a threshold. The high power consumption operation state may refer to a state in which the accelerometer can accurately calculate the acceleration value. It should be noted that in the present disclosure, the term "operating state" refers to a normal operation state, that is, the high power consumption operation state, unless otherwise specified or otherwise limited.

The wake-up mentioned in the present disclosure may include entering the operation state from the dormant state, preparing to enter the operation state, and entering the high power consumption state from the low power consumption state. Merely by way of example, the accelerometer may support three different states, that is, a dormant state, a low power consumption operation state, and a high power consumption operation state. In some embodiments, the wake-up signal may cause the accelerometer to enter the high power consumption operation state from the dormant state. In other embodiments, the wake-up signal may cause the accelerometer to enter the high power consumption operation state from the low power consumption operation state. As another example, the gyroscope sensor may support two different states: a dormant state and an operation state. The wake-up signal may cause the gyroscope sensor to enter the operation state from the dormant state.

In some embodiments, the wake-up signal may be a signal generated by the smart lock system after the identity verification of the user is confirmed by the smart lock 130-1. In some embodiments, the wake-up signal may be generated by the smart lock system when the user touches or operates one or more elements of the smart lock 130-1 (e.g., the manual knob 21, inserting a key into a key hole, opening a key hole cover, turning a handle, touching the handle, etc.). In some embodiments, the wake-up signal may be a signal generated by the smart lock system when the gyroscope sensor and/or the accelerometer is powered on for a first time or re-powered after being powered off. In some embodiments, a sensor (e.g., an infrared sensor, a pressure sensor, etc.) may be disposed near the bolt, and the sensor may generate a signal when the bolt is ejected or retracted. The signal may be determined as the wake-up signal to wake up the gyroscope sensor and/or the accelerometer. In some embodiments, the wake-up signal may also be generated by a position sensor (e.g., the angle sensor 512) when the battery of the control panel 60 is insufficient. For example, the position sensor powered by a standby power source (e.g., a farad capacitor, etc.) may detect the power or a level state of the control panel 60 or the battery supplying power. When it is detected that the control panel 60 or the battery is low, the wake-up signal may be generated.

Figure 32:
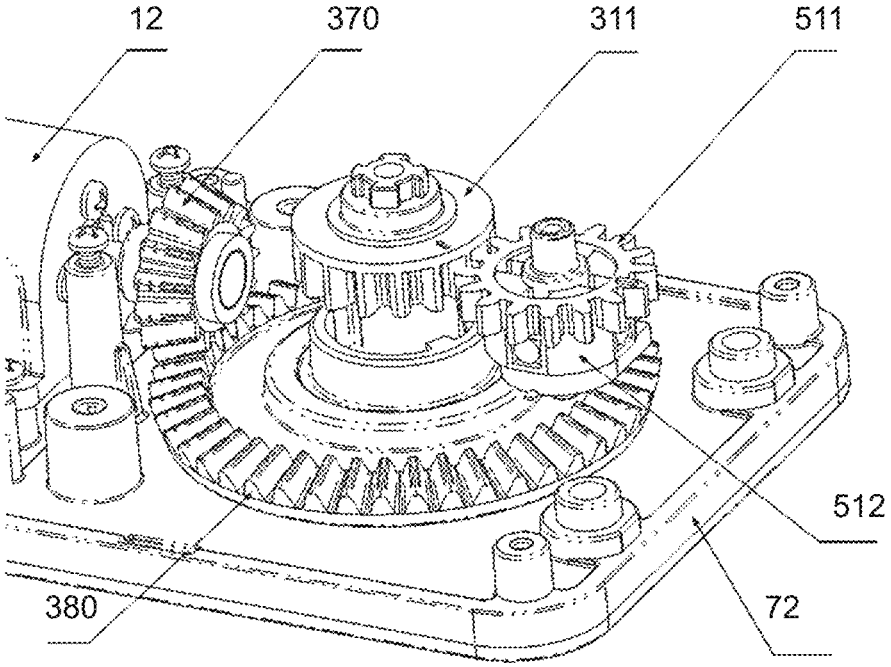
FIG. 32 is a schematic diagram illustrating a smart lock system according to some embodiments of the present disclosure.
Figure 33:
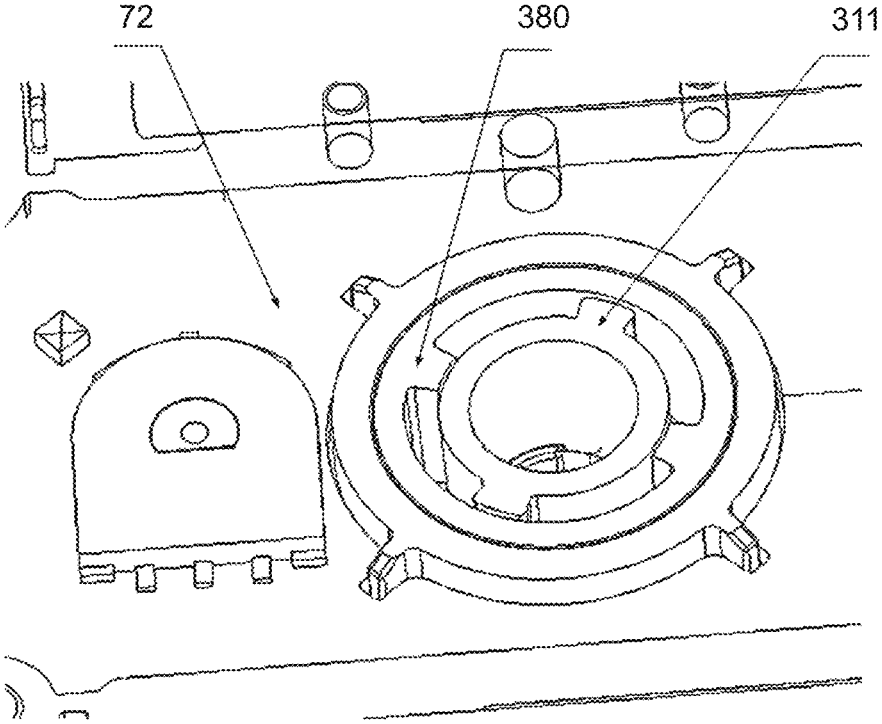
FIG. 33 is a partial schematic diagram illustrating a rear surface of a control panel shown in FIG. 32.

Taking the transmission component in one or more embodiments illustrated in FIG. 12 to FIG. 14 as an example, other detection schemes besides the gyroscope may be illustrated in detail referring to FIG. 32 and FIG. 33.

Referring to FIG. 32 to FIG. 33, FIG. 32 is a schematic diagram illustrating a smart lock system according to some embodiments of the present disclosure; and FIG. 33 is a partial schematic diagram illustrating a rear surface of a control panel shown in FIG. 32. Still referring to FIG. 32 to FIG. 33, in some embodiments, the smart lock may include the control panel 60, the first detection assembly 51, and the induction assembly 80. The first detection assembly 51 and the induction component 80 may be electrically or signally connected to the control panel 60, respectively. The induction component 80 may be adapted to a lock body shaft, and configured to detect a starting motion of the lock body shaft from stationary to rotation and to send a wake-up signal to the control panel 60. Under normal circumstances, the control panel 60 is in a dormant state, that is, in a low power consumption state, until the control panel 60 is waken up in response to receiving the wake-up signal from the induction assembly 80. The control panel 60 may also be configured to wake up the first detection assembly 51 in response to being waken up. The first detection assembly 51 may be adapted to the lock body shaft. In some embodiments, the first detection assembly 51 may send a detected angular displacement of rotation of the lock body shaft to the control panel 60, and the control panel 60 may determine a state (the door body is in an open or closed state) of a door body based on the angular displacement of the rotation of the lock body shaft.

In some embodiments, the smart lock system may further include the gearbox 122 and a transmission assembly. The gearbox 122 may be integrated with a motor and a gear assembly. The transmission assembly may include a driving member (e.g., the driving bevel gear 370) and a driven member (e.g., the output gear 311). The driving member (e.g., the driving bevel gear 370) may be in a transmission connection to the motor, the driven member (e.g., the output gear 311) and the lock body shaft may be coaxially rotatable, and the driving component 12 (e.g., the motor) may drive, via the transmission assembly, the lock body shaft to rotate to open or close the lock body. The driven member (e.g., the output gear 311) may be also in a coaxial transmission with the manual knob 21. The manual knob 21 may be located inside the door, and configured to lock and unlock the smart lock.

In some embodiments, the first detection assembly 51 may include an angle sensor and a rotation detection member that is in transmission connection to the lock body shaft. The angle sensor may be fixedly disposed relative to the rotation detection member, and a current position of the lock body shaft may be determined based on an angular position of the rotation detection member. In some embodiments, the rotation detection member may be any rotation member that is in transmission connection to the lock body shaft. For example, the rotation detection member may be the output gear 311 disposed on the lock body transmission member 310. As another example, the rotation detection member may also be an additionally configured rotation member, that is, the detection gear 511 engaged with the output gear 311. As shown in FIG. 32, the first detection assembly 51 may include the detection gear 511 that is in transmission connection to the output gear 311, and the angle sensor 512 disposed coaxially with the detection gear 511. The angle sensor 512 may be connected to the detection gear 511, and configured to obtain an angle signal and output the obtained angle signal to the control panel 60. The control panel 60 may determine a locked and unlocked state of the smart lock based on the rotation angle of the lock body shaft.

For instance, when the smart lock is not locked or unlocked, the control panel 60 may be in a dormant state to reduce power consumption. Once the lock body shaft rotates, the control panel 60 may be rapidly waken up by the induction assembly 80 for subsequent control. In some embodiments, in order to detect the starting motion of the lock body shaft from stationary to rotation, the induction assembly 80 may include a first induction element and a second induction element. The first induction element may be fixedly mounted on the output gear 311 or the detection gear 511. The second induction element may be fixedly mounted on the lock body shaft. When the lock body shaft rotates, the first induction element and the second induction element may be relatively rotated, and the second induction element may be triggered to send a wake-up signal to the control panel 60.

In some embodiments, the first induction element and the second induction element may be a first magnetic element or a Hall sensor, and the induction element of the induction assembly 80 may be mounted on the output gear 311 or the detection gear 511. The embodiment is described by taking the arrangement on the output gear 311 as an example. In some embodiments, a count of Hall sensors and/or a count of first magnetic members may be more than two, and the elements may be uniformly disposed around the rotation axis of the output gear 311. In some embodiments, the count of Hall sensors may be at least two, and the sensors may be uniformly disposed around a rotation axis of the output gear 311. The count of first magnetic members may be at least two, and the members may be uniformly disposed around the rotation axis of the output gear 311. The count of Hall sensors and the count of first magnetic members may be both at least two, and the Hall sensors and the first magnetic members may be uniformly disposed around the rotation axis of the output gear 311. In this case, the count of Hall sensors may be the same as or different from the count of first magnetic members.

In addition, since the lock body shaft and the manual knob 21 are in coaxial transmission with the output gear 311, the first magnetic member may be fixedly connected to the lock body shaft, the output gear 311, or the manual knob, so that the first magnetic member and the lock body shaft are relatively fixed. The Hall sensor may be welded and fixed to the control panel 60, and electrically or signally connected to the control panel 60, so that the Hall sensor rotates relative to the first magnetic member and sends the wake-up signal to the control panel 60.

In some embodiments, the first induction element 81 may be a first magnetic member, and the second induction element 82 may be a Hall sensor, so that the overall shame of the induction assembly 80 is simple and reliable. In addition, the Hall sensor may be triggered even in the case of being not directly connected to the magnetic induction element. Therefore, the mounting is convenient, and the cost is low. Further, no direct contact between the Hall sensor and the magnetic induction element may reduce friction when the two elements rotate relative to each other, and ensure the service life.

In other embodiments, the induction assembly 80 may also use other implementations, for example, infrared pair tubes, electric brushes, etc. The specific form of the induction assembly is not limited in the present disclosure, as long as the induction assembly can detect the starting motion of the lock body shaft from stationary to rotation and send the wake-up signal to the control panel.

In some embodiments, the output gear 311 and the detection gear 511 may be gears that are engaged with each other. As shown in FIG. 32, to facilitate the arrangement of the gears in the housing of the lock body, the detection gear 511 may be disposed on a radial side of the output gear 311.

As shown in FIG. 32, in some embodiments, the transmission assembly may further include an intermediate transmission member (e.g., the driven bevel gear 380). The intermediate transmission member (e.g., the driven bevel gear 380) may be disposed to be coaxial with the driven member (e.g., the output gear 311) and engaged with the driving member (e.g., the driving bevel gear 370). Moreover, from the rear surface of the sealing plate 72 shown in FIG. 33, the intermediate transmission member (e.g., the driven bevel gear 380) and the driven member (e.g., the output gear 311) may be disposed with mutually matched vacancy rotation connection structures (or clutch mechanisms). When the intermediate transmission member (e.g., the driven bevel gear 380) and the driven member (e.g., the output gear 311) rotate within a vacancy rotation stroke, the user may manually unlock the smart lock more easily and less laboring. In some embodiments, when the driven bevel gear 380 rotates in one direction, the driven bevel gear 380 may be clamped with the output gear 311 and drive the output gear 311 to rotate as well. Then, the driven bevel gear 380 may rotate in a reverse direction. When the vacancy rotation stroke is not exceeded, the output gear 311 may not follow the driven bevel gear 380 to rotate, thereby leaving a space for manually turning the manual knob 21 to rotate the output gear 311.

In some embodiments, the driving component 12 may drive, via the transmission assembly as described in the above embodiments, the lock body to rotate, thereby achieving unlocking or locking of the smart lock. In some embodiments, the transmission assembly may include a driving member and a driven member that is in the transmission connection to the driving member. In some embodiments, the transmission assembly may further include an intermediate transmission member that is in the transmission connection between the driving component and the driven member. In some embodiments, the driving member and the intermediate transmission member may be the driving bevel gear 370 and the driven bevel gear 380 that are engaged with each other, and the driven member may be the output gear 311 disposed on the lock body transmission member 310. In some embodiments, more descriptions regarding the driving component, the driven member, and the intermediate transmission member in the transmission assembly may be found elsewhere in the present disclosure.

In some embodiments, in addition to detecting whether the lock body shaft is moving and determining the angular displacement of the lock body shaft, so as to detect the action of the lock body shaft with low power consumption in the standby state, the smart lock system may also detect rotation of the output shaft of the motor. In some embodiments, the smart lock system may further include a second detection assembly electrically or signally connected to the control panel 60. The second detection assembly may be connected or adapted to the transmission assembly, and send an angular displacement of the rotation of the output shaft detected by the transmission assembly to the control panel 60.

In some embodiments, the second detection assembly may include a third induction element (not shown in the drawings) and a fourth induction element (not shown in the drawings). The third induction element may be fixedly mounted on the driven bevel gear 380 or the driving bevel gear 370, and the fourth induction element may be fixedly mounted on the lock body shaft. When the output shaft of the motor rotates, the third induction element and the fourth induction element may rotate relative to each other, and the fourth induction element may be triggered to detect an angular displacement of the third induction element.

In the embodiment, the third induction element may be a second magnetic member, and the fourth induction element may be a magnetic encoder. A mounting position of the magnetic encoder should be set according to a position of the second magnetic member. For example, when the second magnetic member is mounted on the driven bevel gear 380, the magnetic encoder may be fixedly mounted on the sealing plate 72 of the lock body. When the second magnetic member is mounted on the driving bevel gear 370, the magnetic encoder may be fixedly mounted on the control panel of the lock body.

In other embodiments, the second detection assembly may also use other implementations, for example, a magnetic code disc, an infrared pair tube code disc, an angle sensor, etc., as long as the angular displacement of the rotation of the output shaft may be detected by the transmission component and sent to the control panel 60.

For example, the second detection assembly may be configured as an infrared code disk. For example, black and white color bars may be disposed on the driving bevel gear 370 or the driven bevel gear 380, a count of pulses may be detected by the infrared pair tube, and the rotation angle may be obtained based on the count of pulses. Alternatively, the second detection assembly may also be configured as a magnetic code disc. For example, a magnetic ring may be fixedly disposed on the driving bevel gear 370 or the driven bevel gear 380, a count of pulses may be detected by the Hall sensor, and the rotation angle may be obtained based on the count of pulses. Optionally, the second detection assembly may also be configured as a gyroscope. The gyroscope may be fixedly connected to the driving bevel gear 370 or the driven bevel gear 380, and the gyroscope may obtain the rotation angle while the gyroscope is rotating.

According to the embodiment, the rotation angle may be detected by the magnetic encoder and the second magnetic member, so that the second detection assembly has a high detection accuracy, and a strong anti-interference capability, and thus the mounting is convenient and the cost is low.

The operation principle of the smart lock system according to the embodiments of the present disclosure may be as follows.

a) Rotation of the lock body shaft/the manual knob 21 may be detected.

Since the lock body shaft and the manual knob 21 are in coaxial transmission with the output gear 311, and the detection gear 511 and the output gear 311 are engaged with each other, when the lock body shaft or the manual knob 21 rotates, the detection gear 511 engaged with the lock body shaft or the manual knob 21 may rotate, and a position of the lock body shaft/the manual knob 21 may be accurately detected by the angle sensor 512 connected to the detection gear 511.

b) Rotation of the output shaft of the motor may be detected.

The driving bevel gear 370 may be driven by the output shaft of the motor. The driven bevel gear 380 may be engaged with the driving bevel gear 370. When the output shaft of the motor rotates, the driven bevel gear 380 and the driving bevel gear 370 may rotate. The driven bevel gear 380 or the driving bevel gear 370 may be disposed with the second magnetic member that cooperates with the magnetic encoder. The rotation angle of the second magnetic member may be detected by the magnetic encoder, so that the rotation angle of the output shaft of the motor is obtained. In some embodiments, the rotation angle may be detected through a position sensor. For example, the position sensor may be used to detect a displacement of the output shaft, and the rotation angle may be determined based on the displacement. Using different detection manners, the rotation angle may be obtained accurately, which improve the control of the smart lock.

c) The motion of the lock body shaft may be detected in the standby state with low power consumption.

When operating normally, the angle sensor has high power consumption, while the Hall sensor has small power consumption. If the angle sensor 512 is in the normal operation state for a long time, the service life of the smart lock 130-1 may be shortened. Therefore, in the standby state, the Hall sensor with small power consumption may be used to replace the angle sensor. Since the output gear 311 or the detection gear 511 is disposed with the first magnetic member that cooperates with the Hall sensor, the control circuit may turn off the angle sensor 512 in the standby state. The Hall sensor may be used to detect the motion of the lock body shaft. Once the lock body shaft moves, the motion may be perceived by the Hall sensor, and the control circuit may immediately power on and wake up the angle sensor 512.

As shown in FIG. 32, in some embodiments, an outer diameter of the driven bevel gear 380 may be 2 to 3 times an outer diameter of the output gear 311. In order to save space as much as possible, the angle sensor 512 may be disposed between the detection gear 511 and the driven bevel gear 380, and the driving bevel gear 370 may be disposed on the other side of the output gear 311 opposite to the detection gear 511.

As shown in FIG. 33, the vacancy rotation stroke between the driven bevel gear 380 and the output gear 311 may be within a range from 120 degrees to 170 degrees.

In this disclosure, the positions of the magnetic encoder and the Hall sensor are not limited. For example, the magnetic encoder or the Hall sensor may be fixed to a mounting plate of the drive mechanism. The magnetic decoder and the Hall sensor may be fixedly connected to the control panel 60. Therefore, the overall structure may be more regular. In addition, after the magnetic encoder and the Hall sensor are fixedly connected to the control panel 60, a distance between the Hall sensor 811 and the magnetic induction element 821 and a distance between the magnetic encoder 522 and the magnetic member 521 may be within a detectable range of good signals, thereby ensuring the detection accuracy.

Structures of the first magnetic member and the second magnetic member may not be limited in the present disclosure. For example, the structure may include a block shape, a strip shape, a magnetic ring, etc. In practical applications, the second magnetic member may be embedded on a small end surface of the driving bevel gear 370. The first magnetic member may be a circular ring disposed on the output gear 311, and an axis of the circular ring may be coincident with the axis of the output gear 311.

The present disclosure also provides a smart lock 130-1. The smart lock 130-1 may include the smart lock system as described in the above embodiments. Since the smart lock system according to the above embodiments achieves the above technical effects, the smart lock 130-1 of the smart lock system may also achieve the above technical effects, which are not repeated herein.

It should be noted that one or more detection schemes disclosed in one or more embodiments in the present disclosure (e.g., the detection based on the angle sensor, the detection based on the Hall sensor and the magnetic induction member, the detection based on the gyroscope and the accelerometer detection, etc.) may be combined with other transmission structures, and the corresponding sensor positions may be changed according to different transmission mechanisms. In addition, one or more of the detection schemes in the present disclosure may be used in combination with any scene in the smart security device that requires a position detection or a motion detection. For example, the schemes may be applied to a smart lock state detection, a door body state detection, a clutch position detection of the clutch mechanism, or the like, or any combination thereof.

The possible beneficial effects of the embodiments of the present disclosure may include, but not be limited to the following. (1) When a lock body is active, a control panel in a low power state may be rapidly waken up to perform subsequent operations. (2) Power consumption of the control pane may be reduced and the battery life of the control panel may be improved. (3) After the motor rotates to an operation station to unlock or lock a lock body, the control panel may control the motor to reversely rotate, so that a transmission between the motor and the lock body is disconnected in a certain angular range, which causes the clutch structure to be an operation vacancy. Manual unlocking by a user may be labor-saving. (4) Modularizing or integrating at least a portion of the parts of the smart lock may facilitate assembly and improve assembly efficiency. (5) A sealing plate may be fixed relative to an assembly plate by the rotation of the intermediate plate between two positions, which may improve the assembly efficiency. It should be noted that different embodiments may have different beneficial effects. In different embodiments, the possible beneficial effects may be any one or a combination thereof, or any other beneficial effects that may be obtained.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures, or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer-readable media having computer-readable program code embodied thereon.

A non-transitory computer-readable signal medium may include a propagated data signal with computer readable program code embodied therein, for example, in baseband or as part of a carrier wave. Such a propagated signal may take any of a variety of forms, including electromagnetic, optical, or the like, or any suitable combination thereof. A computer-readable signal medium may be any computer-readable medium that is not a computer-readable storage medium and that may communicate, propagate, or transport a program for use by or in connection with an instruction execution system, apparatus, or device. Program code embodied on a computer-readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object-oriented programming language such as Java, Scala, Smalltalk, Eiffel, JADE, Emerald, C++, C #, VB. NET, Python, or the like, conventional procedural programming languages, such as the "C" programming language, Visual Basic, Fortran, Perl, COBOL, PHP, ABAP, dynamic programming languages such as Python, Ruby, and Groovy, or other programming languages. The program code may execute entirely on the users computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution, e.g., an installation on an existing server or mobile device.

Similarly, it should be appreciated that in the foregoing description of embodiments of the present disclosure, various features are sometimes grouped together in a single embodiment, figure, or description thereof to streamline the disclosure aiding in the understanding of one or more of the various inventive embodiments. This method of disclosure, however, is not to be interpreted as reflecting an intention that the claimed object matter requires more features than are expressly recited in each claim. Rather, inventive embodiments lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A system for smart security, comprising:

a smart security device, a control module, a driving module, and a mechanical structure; wherein the control module is configured to send a control instruction to the driving module, the driving module is configured to drive the mechanical structure based on the control instruction to perform a state switching operation on the smart security device, the smart security device includes a smart lock, the smart lock including a lock body structure, and the mechanical structure includes a transmission assembly disposed between the driving module and the lock body structure, the transmission assembly being configured to connect the driving module and the lock body structure in a transmission connection, wherein the transmission assembly includes a lock body connection member, the lock body connection member being configured to drive the lock body structure to rotate; and the transmission assembly further includes a clutch mechanism, the clutch mechanism being configured to couple or separate the driving module and the lock body connection member during a rotation transmission process.

2. The system of claim 1, wherein the clutch mechanism includes a planet transmission assembly, the planet transmission assembly including a sun gear, a planet carrier, a first planet gear, and a second planet gear, the first planet gear and the second planet gear being disposed on the planet carrier;

the driving module is configured to drive the sun gear to rotate, rotations of the first planet gear and the second planet gear driven by the sun gear causing the planet carrier to swing between a first position and a second position;

when the planet carrier is in the first position, a first coupling relationship is formed between the first planet gear and the lock body connection member; and when the planet carrier is in the second position, a second coupling relationship is formed between the second planet gear and the lock body connection member; wherein the planet carrier further has a transitional rotation stroke between the first position and the second position.

3. The system of claim 2, wherein the driving module further includes a driving component and a reduction stage that is connected to the driving component through a transmission connection, and the planet transmission assembly is disposed between a final-stage element of the reduction stage and the lock body connection member.

4. The system of claim 1, wherein the clutch mechanism includes an output member connected to a driving component through a transmission connection; the output member being configured to drive the lock body connection member to rotate;

a first abutment member is disposed on the output member, a second abutment member is disposed on the lock body connection member;

the first abutment member is positioned to abut the second abutment member along a first direction to form a first abutment operation station; and the first abutment member is positioned to abut the second abutment member along a second direction to form a second abutment operation station; wherein the first abutment member and the second abutment member are positioned to separate from each other to form an operation vacancy; and the first direction is opposite to the second direction.

5. The system of claim 4, wherein the transmission connection between the driving component and the output member includes a bevel gear transmission.

6. The system of claim 1, wherein the system further includes a detection module, the detection module being configured to detect a current state of a lock body shaft; wherein the detection module includes a first detection assembly and a control panel connected to the first detection assembly.

7. The system of claim 6, wherein the first detection assembly includes an angle sensor and a rotation detector that is connected to the lock body shaft through a transmission connection, the angle sensor being fixedly disposed relative to the rotation detector.

8. The system of claim 4, wherein the system further includes a detection module, the detection module including a second detection assembly and the control panel being connected to the second detection assembly; and when the driving component drives the lock body shaft to a locked state along the second direction at the second abutment operation station, the driving component drives the first abutment member to reverse, and the second detection assembly is configured to detect a reversal angle of the first abutment member.

9. The system of claim 8, wherein the second detection assembly includes a magnetic member and a magnetic encoder that is disposed corresponding to the magnetic member, wherein the magnetic member is disposed on the output member or an output shaft of the driving component; and the magnetic encoder is disposed on the control panel.

10. The system of claim 6, wherein the detection module further includes an induction assembly; the induction assembly including a first induction element and a second induction element, the first induction element being fixedly disposed relative to the lock body connection member; and the second induction element being configured to rotate relative to the first induction element; and the rotation of the lock body shaft is configured to drive the first induction element to move relative to the second induction element and trigger the first induction element or the second induction element to send a wake-up signal to the control panel.

11. The system of claim 10, wherein the first induction element includes a Hall sensor, and the second induction element includes a magnetic induction member.

12. The system of claim 6, wherein the first detection assembly includes a position sensor, the position sensor being disposed on the lock body shaft for detecting a rotation angle of the lock body shaft.

13. The system of claim 1, wherein the smart lock includes a mounting plate assembly, the mounting plate assembly being configured to mount the smart lock; wherein the mounting plate assembly includes a mounting plate and one or more sliding components.

* * * * *